US005799957A

United States Patent [19]

Okajima et al.

[11] Patent Number: 5,799,957

[45] Date of Patent: Sep. 1, 1998

[54] SNOWBOARD BINDING

[75] Inventors: Shinpei Okajima, Izumi; Yutaka Ueda, Tondabayashi, both of Japan

[73] Assignee: Shimano, Inc., Osaka, Japan

[21] Appl. No.: 760,953

[22] Filed: Dec. 6, 1996

Related U.S. Application Data

[60] Division of Ser. No. 348,844, Nov. 28, 1994, which is a continuation-in-part of Ser. No. 254,889, Jun. 6, 1994, abandoned.

[51] Int. Cl.[6] ..... A63L 9/00

[52] U.S. Cl. ..... 280/14.2; 280/607; 280/613; 280/624; 280/632

[58] Field of Search ..... 280/11.3, 607, 280/613, 617, 618, 620, 623, 624, 625, 626, 627, 631, 632, 634, 14.2; 36/115, 117.1, 117.3

[56] References Cited

U.S. PATENT DOCUMENTS

| | | | |
|---|---|---|---|
| Re. 33,544 | 2/1991 | Dennis et al. | 280/618 |
| 3,154,312 | 10/1964 | Marchand | 280/11.13 |
| 3,471,161 | 10/1969 | Cabberley | 280/11.35 |
| 3,775,875 | 12/1973 | Dvorsky | 36/117.3 |
| 3,834,723 | 9/1974 | Erlebach | 280/11.35 |
| 3,900,204 | 8/1975 | Weber | 280/11.13 |
| 3,909,026 | 9/1975 | Salomea | 280/11.35 |
| 3,910,591 | 10/1975 | Salomon | 280/11.35 |
| 3,955,825 | 5/1976 | Kubelka et al. | 280/618 |
| 4,026,045 | 5/1977 | Druss | 36/117.3 |
| 4,165,889 | 8/1979 | Weinstein et al. | 280/626 |
| 4,184,696 | 1/1980 | Settembre | 280/615 |
| 4,270,770 | 6/1981 | Spademan | 280/624 |
| 4,275,904 | 6/1981 | Pedersen | 280/818 |
| 4,361,344 | 11/1982 | Hull | 280/613 |
| 4,392,666 | 7/1983 | Ramer | 280/614 |
| 4,571,858 | 2/1986 | Faulin | 36/117 |
| 4,652,007 | 3/1987 | Dennis | 280/618 |
| 4,728,116 | 3/1988 | Hill | 280/618 |
| 4,732,405 | 3/1988 | Freisinger et al. | 280/634 |
| 4,973,073 | 11/1990 | Raines et al. | 280/624 |
| 5,035,443 | 7/1991 | Kincheloe | 280/618 |
| 5,116,074 | 5/1992 | Peyre | 280/618 |
| 5,145,202 | 9/1992 | Miller | 280/613 |
| 5,236,216 | 8/1993 | Ratzek | 280/14.2 |
| 5,299,823 | 4/1994 | Glaser | 280/607 |
| 5,368,320 | 11/1994 | Teeter et al. | 280/14.2 |
| 5,505,477 | 4/1996 | Turner et al. | 36/117.3 |
| 5,544,909 | 8/1996 | Laughlin | 280/617 |
| 5,551,728 | 9/1996 | Barthel et al. | 280/818 |
| 5,558,355 | 9/1996 | Henry | 280/624 |

*Primary Examiner*—Brian L. Johnson
*Assistant Examiner*—Min Yu

[57] ABSTRACT

A snowboard binding for releasably connecting a boot to a snowboard. One embodiment of the invention includes inner and outer main bodies to receive a two-piece cleat. A second embodiment includes inner and outer hooks for hooking, and a latch for securing, a one-piece cleat. A third embodiment includes a front main body and a spring-loaded latch in a rear main body for engaging a one-piece cleat. A fourth embodiment engages a one-piece cleat with inwardly beveled, semi-circular inner and outer main bodies. A fifth embodiment engages a one-piece cleat with a front main body and a latch, fixedly mounted upon an axle, within a rear main body. The latch is biased toward the engaged position by a spring. In a sixth embodiment of the invention, a one-piece cleat is engaged with a front main body and two rear spring biased latches. In a seventh embodiment, among other things, the cleat is formed in two pieces.

23 Claims, 46 Drawing Sheets

FIG. 1

FIG. 2

SNOWBOARD BINDING

This is a divisional application from U.S. patent application Ser. No. 08/348,844, filed Nov. 28, 1994, which is a continuation-in-part of U.S. patent application Ser. No. 08/254,889, filed Jun. 6, 1994, now abandoned, the entire disclosures of which are incorporated herein by reference.

BACKGROUND OF THE INVENTION

The present invention relates generally to a snowboard binding. More specifically, the present invention relates to a binding mechanism affixed to a snowboard and a cleat affixed to a boot with the cleat being releasably engaged by the binding mechanism.

In the sport of snowboarding, a rider rides the snowboard down a snow covered hill. The snowboard is shaped generally like a small surfboard or a large skateboard without wheels. The rider stands with his feet generally transverse to the longitudinal axis of the snowboard. It is necessary to provide means to secure the rider's boots to the snowboard.

It is desirable to have a manual release for the snowboard binding that is easy for the rider to operate. This is advantageous when the rider wishes to dismount from the board and walk on the terrain, or when he wishes to release one foot and push himself a short distance on snow while the other foot is bound to the snowboard, or when the rider wants to disengage the binding to get on or off a lift. Therefore, it is desirable to have a snowboard binding which securely holds the boots to the snowboard, does not release when the rider falls, but is easy to manually release.

When the rider does walk in the snow, it is common for snow to be caked to the sole of the rider's snowboard boots. This interferes with remounting the boot onto the snowboard because snow becomes trapped between the sole of the boot and the top surface of the snowboard and in the binding mechanism itself, making it difficult to close and latch the mechanism. It is therefore desirable to have a boot and cleat design which is not prone to having snow stick to it. It is also desirable to have a cleat and binding design which operates despite the presence of snow on the cleat, the sole of the boot, or the top surface of the snowboard.

Since a rider may find himself on uneven terrain when he needs to engage his boots into the binding, it is also desirable to have a binding mechanism which operates with an easy step-in motion. Such a binding mechanism should make it easy to place the boot in the proper location relative to the binding and to engage the cleat with the binding by the step-in motion.

To provide secure engagement of the boot against the snowboard, it is desirable that the attachment points of the cleat be far apart from one another. This will securely hold the boot in place during riding and help prevent lift up of the heel during maneuvering. However, a large cleat makes it cumbersome to walk as it is prone to knocking against the rider's legs as he walks and also increases the stiffness of the sole of the boot making it more difficult to walk. There is therefore a need for a binding and cleat design which provides adequate binding strength, yet still allows the snowboard rider to walk easily when the boot is disengaged from the binding.

As a rider is using the snowboard, he may traverse rough terrain. If the cleat is mounted directly on the top surface of the snowboard, this increases the transmission of vibration through the snowboard into the rider's foot making riding uncomfortable. It is therefore desirable to have a cleat and binding design which absorbs vibration from the terrain which is transmitted through the snowboard.

A snowboard binding generally orients the rider's boots a fixed distance apart and transverse to the longitudinal axis of the snowboard. This can be uncomfortable for some riders. It is therefore desirable to have a binding mechanism and cleat design which allows for easy adjustment of the angular orientation of the boots relative to the longitudinal axis of the snowboard and also allows for adjustment of the spacing of the boots relative to one another.

Snowboard binding mechanisms are disclosed in U.S. Pat. No. 5,299,823 (Glaser), U.S. Pat. No. 5,236,216 (Ratzek), U.S. Pat. No. 5,145,202 (Miller), U.S. Pat. No. 4,973,073 (Raines), U.S. Pat. No. 4,728,116 (Hill), U.S. Pat. No. 3,900,204 (Weber), and U.S. Pat. No. Re. 33,544. U.S. Pat. No. 4,571,858 (Faulin) discloses a shoe sole for a ski binding.

SUMMARY OF THE INVENTION

The present invention overcomes all of the disadvantages of the prior art by providing a strong, compact, lightweight binding mechanism, cleat and boot design which provides secure engagement of the boot against the top surface of the snowboard and is easy to operate as described in the several embodiments set forth herein.

In one aspect of the invention, the snowboard boots each have a cleat in the form of two cleat pieces separated in the fore and aft direction to allow flexibility of the boot while walking, the cleat pieces extending beyond the sides of the boot to provide stability when engaged with the binding mechanism.

In another aspect of the invention, the binding mechanism has an inner main body and an outer main body, and the outer main body has a handle which is manually operated to easily release or engage and lock the cleats.

In another aspect of the invention, the handle may be locked in place to prevent unintended release of the cleat by the binding mechanism.

In another aspect of the invention, the inner main body of the binding mechanism has a flat top surface and is shorter than the outer main body of the binding mechanism, allowing the rider to place his boot on the inner main binding and slide it outwards until it engages the outer main binding, thereby properly locating the cleat for a step-in engagement of the cleat pieces with the binding mechanism.

In another aspect of the invention, the inner and outer main bodies of the binding mechanism are affixed to the snowboard by a pair of adjusting plates which allow angular and spacing adjustment of the position of the inner and outer binding bodies.

In another aspect of the invention, a one-piece main body of the binding mechanism has a pair of inner hooks and a pair of outer hooks which engage a one-piece cleat, and a latch to secure the cleat from unintentional release.

In another aspect of the invention, the pair of outer hooks is higher than the pair of inner hooks allowing the cleat to slide outward against the outer hooks after it has been placed on the top surface of the main body to allow an easy step-in engagement.

In another aspect of the invention, the one-piece cleat has a pair of bevel surfaces angled away from the boot to engage the top of the binding main body to provide proper location of the boot in the fore and aft direction relative to the binding to allow easy engagement of the binding with the cleat.

In another aspect of the invention, the cleat is maintained above the bottom surface of the boot to help prevent snow from sticking to the cleat and to help keep entrapped snow from preventing engagement of the binding.

In another aspect of the invention, the one-piece main body of the binding is held to the snowboard by a circular mounting plate which fits in a recess in the main body, such that the angular position of the main body can adjusted a full 360 degrees.

In another aspect of the invention, a one-piece cleat is engaged with the binding mechanism by stepping the boot in toward the toe to be engaged by a front main body and then lowering the heel to be engaged by a spring-loaded latch mounted in a rear main body.

In another aspect of the invention, the one-piece cleat extends approximately 140 mm in the fore and aft direction of the boot to reduce toe and heel lift.

In another aspect of the invention, the one-piece cleat is fixed under the mid-sole of the boot and is curved to fit the contour of the mid-sole.

In another aspect of the invention, inside and outside main bodies are provided to engage the cleat at the sides of the boot, with the inside main body having a top surface with a shallower bevel angle to the snowboard than the outer binding top surface bevel, providing better guidance during step-in engagement when the feet are placed far apart, causing the rider's leg to be at an angle from the normal to the snowboard.

In another aspect of the invention, the cleat may be disengaged from the snowboard by rotating the boot parallel to the top surface of the snowboard to provide easy disengagement.

In another aspect of the invention, a front and rear main body are provided to engage the cleat at fore and aft positions of the boot, wherein a one-piece cleat with rearwardly and forwardly extending tabs engages with the binding mechanism first by angling the front tab into the front main body and lowering the rear tab into the rear main body, engagement of the rear tab being accomplished by the rotation of an axle, parallel to the longitudinal direction of the snowboard, to which is affixed a latch that rotates into an engaged position over the rear tab.

In another aspect of the invention, the engaging portion of the rear main body is higher than the engaging portion of the front main body to allow for easy engagement of a one-piece cleat having a front section lower than its rear section.

In another aspect of the invention, rubber pads are affixed to the underside of both the front and rear sections of the one-piece cleat to eliminate contact of the boot outsole against the binding.

In another aspect of the invention, the one-piece cleat is strapped to the snowboard boot by the use of buckles located on the distal ends of the cleat front and rear sections, the buckles receiving the straps.

In another aspect of the invention, a front main body is provided for engagement with the front tab of a one-piece cleat, the cleat including two rearwardly disposed tabs to be engaged with two rear main bodies, the engagement of the rear tabs being accomplished by lowering handles which are mounted on bases and rotatably affixed to latches, the lowering of the handles causing the latches to rotate to such an extent that the rear tabs of the cleat are retained within cleat receiving grooves. The latches remain in this position without further force to the handles due to biasing springs on the axles upon which the latches are rotatably mounted.

In another aspect of the invention, the rider can lower the heel of the boot such that the rear tabs engage the latches in their engaged positions, with further downward pressure causing the latches to rotate into their released positions until the rear tabs become engaged with the cleat receiving grooves, wherein the latches bias back into their engaged positions.

The above and other aspects, structures and functions of the invention will be more readily understood from the following detailed description of the invention which is provided in connection with the accompanying drawings.

BRIEF DESCRIPTION OF THE DRAWINGS

FIG. 2(*b*) is a cross-sectional view taken along line II—II of FIG. 1 showing the binding in its release position;

FIG. 2(*c*) is a view like FIG. 2(*b*) showing the binding in its engaged position;

FIG. 32(*b*) is a back view of the binding of FIG. 32(*a*);

FIG. 32(*c*) is an enlarged cross-sectional view taken along the line XXXII(*c*)—XXXII(*c*) of FIG. 32(*a*) showing the latch and body plate, and also a cleat;

FIG. 32(*d*) is a side view of the release arm and hook of FIG. 32(*a*);

FIG. 33(*b*) is a view of the front main body of FIG. 32(*a*) in direction XXXIII(*b*) of FIG. 32(*a*);

FIG. 33(*c*) is a bottom view of the front main body of FIG. 33(*a*);

FIG. 34(*b*) is a top view of the rear main body of FIG. 34(*a*);

FIG. 34(*c*) is a side view of the rear main body of FIG. 34(*a*);

FIG. 34(*d*) is a bottom view of the rear main body of FIG. 34(*a*);

FIG. 40(*b*) is a side view of the cleat of FIG. 40(*a*);

FIG. 42(*b*) is a partial back view of the latches of FIG. 42(*a*) engaged with a cleat;

FIG. 43(*b*) is a side view of the cleat of FIG. 43(*a*);

FIG. 44(*b*) is a side view of the latch;

FIG. 45(*b*) is a side view of the base of FIG. 45(*a*);

FIG. 45(*c*) is a bottom view of the base of FIG. 45(*a*);

FIG. 47(*b*) is a top view of a handle mounting pin of FIG. 42(*a*);

FIG. 47(*c*) is a top view of a latch axle of FIG. 42(*a*);

DETAILED DESCRIPTION OF PREFERRED EMBODIMENTS

Figure 1:
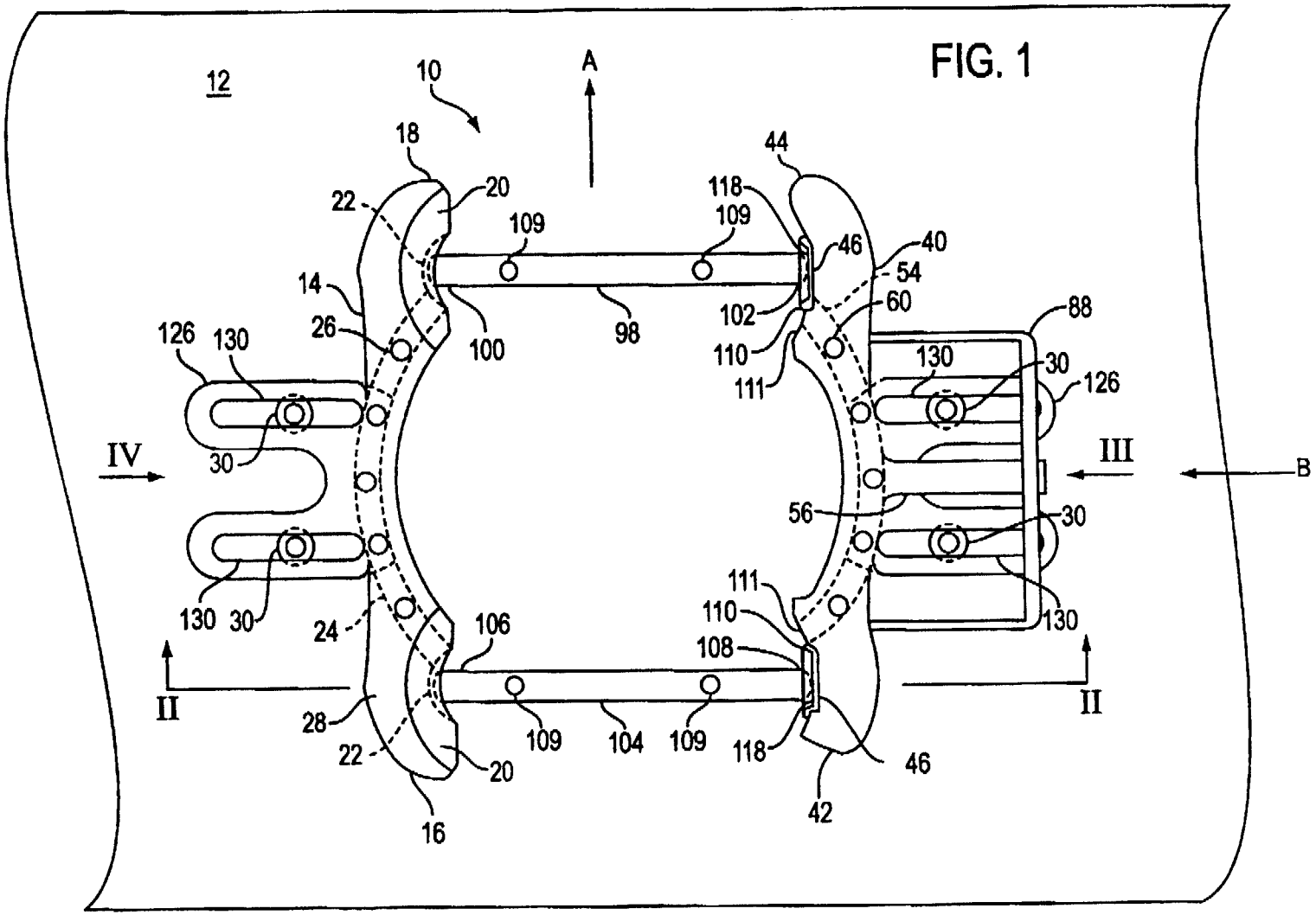
FIG. 1 is a top view of a first embodiment of a snowboard binding constructed in accordance with the present invention.
Figure 5:
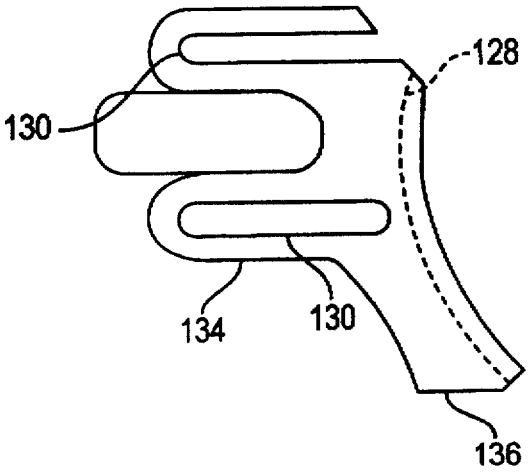
FIG. 5 is a top view of an alternate embodiment of a mounting plate used with the snowboard binding of FIG. 1.
Figure 6:
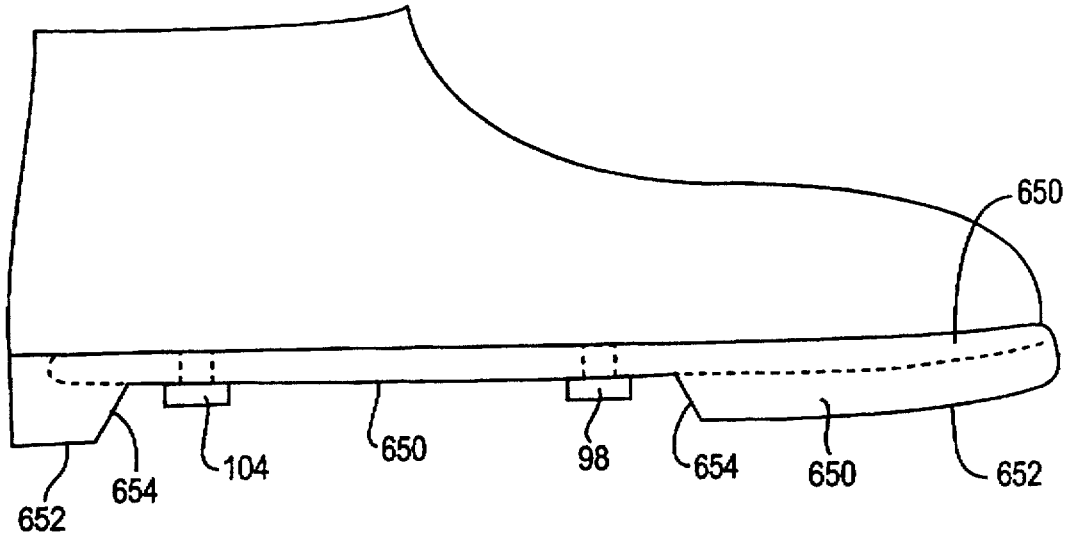
FIG. 6 is an elevational view showing the cleat of FIG. 1 mounted on a snowboard boot.
Figure 7:
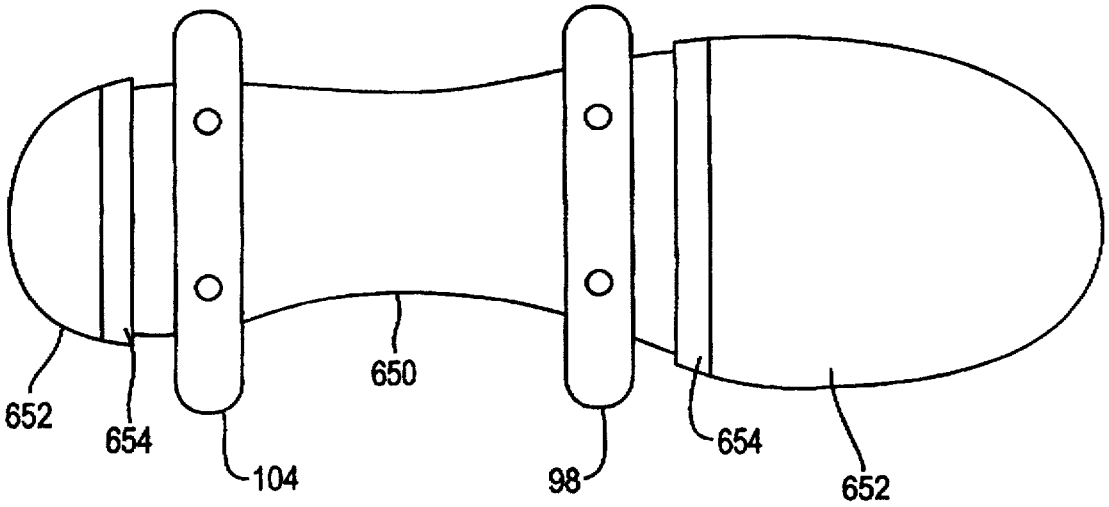
FIG. 7 is a bottom view of the cleat and boot of FIG. 6.

Referring now to the drawings, wherein like reference numerals indicate like elements, there is shown in FIG. 1 a first embodiment of a snowboard binding mechanism 10 constructed in accordance with the present invention. Binding mechanism 10 includes an inside main body 14 and outside main body 40 both affixed to the top surface of the snowboard 12. The binding mechanism 10 is designed to engage and disengage cleats 98 and 104 which are mounted to the underside of a snowboard boot (as shown in FIGS. 6 and 7). For clarity, the boot is not shown in FIGS. 1–5. In the arrangement illustrated, the front of the rider's boot points in direction A. The longitudinal axis of the snowboard extends in direction B toward the front of the snowboard for a rider who places his right foot near the rear of the snowboard and his left foot near the front. Thus, inside main body 14 will engage the ends of the cleats extending from the left side of the rider's right boot, while outside main body 40 will engage the ends of the cleats extending from the right side of the rider's right boot.

The inside main body 14 has first receptor 16 for engaging the first end 106 of the rear cleat 104 and second receptor 18 for engaging the first end 100 of the forward cleat 98. Outside main body 40 has first receptor 42 for engaging the second end 108 of the rear cleat 104 and second receptor 44 for engaging the second end 102 of the forward cleat 98.

Figure 2A:
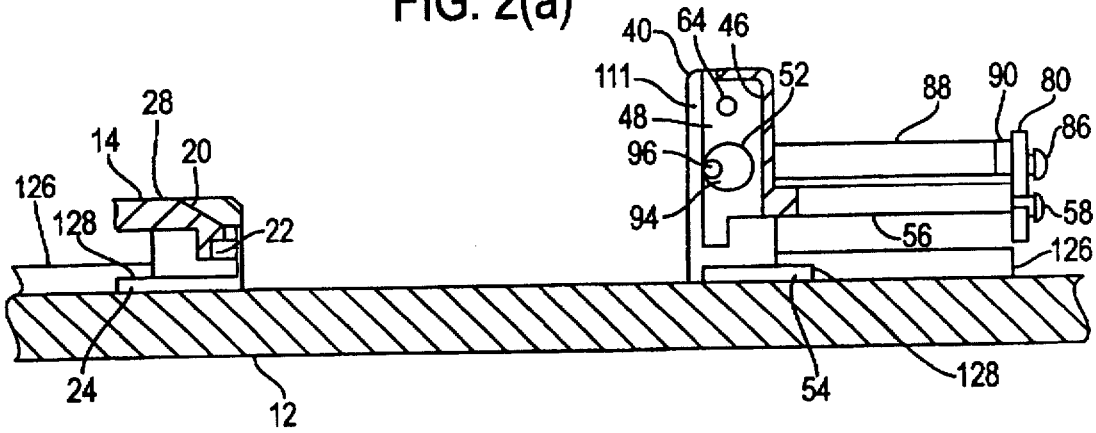
FIG. 2(*a*) is a cross-sectional view of the snowboard binding of FIG. 1 taken along line II—II with the latch removed for clarity.
Figure 2B:
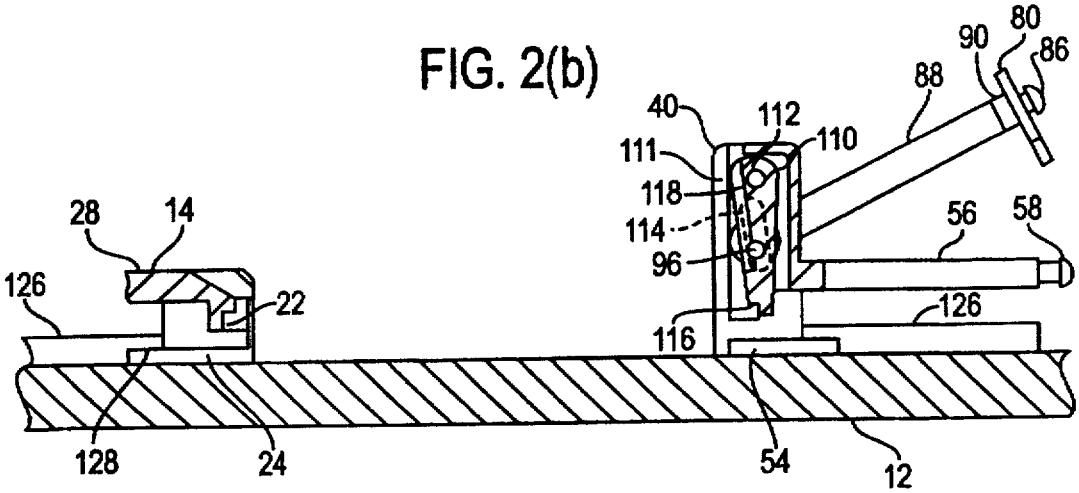

Inside main body 14 has top surface 28 which is generally planar and parallel to the top surface of the snowboard. The first receptor 16 and second receptor 18 of the inside main body 14 each have a cleat receiving groove 22 located on the lower portion of the receptors. The first receptor 16 and second receptor 18 both have a bevel surface 20 located on the top portion of the receptors. Bevel surfaces 20 help direct the first ends of the cleats downwardly toward the snowboard and to the correct location where the cleats 98 and 104 engage with receptors 16 and 18 during step-in. Inside main body 14 also has a mounting rail 24 which rests against the top surface of the snowboard. As seen in FIGS. 2(*a*), 2(*b*) and 2(*c*), the mounting rail 24 fits within a groove 128 of a mounting plate 126. Returning to FIG. 1, it is seen that the mounting plate 126 is held to the snowboard 12 by way of nuts 30 which are embedded in the snowboard and which receive bolts (not shown) inserted through the elongated holes 130 of the mounting plate 126. The elongated holes 130 allow for adjustment of the main body 14 in the longitudinal direction B of the snowboard.

Inside main body 14 also has threaded mounting bolt holes 26. Bolts (not shown) are screwed through the appropriate holes 26 aligned over the mounting plate 126 to secure the mounting rail 24 of the main body 14 to the groove 128 of mounting plate 126. The bolts may be loosened to allow angular adjustment of the inside main body 14 relative to the longitudinal axis B of the snowboard.

First receptor 42 and second receptor 44 of the outside main body 40 each have a latch recess 46 in which respective latches 110 are located. Adjacent the latch recesses 46 are taper surfaces 111. As seen in FIGS. 2(*a*), 2(*b*), 2(*c*) and 3, latch recesses 46 are formed by first side wall 48 and second side wall 50. A latch bolt 62 extends through holes 64 and provides a means for pivotally mounting latch 110 within the latch recess 46. For clarity, only a single recess 46 is illustrated in FIG. 3, but it should be understood that both the first receptor 42 and the second receptor 44 have a latch 110 and latch recess 46. As seen in FIG. 2(*a*), a hole 52 is also formed in first side wall 48 for supporting a cam 94. Cam 94 is free to rotate within hole 52. Cam 94 has extending from it into the latch recess 46 a cam pin 96 for engaging with latch 110 as described below. The latch 110 is not shown in FIG. 2(*a*) to better illustrate the cam 94 and cam pin 96.

The outside main body 40 is mounted to the snowboard 12 by a mounting rail 54 and mounting plate 126 in a manner similar to that of inner body 14. Bolts (not shown) are screwed through the appropriate holes 60 to secure the mounting rail 54 to groove 128 of mounting plate 126. The bolts are placed in the appropriate holes after the angular position of the binding is adjusted. The mounting plate 126 is secured to the snowboard 12 by means of bolts (not shown) inserted through elongated holes 130 into embedded nuts 30. The mounting plates 126 shown in FIG. 1 allow angular adjustment of up to about 30° in either direction of the inside and outside main bodies. Alternatively, mounting plates 134 may be used as shown in FIG. 5. Mounting plate 134 includes an extension portion 136 to allow angular adjustment of up to 45°. Having two mounting plate configurations allows use of the smaller, more compact mounting plate 126 for most applications to save weight.

As seen in FIGS. 2(*b*) and 2(*c*), latch 110 has pivot hole 112 through which latch bolt 62 extends such that latch 110 pivots about latch bolt 62. Latch 110 has formed in one side thereof a cam groove 114 for receiving the cam pin 96 of cam 94. Each latch 110 also has a cleat receiving groove 116 formed on a lower end thereof for receiving the second end of the cleat. Cleat receiving grooves 22 of the inner main body 14 and cleat receiving grooves 116 of the outer main body face one another. Latch 110 also has recess 118 on the front surface thereof to allow the second end of the cleat to step in down through the latch recess 46 for engagement by the binding mechanism.

As seen in FIG. 1, a generally "U" shaped handle 88 is supported at one end by the first receptor 42 and at its other end by second receptor 44 of the outside main body 42. As shown in FIG. 3, each cam 94 is affixed to opposite ends of the handle 88 to rotate therewith. As seen in FIG. 2(*b*), when handle 88 is raised to a first position, cam 94 and pin 96 are rotated. Because pin 96 is engaged in groove 114 of latch 110, raising handle 88 to a first position causes latch 110 to rotate with cam 94 and pin 96 so that cleat receiving groove 116 moves away from the cleat 104 to its release position. The outer main body 40 is placed in this position to allow a rider to step into the binding with cleat 104 and to allow cleat 104 to be released from the binding.

As seen in FIG. 2(*c*), lowering handle 88 to a second position causes cam 94 and pin 96 to rotate in an opposite direction, thereby causing latch 110 to rotate to its engaged position, moving cam receiving groove 116 against the second end 108 of the cleat 104. Cleat 104 will now be secured at its first end 106 in groove 22 of inner main body 14, and at its second end 108 by the groove 116 of the latch 110 mounted in the outer main body 40. Although a rear cleat 104 is illustrated in FIG. 2(*c*), front cleat 98 is affixed by the second receptors 18 and 44 in a similar fashion upon rotation of handle 88.

As seen in FIG. 3, when handle 88 is lowered into its second position causing the latches 110 to be engaged with cleats 104 and 98, hook 80 may be engaged with a tab 58 to prevent unintended release of handle 88. Hook 80 is pivotally mounted to handle 88 by a bolt 86. Tab 58 is affixed to tab support 56 extending from the rear of outside main body 40. Hook 80 has groove 84 which engages with tab 58. Hook 80 can be released by means of a cord (not shown) attached to elongated hole 82 of the hook 80. Bushing 90 (FIGS. 2(*a*), 2(*b*), 2(*c*)) is mounted on bolt 86 between handle 88 and hook 80.

As seen in FIGS. 2(*a*), 2(*b*) and 2(*c*), the top surface 28 of the inside main body 14 is lower than the top surface of the outside main body 40. This helps make the step-in operation easier as follows. The snowboard rider can place his boot on top surface 28 of inside main body 14 and slide the boot in the direction opposite arrow B until it is stopped by the relatively taller receptors 42 and 44 of the outside main body 40. This will provide for easy location of the boot relative to the binding mechanism in the longitudinal direction of the snowboard in preparation for step-in engagement. Bevel 20 on the inside main body and recess 118 on the latch 110 of the outside main body help guide the ends of the cleats down into the binding mechanism where the appropriate ends of the cleat respectively engage with groove 22 and with an area just in front of groove 116. After the rider steps in, the handle 88 may be lowered to its second position as shown in FIG. 2(*c*) to rotate latch 110 and securely engage the cleat. Hook 80 may then be secured to tab 58 to prevent disengagement.

Figure 8:
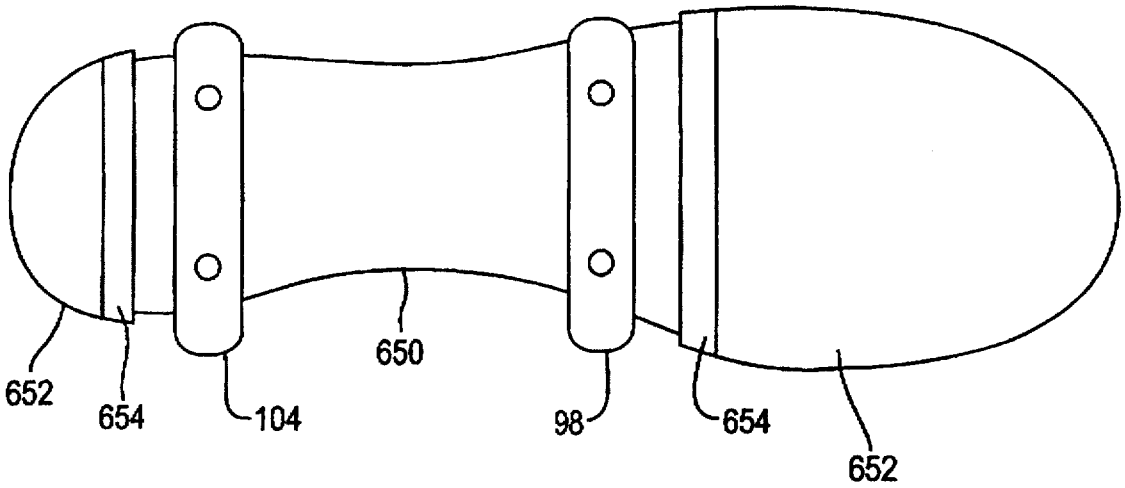
FIG. 8 is a bottom view of an alternate embodiment of the cleat and boot of FIG. 7.
Figure 9:
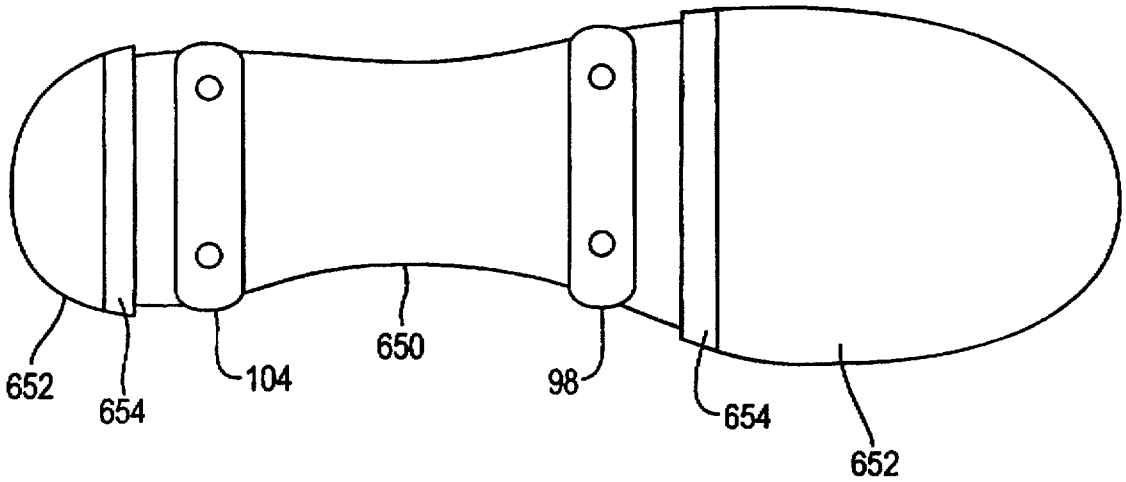
FIG. 9 is a bottom view of another alternate embodiment of the cleat and boot of FIG. 7.

As seen in FIGS. 6 and 7, the cleats 98 and 104 are separated in the fore and aft direction A far enough to provide adequate support and help prevent heel lift. The cleats can be approximately 120 mm apart, and located between the heel and the ball of the foot. The cleats are approximately 118 mm long. By using two narrow cleats separated by this distance, the sole of the boot remains flexible to provide for easy walking when not engaged with the snowboard. The cleats 98, 104 are bolted to the sole of the boot through holes 109 provided therein. The cleats may alternatively be wider than the heel to provide lateral support and be narrower than the ball of the boot, to make walking easier by reducing the chance of hitting the cleat ends against one's opposite leg while walking (FIG. 8). The cleats may also be narrower than the heel of the sole to further facilitate walking (FIG. 9).

Figure 2C:
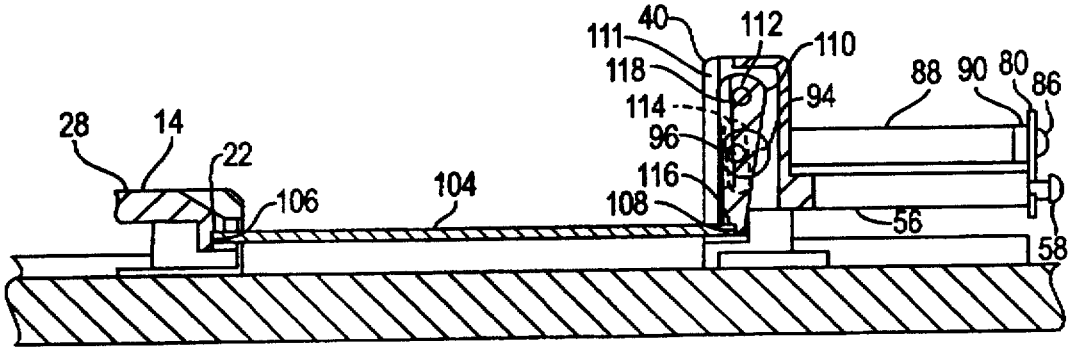
Figure 3:
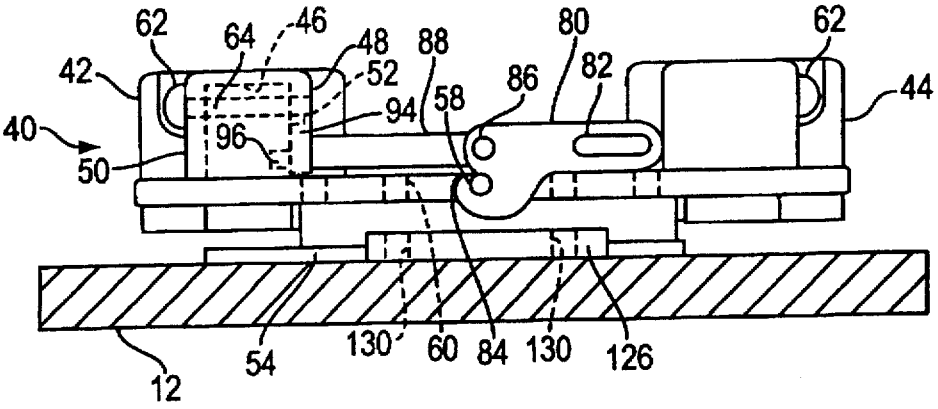
FIG. 3 is an elevational view in direction III of FIG. 1 of an outer main body of the binding of FIG. 1.
Figure 4:
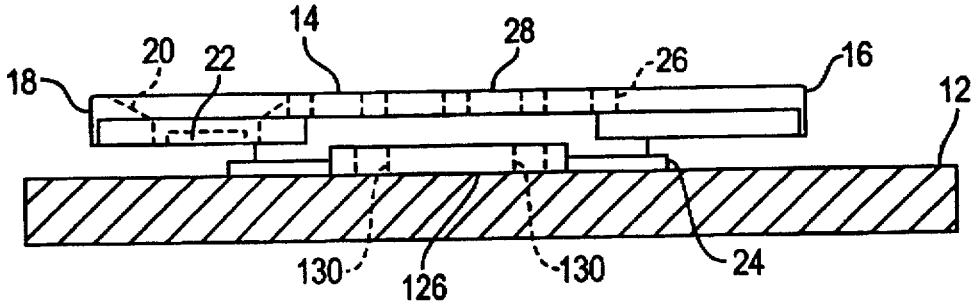
FIG. 4 is an elevational view taken in direction IV of FIG. 1 of an inner main body of the binding of FIG. 1.

As seen in FIG. 2(c), when the binding mechanism is engaging with the cleats they are maintained above the top surface of the snowboard. The separation can be, for example, 8 mm. This helps prevent snow which may be accumulated on the bottom of the cleat from interfering with the step-in engagement. The cleats are mounted to midsole 650 within a recess formed by bevel surfaces 654 of the sole 652. This raises the cleats relative to the bottom surface of the sole of the boots as seen in FIG. 6. This helps prevent snow from sticking to the bottom of the cleat, and allows the remainder of the sole of the boot to rest on the top surface of the snowboard while the cleat is maintained above the top surface of the snowboard.

Figure 10:
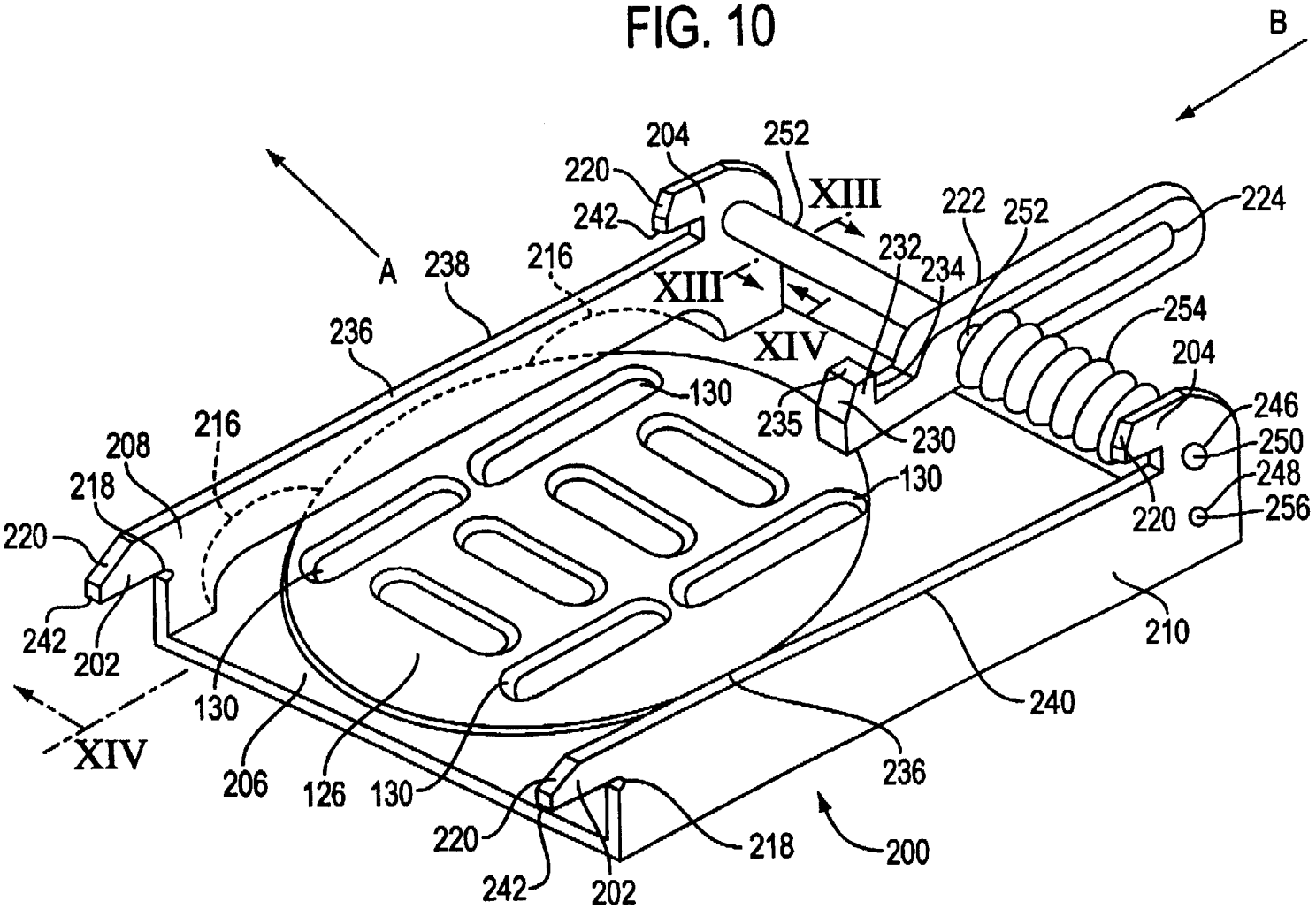
FIG. 10 is a perspective view of a second embodiment of a snowboard binding constructed in accordance with the present invention.

Refer now to FIG. 10, wherein is shown a second embodiment of a snowboard binding constructed in accordance with the present invention. In the second embodiment, main body 200 is used to engage the right boot of the snowboard rider, with direction A indicating the front of the boot and direction B indicating the longitudinal axis of the snowboard in the direction towards the front of the snowboard for a rider who places his right boot near the rear of the snowboard.

Figure 11:
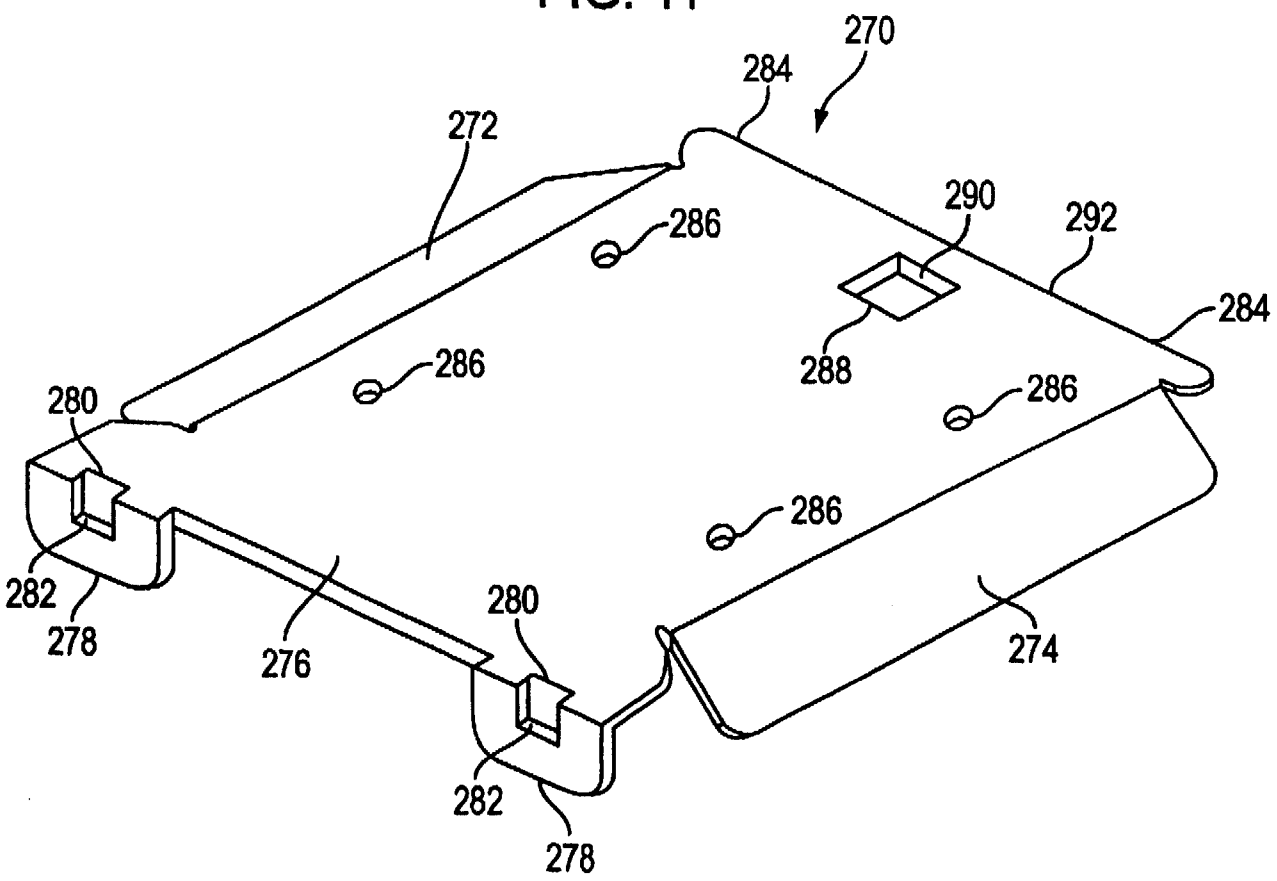
FIG. 11 is a perspective view of a cleat to be used with the binding of FIG. 10.

The binding mechanism has main body 200 formed by bottom plate 206, front wall 208 and rear wall 210. On the left side of front wall 208 and rear wall 210 are inside hooks 202. On the right side of the front and rear walls are outside hooks 204. The inside and outside hooks engage the cleat 270, shown in FIGS. 11 and 12. Undercuts 218 are provided adjacent the inside hooks 202. Bevel surfaces 220 are provided on the top surface of inside hooks 202 and outside hooks 204. Bottom surfaces 242 of the inside hooks 202 and outside hooks 204 prevent upward movement of the cleat 270. Lobes 216 extend from bottom plate 206 beyond front wall 208 to provide additional area for mounting plate 126 to secure the main body 200 to a snowboard.

Figure 14:
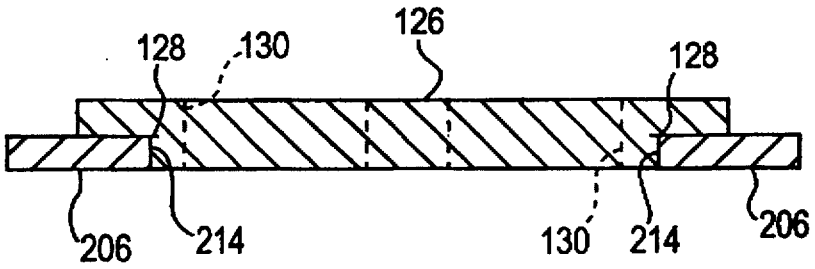
FIG. 14 is a cross-sectional view taken along line XIV—XIV of FIG. 10 showing how the mounting plate secures the main body to the snowboard.

As seen in FIG. 14, mounting plate edge 214 of the bottom plate 206 is engaged by groove 128 of the mounting plate 126. The mounting plate also has elongated holes 130 through which bolts (not shown) are fastened into nuts 30 embedded in the snowboard. Mounting plate 126 is circular, and edge 214 of the bottom plate 206 is also circular, although not a complete circle. This allows the main body 200 to be adjusted to any angular orientation relative to the longitudinal axis of the snowboard. Elongated holes 130 allow adjustment in the longitudinal direction B of the snowboard, to allow the feet to be placed further from or closer to one another.

Figure 13:
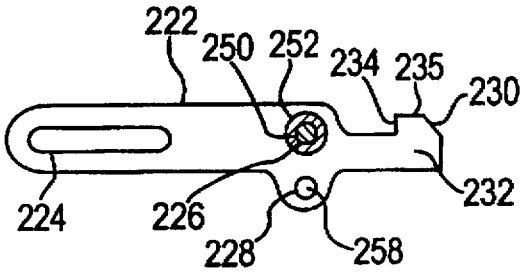
FIG. 13 is a cross-sectional view taken along line XIII—XIII of FIG. 10.

Returning to FIG. 10, latch 222 is pivotally mounted on main body 200 by axle 250 which is supported by holes 246 in the outside hooks 204. A bushing 252 is placed on axle 250 on each side of latch 222 to maintain the latch in the proper position. A spring 254 is mounted on one side of the latch on bushing 252. A first end 256 of spring 254 is engaged in a hole 248 of rear wall 210. A second end of the spring 254 is engaged in hole 228 of latch 222 (FIG. 13). When spring 254 is at rest, the latch 222 is held horizontal relative to the snowboard. Latch 222 has at one end thereof latch hook 232 which has inside surface 234, top surface 235 and bevel surface 230. Latch hook 232 engages with the single cleat 270 (FIG. 11) as described below.

Cleat 270 is formed by main plate 276, forward bevel plate 272, and rear bevel plate 274. Tabs 278 are located on one side of cleat 270, the tabs having tab holes 280 and hook surfaces 282. Tab holes 280 engage with inside hooks 202 when the cleat is secured to the binding. The surface 282 of the tab holes 280 is retained by the surface 242 of the inner hooks to prevent the cleat from lifting when it is engaged. Outside tabs 284 engage with outside hooks 204 when the cleat is engaged with the binding. Main plate 276 includes four bolt holes 286 by which the cleat is bolted to the sole of the snowboard boot (FIGS. 16 and 17), and latch hole 288 which is engaged by hook 232 of the latch 222. Surface 290 of the latch hole engages inside surface 234 of the latch hook 232 to prevent the cleat from moving sideways out of engagement from the binding main body 200.

Figure 12:
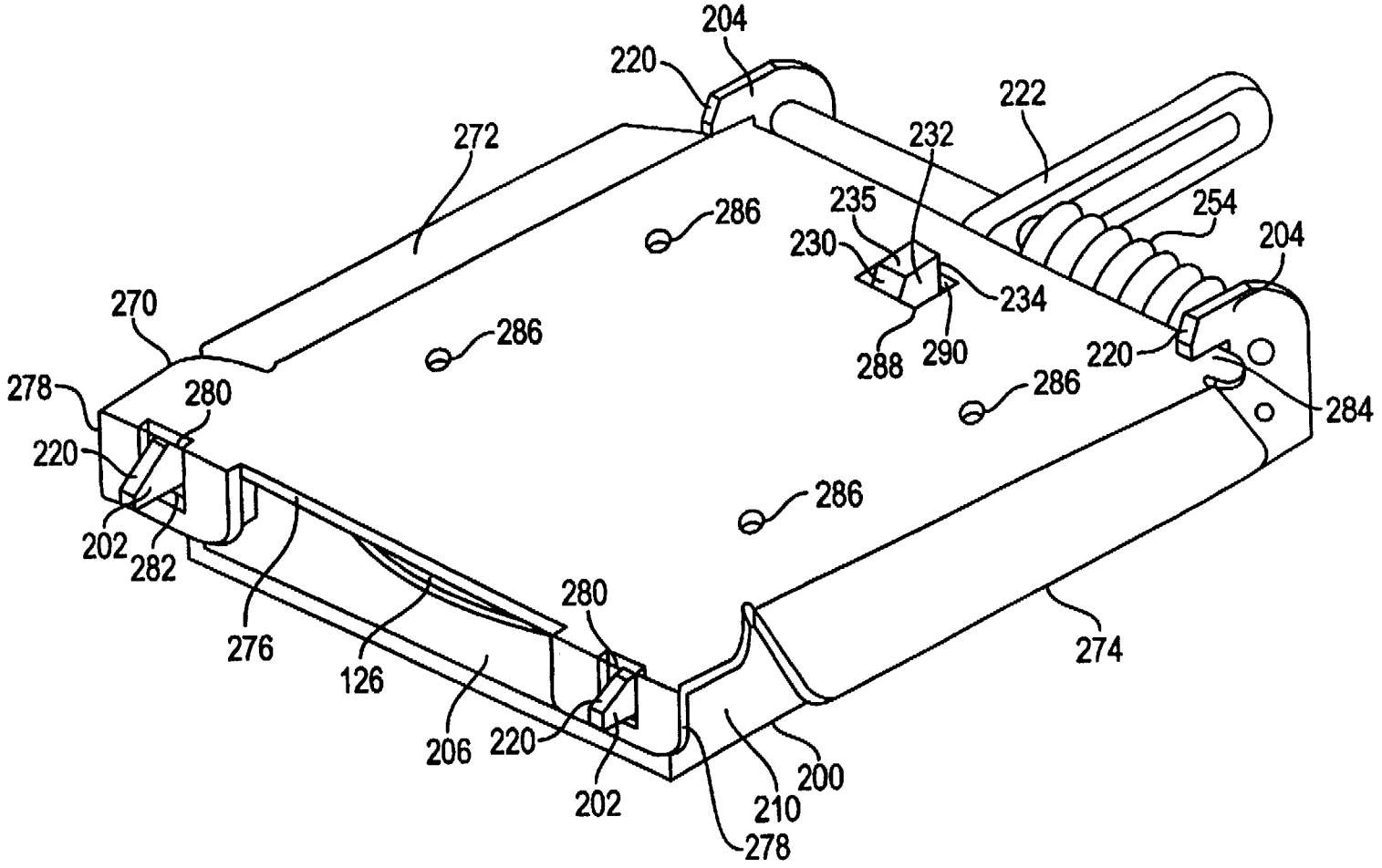
FIG. 12 is a perspective view of the cleat of FIG. 8 engaged with the binding of FIG. 10.

FIG. 12 illustrates cleat 270 engaged with the main body 200. Inside hooks 202 extend through holes 280 of the cleat tabs 278. Outside tabs 284 of the cleat are engaged by outside hooks 204 of the main body 200. Latch hook 232 is engaged through latch hole 288 of the cleat 270.

Step-in engagement of the cleat is accomplished as follows. The snowboard rider will lower his foot in a generally vertical direction until forward bevel plate 272 and rear bevel plate 274 engage forward edge 238 and rear edge 240 of the top surface 236 of the main body 200. The engagement of the bevel plates with the edges will properly place the cleat with respect to the direction A as the cleat is lowered against the main body. The cleat is rested on top surface 236 of the main body. If the cleat is too far to the right for main plate 276 to engage top surface 236, the inside tabs 278 engage with bevels 220 on the inside hooks 202 and the outer edge 292 of the cleat engages with the bevel surfaces 220 on the outside hooks 204 to direct the cleat to its correct location. Main plate 276 of the cleat will then contact latch hook 232, causing the latch 222 to rotate against the biasing strength of spring 254.

The snowboard rider then slides the cleat to the right until inner hooks 202 are engaged with inside tab hooks 280 and outside tabs 284 are engaged by outside hooks 204. The latch hole 288 in the cleat will then be aligned with latch hook 232, and spring 254 will cause hook 232 to extend up through the latch hole 288. This prevents the cleat from sliding to the left out of engagement. Inside hook surfaces 242 can be approximately 13 mm from the top of the snowboard and outside hook surfaces 242 can be approximately 18 mm from the top of the snowboard to facilitate the step-in binding procedure just described.

Figure 15:
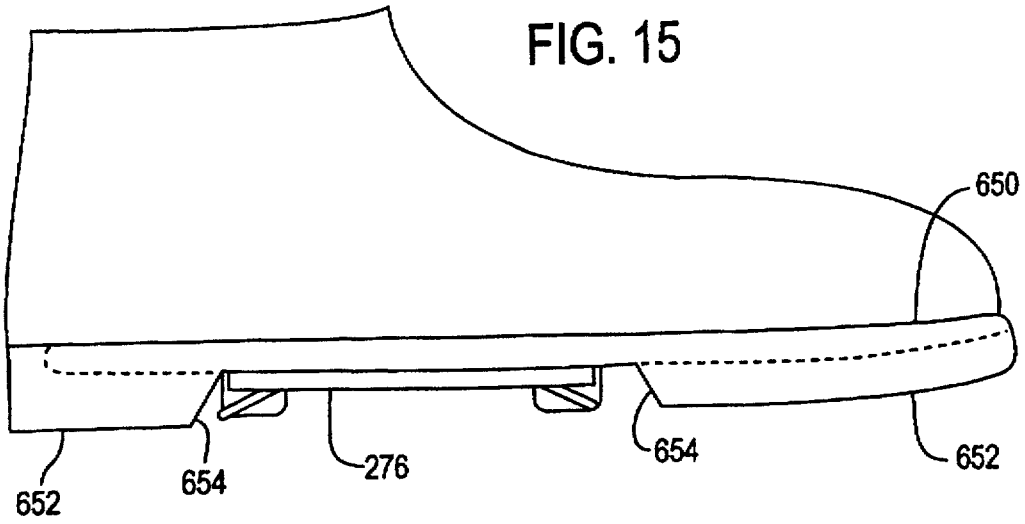
FIG. 15 is an elevational view showing the cleat of FIG. 11 mounted on a snowboard boot.
Figure 16:
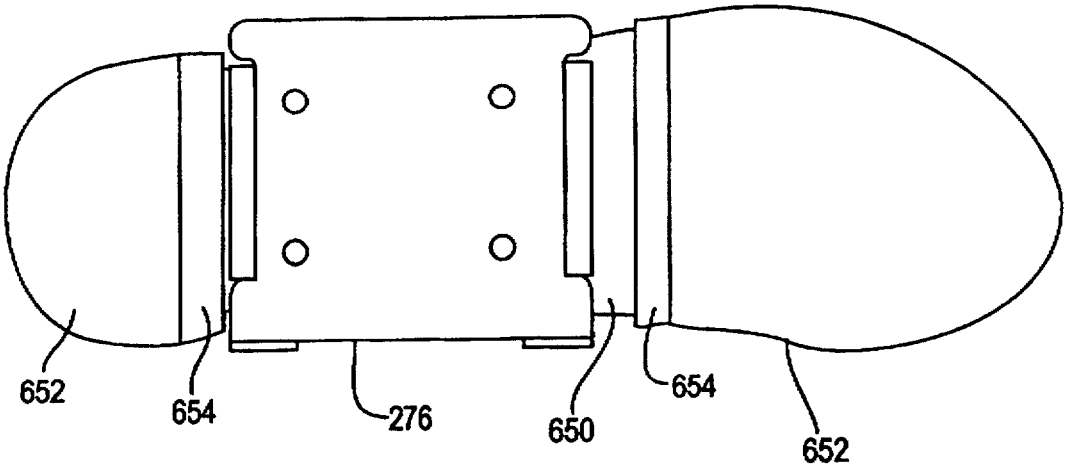
FIG. 16 is a bottom view of the cleat and boot of FIG. 15.
Figure 17:
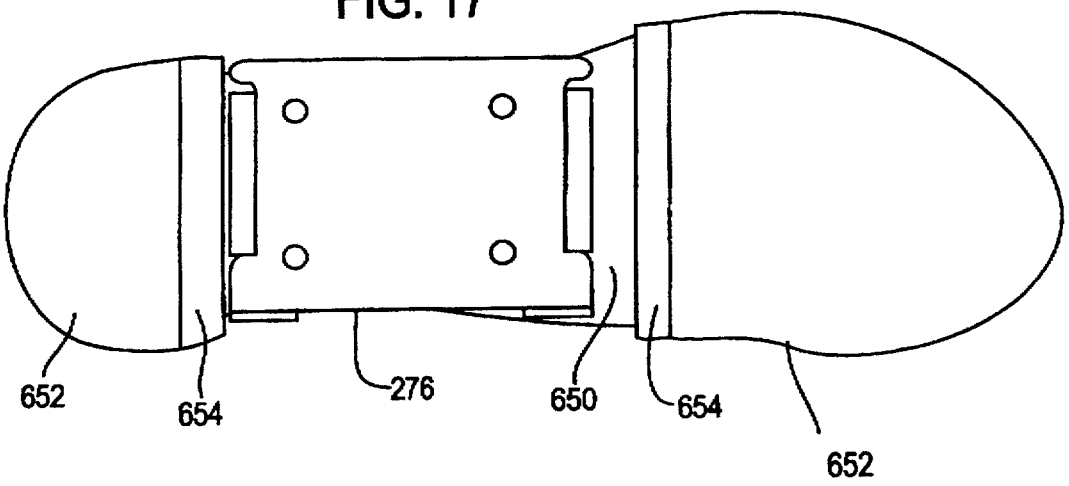
FIG. 17 is a bottom view of an alternate embodiment of the cleat and boot of FIG. 16.

As shown in FIGS. 15–17, the cleat is affixed to the midsole 650 of the boot between bevel surfaces 654. The main plate 276 is thereby recessed approximately 18 mm from the bottom of the sole 652 of the boot. This allows the sole of the boot to rest against the top of the snowboard when the cleat is engaged. The boot has a beveled outsole to allow the cleat to be mounted this way. There is approximately 2 mm of looseness of the cleat main plate 276 relative to main body top surface 290 when the cleat is engaged. There is also approximately 2 mm play in the direction B between the hooks and the latch. This facilitates engaging the binding mechanism despite snow being trapped between the cleat and the binding mechanism. Cleat 226 can be wider than the sole 652 to provide maximum lateral support. Or, as shown in FIG. 16, the cleat can be wider than the heel and narrower than the ball of the boot to provide lateral support while reducing the interference of the cleat with walking. Or, to further facilitate walking, the cleat can be narrower than the heel of the boot as seen in FIG. 17.

The rider may disengage the latch by means of a cord (not shown) attached to elongated hole 224 of latch 222. Pulling up on the cord through hole 224 will rotate the latch and cause hook 232 to come out of engagement with latch hole 288, allowing the cleat to slide to the left far enough to disengage the hooks and allow the boot to be removed from the binding.

Figure 18:
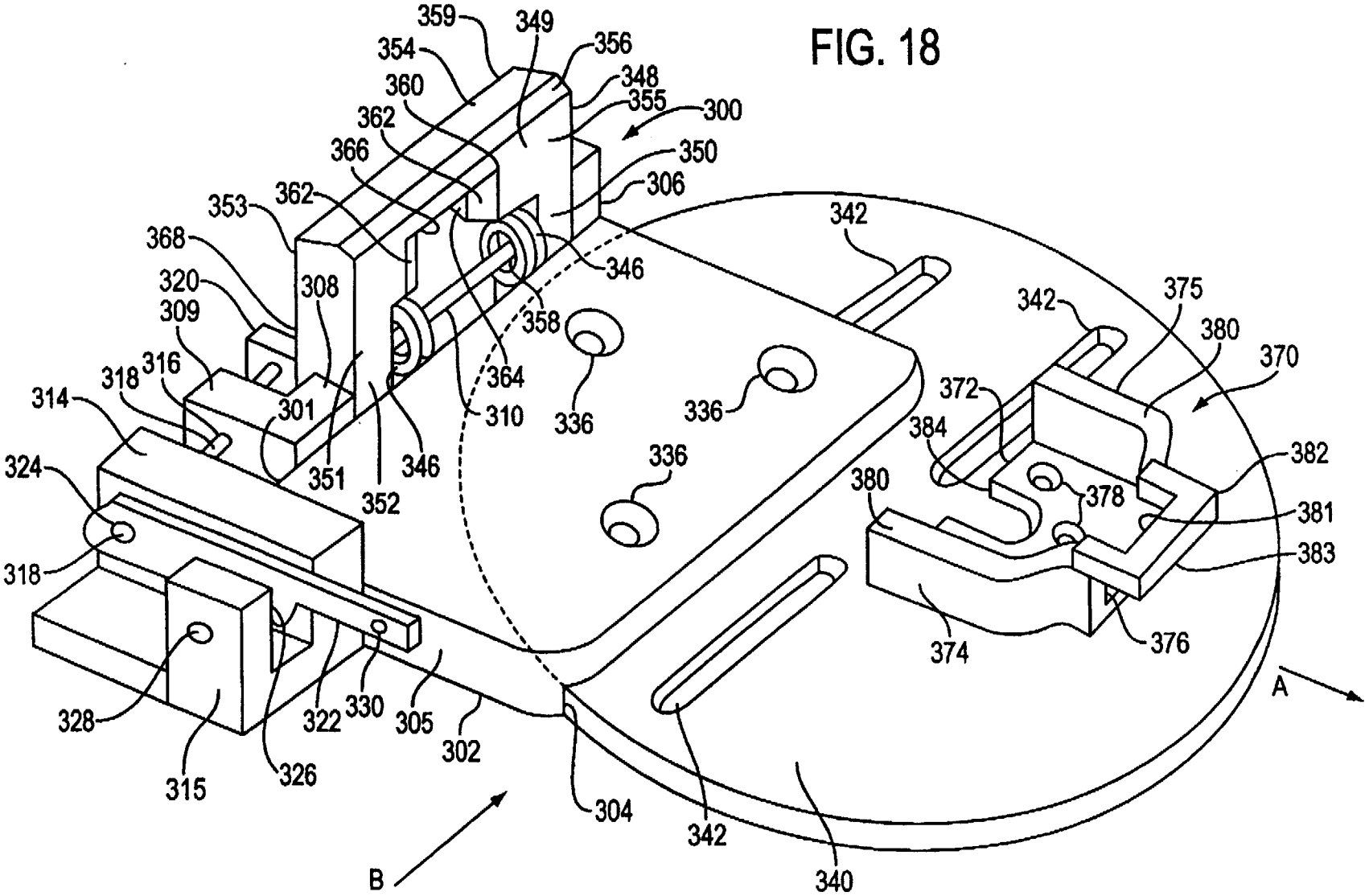
FIG. 18 is a perspective view of a third embodiment of a snowboard binding constructed in accordance with the present invention.

FIG. 18 shows a third embodiment of a snowboard binding mechanism constructed in accordance with the present invention. In the illustrated arrangement, the front of the rider's boot points in direction A, and the longitudinal axis of the snowboard is shown in direction B toward the front of the snowboard for a rider who places his right foot near the rear of the snowboard.

The binding mechanism includes a rear main body 300 and a front main body 370, both of which are attached to the top surface of snowboard 12 by means of mounting plate 340. The front main body 370 includes base 372 which is affixed to the mounting plate 340 by way of three mounting holes 378. Bolts (not shown) extend through the mounting holes 378 and are secured into mounting holes 344 in the mounting plate. Extending up from the edges of the base 372 are a first wall 374 and a second wall 375. The first and second walls each have a top surface 380. The first and second walls angle towards the narrower forward side of the main body but do not extend across the forward side of the front main body 370. Retaining bar 382 extends from the top surface 380 of the first wall 374, across the front of the front main body, and onto the top surface 380 of the second wall 375. A cleat receiving opening 376 is formed on the forward side of front main body 370, and is bounded at its bottom side by the forward end of the base 372, on one side by the forward end of first wall 374, on its second side by the forward side of second wall 375, and across its top by retaining bar 382. A recess 384 is located at the center of the rear portion of the base 372.

Rear main body 300 has a base 302 which is affixed to the mounting plate 340 by means of bolts (not shown) extending through base bolt holes 336 into corresponding mounting holes 344 in the mounting plate. The lower surface of the base 302 has a fixing groove 304 to receive the mounting plate 340. Extending up from the rear side of the base 302 are a first latch support 306 and a second latch support 308. Latch axle 310 extends between the first latch support 306 and second latch support 308 and is supported by axle holes 312.

Latch 348 is pivotally mounted on the rear main body 300 by a latch axle 310. Latch 348 has on one side first leg 350 and on other side second leg 352, each having axle holes 358 for mounting on the axle 310. The first and second legs extend down from the latch body 353. Latch body 353 defines a cleat receiving notch 360 to engage the rear tab of cleat 386. The cleat receiving notch 360 is defined by a pair of bevel surfaces 362 and a pair of straight surfaces 364. The top of the cleat receiving notch is defined by top surface 366. The latch body 353 has top surface 354, front surface 355 and rear surface 359. Cleat receiving notch 360 opens onto the front surface 353. Top surface 354 and front surface 355 are joined by bevel surface 356.

Latch body rear tabs 410 (FIGS. 20, 21) extend from latch rear surface 359. Tabs 410 have bolt holes 412. Spring retainer 414 is bolted via bolt holes 416 to the rear tabs 410. The spring retainer 414 has an extension 418 in the center thereof. Two springs 346 are coiled about latch axle 310, each having a lower free end 345 supported against rear shelf 303 of base 302, and an upper free end 347 supported against spring retainer 414. Extension 418 maintains the springs in the proper position on axle 310. The springs 346 bias the latch in a forward direction such that the front surfaces 349 and 351 of the first and second legs 350, 352 are flush against rear surface 301 of the base 302. This maintains the latch 348 in a vertical orientation, which is its engaged position for engaging a cleat.

Figure 20:
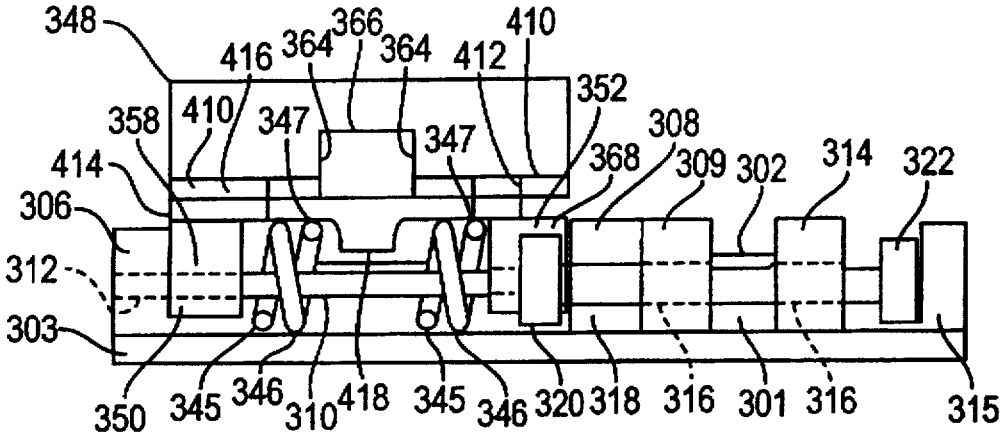
FIG. 20 is a rear view of the binding of FIG. 18 showing the sliding shaft of the binding in its locked position.
Figure 21:
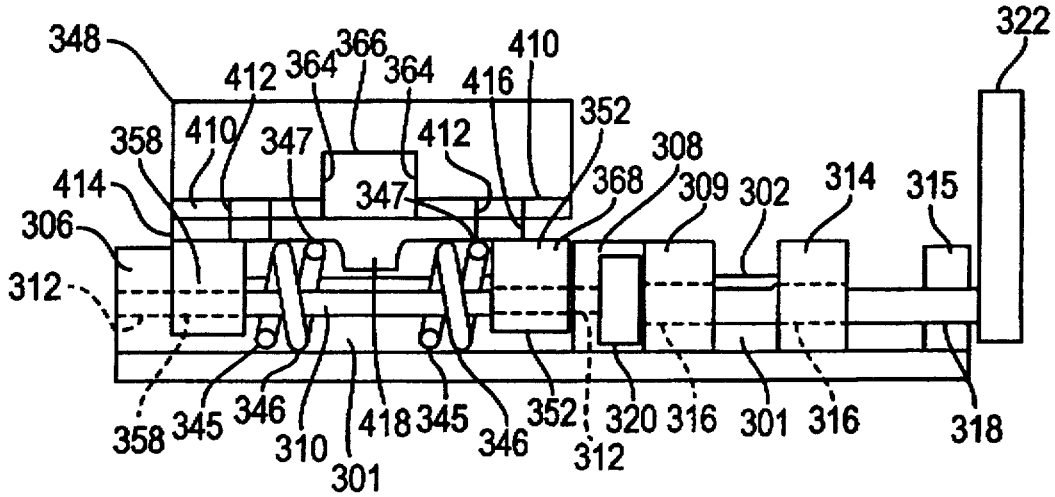
FIG. 21 is a view like FIG. 20 showing the sliding shaft in its release position.

A shaft support 314 extends from side 305 of the base 302. Shaft support 314 has a shaft hole 316 on a rear portion thereof which is aligned with shaft hole 316 located in the shaft support position of second latch support 308. Sliding shaft 318 is slidably supported by the shaft holes 316. Sliding shaft 318 has defined on one end thereof a square head 320. Rotatably fastened to the other end of sliding shaft 318 is hook 322. The sliding shaft 318 is free to slide along its longitudinal axis to a release position in which the square head 320 is adjacent shaft support portion 309 (FIG. 21). In this position, the square head 320 is out of the range of motion of second leg 352 of the latch 348. This allows latch 348 to pivot rearward against the biasing force of the springs 346 to its release position to release the cleat from engagement, and also allows the latch to be pivoted rearward during step-in engagement of the cleat. Sliding shaft 318 may also slide along its longitudinal axis to a locking position in which the square head 320 is behind rear surface 368 of second leg 352 (FIG. 20). In this position, the latch 348 is prevented from pivoting rearward.

Hook 322 is rotatably mounted on sliding shaft 318 by way of shaft hole 324. Hook 322 includes locking slot 326 which engages with tab 328. Tab support 315 and shaft support 314 each have tab holes 317 aligned with one another for supporting the tab 328. A cord (not shown) may be secured to hole 330 of the hook 322. Pulling the cord disengages hook 322 from tab 328 allowing it to rotate up beyond tab support 315. This will allow sliding shaft 318 to slide along its longitudinal axis to its release position.

Figure 19:
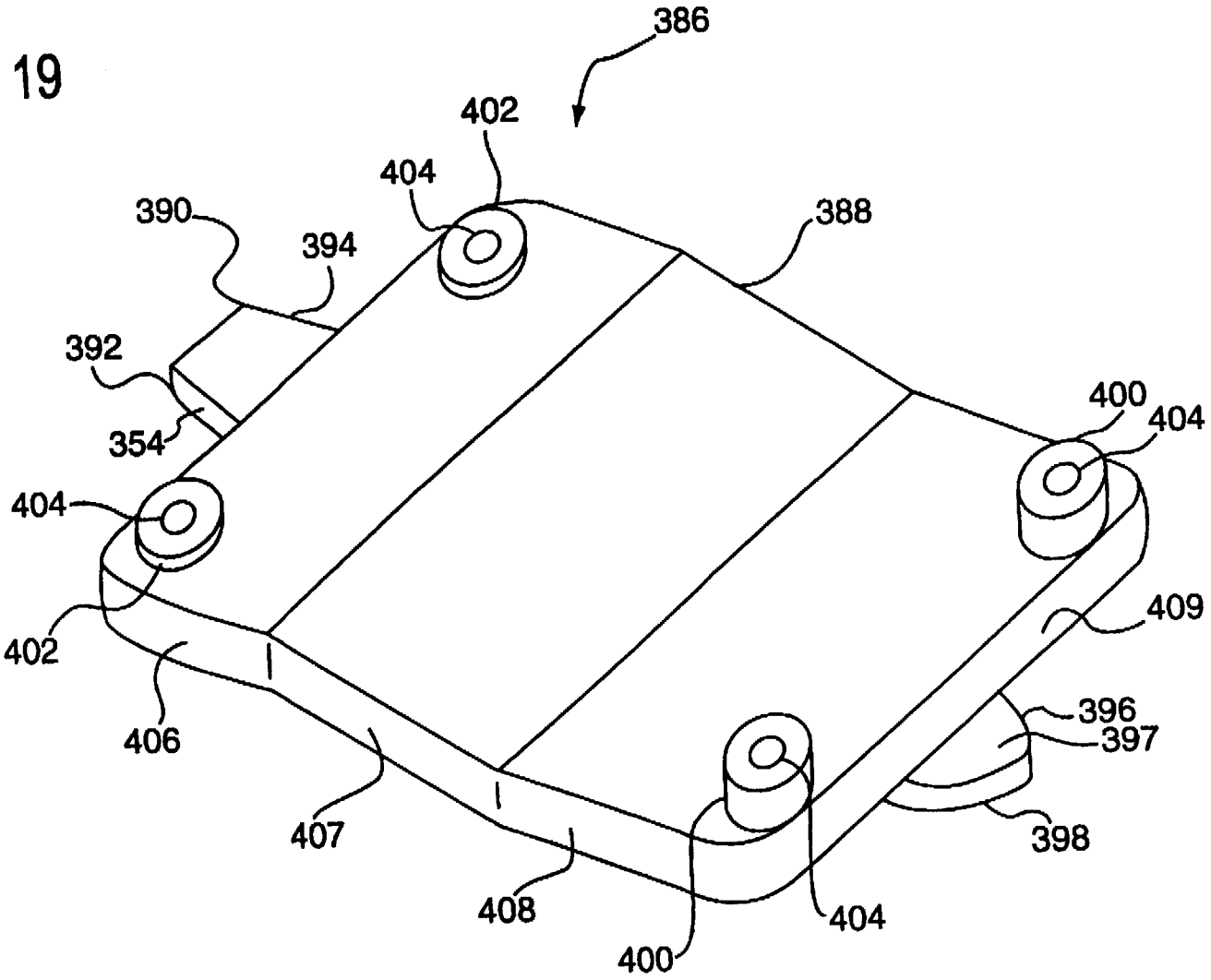
FIG. 19 is a perspective view of a cleat to be engaged by the binding of FIG. 18.

FIG. 19 shows a perspective view of a cleat 386 for use with the FIG. 18 binding mechanism. Cleat 386 includes a main plate 388. The main plate 388 of the cleat includes a rear portion 406, a middle portion 407, and a front portion 408. The front portion 408 and rear portion 406 are both generally parallel to the top surface of the snowboard 12. The front portion 408 is somewhat lower than the rear portion 406 relative to the top surface of the snowboard. Middle portion 407 transitions from the higher rear portion down onto the lower front portion. This arrangement follows the contour of the midsole of the boot and allows engagement of the rear tab 390 by the cleat receiving notch 360 of the rear main body 300 of the binding and the front tab 396 to be engaged by cleat receiving opening 376 of the front main body 370. This is necessary because the cleat receiving notch 360 is higher than the cleat receiving opening 376 relative to the top surface of the snowboard.

Rear tab 390 extends from rear portion 406, and front tab 396 extends from front surface 409 of front portion 408. Rear tab 390 includes bevel surface 392 on the lower rear corner thereof, and bevel sides 354 on each side. Front tab 396 is generally a semi-circular shape, and includes bevel surface 398 on its lower front corner. Rear tab 390 is thinner than rear portion 406 and is generally flush with the bottom of the rear portion. Front tab 396 extends from the bottom surface of the front portion 408. Cleat 386 is approximately 140 mm long in the fore and aft direction, i.e., in direction A. This provides secure engagement of the boot to keep heel and toe lift to a minimum. This also reinforces the sole of the boot, minimizing the risk of breaking the midsole, and eliminating the need for additional reinforcement.

Figure 22:
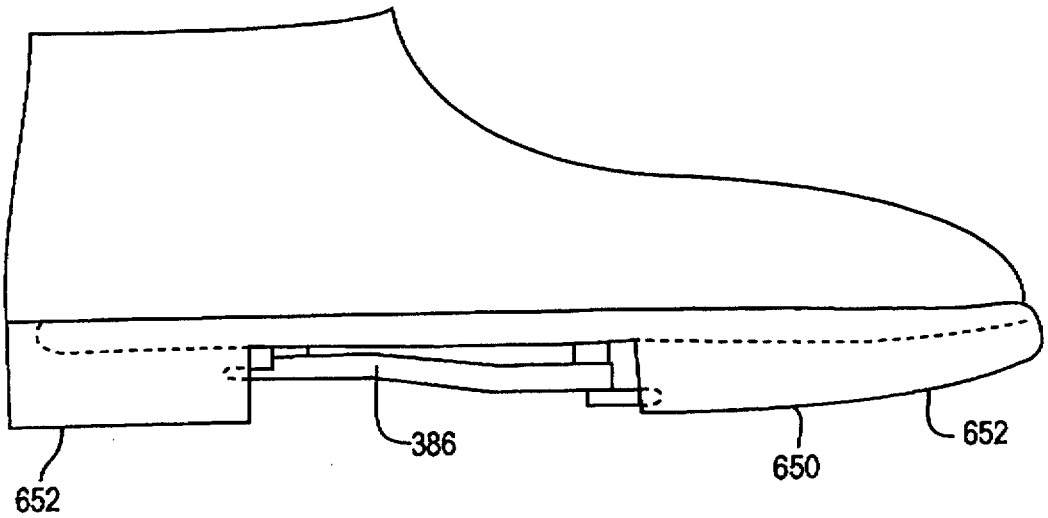
FIG. 22 is an elevational view of the cleat of FIG. 19 mounted on a snowboard boot.
Figure 23:
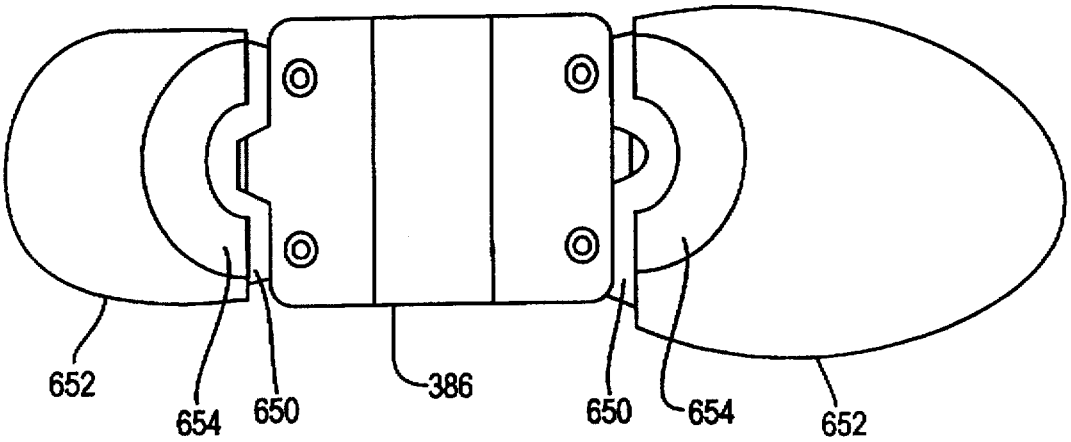
FIG. 23 is a bottom view of the cleat and boot of FIG. 22.

FIGS. 22 and 23 show that the sole of the boot 652 has an arc or "stadium style" bevel at 654 to accept the cleat 386.

This style bevel also helps guide the front and rear tabs into proper engagement with the front and rear main bodies. This style bevel can be used with any of the cleat embodiments described herein, particularly with cleats which are narrower than the outsole. The bevel here is shown open on each side of the cleat, but may alternatively surround the cleat completely. The beveled sole also maintains the cleat above the lower surface of the sole. This reduces the amount of snow which sticks to the bottom of the cleat and allows the remaining portion of the sole to rest on the snowboard when the cleat is engaged.

The cleat 386 is affixed to the sole of the snowboard boot by means of forward mounting studs 400 and rear mounting studs 402. Forward mounting studs 400 extend further from the top surface of the cleat 386 than do the rear mounting studs 402 to account for the height difference of the front portion 408 of the cleat relative to the front portion 406 of the cleat. Each of the mounting studs has bolt hole 404 for receiving a bolt through the cleat to be affixed into the sole of the snowboard boot.

Step-in engagement of the FIG. 18 embodiment of the snowboard binding mechanism is accomplished as follows. The snowboard rider first locates front tab 396 of the cleat into the cleat receiving opening 376 of the front main body 370. The first wall 374 and second wall 375 angle toward the cleat receiving opening 376 to facilitate alignment of the cleat relative to the front main body 370. Front bevel 654 in sole 652 also helps guide the front tab of the cleat into engagement. The cleat is moved forward until front surface 409 of the cleat is flush against rear surface 381 of the retaining bar 382. At this time, the top surface 397 of the front tab 396 will be restrained from upward motion by bottom surface 383 of the retaining bar 382.

Rear tab 390 of the cleat may now be engaged with the latch 348 as follows. The snowboard rider will lower the rear portion of the boot until the rear tab bevel 392 comes into contact with the top surface 354 and/or the bevel surface 356 of the latch body 353. Rear bevel 654 of sole 652 will help align the rear tab of the cleat into engagement. Interaction of the bevel surfaces will force the latch 348 rearward against the biasing force of the springs 346. The rider continues stepping down until the rear tab 390 is engaged with cleat receiving notch 360. The rider may pivot the boot from side to side as necessary to align the cleat rear tab 390 with the cleat receiving notch 360 until engagement is accomplished. The springs 346 will then pivot the latch 348 to its engaged position.

To lock the latch 348 in the engaged position, sliding shaft 318 is slid along its longitudinal axis until square head 328 is aligned with rear surface 368 of second leg 352. Hook 322 is then rotated forward until locking slot 326 is engaged with locking tab 328.

Disengagement of the cleat is as follows. The rider first pulls the cord attached to hole 330 of the hook 322 upward to disengage locking slot 326 from locking tab 328. Hook 322 is then rotated rearward until it can clear tab support 315 allowing the sliding shaft 318 to be slid away from the latch until square head 320 of the sliding shaft is clear of the second leg 352 of the latch. The rider then pivots the rear of the boot sideways in either direction. The beveled side 354 of the rear tab 390 will interact with the bevel surface 362 of the cleat receiving notch as the rider pushes with enough force to overcome the biasing force of the springs 346. As the two beveled surfaces slide against one other, latch 348 will pivot rearward until the rear tab 390 of the cleat is free of the cleat receiving notch 360. The rear of the boot may then be lifted up until the cleat is clear of the rear main body 300, and the boot may be pulled rearward and up until the front tab 396 of the cleat is clear of the front main body 370.

Figure 24:
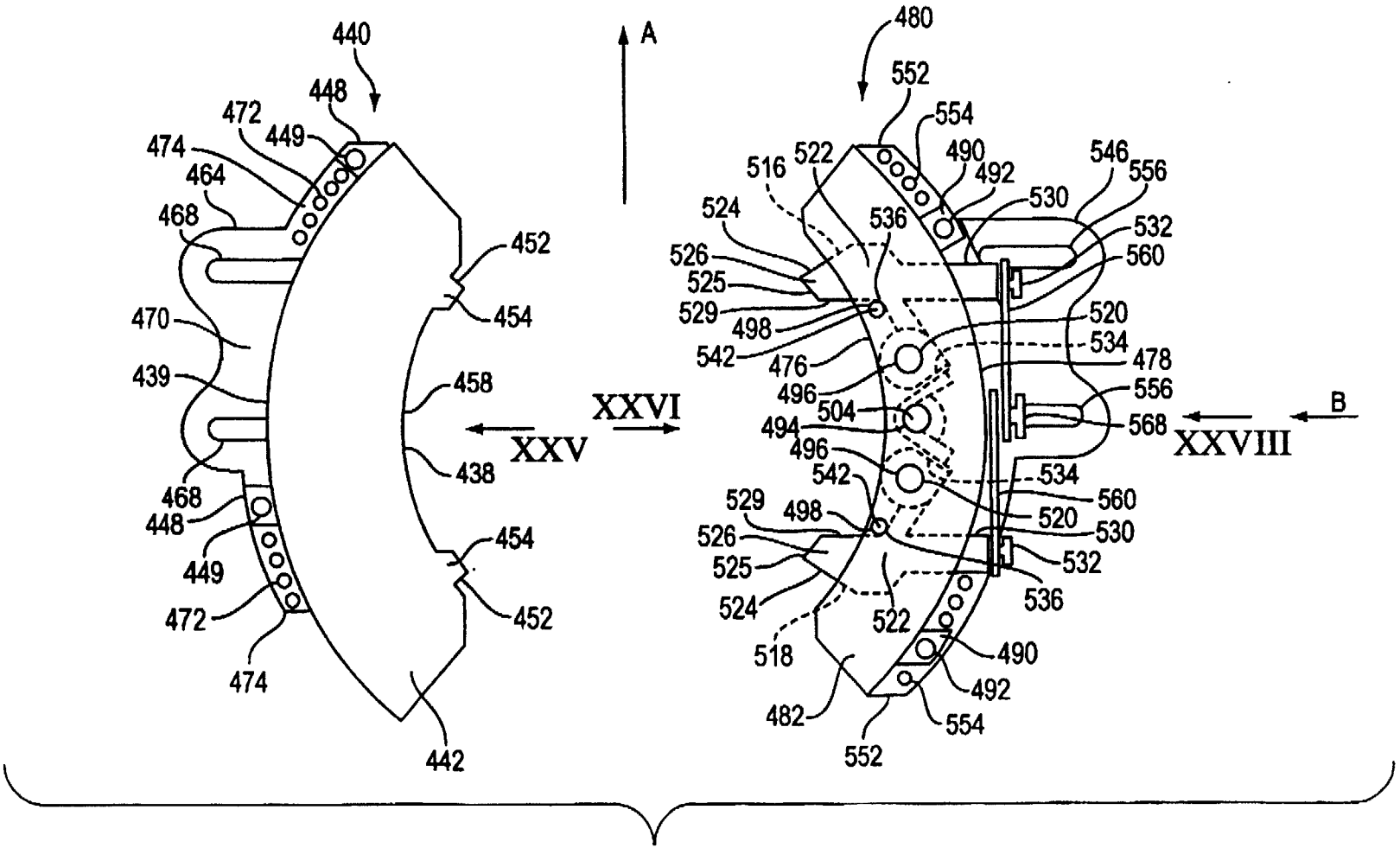
FIG. 24 is a top view of a fourth embodiment of a snowboard binding constructed in accordance with the present invention.

FIG. 24 shows a fourth embodiment of a snowboard binding mechanism according to the present invention. In the arrangement shown, inside main body 440 engages with the left side of a cleat of the right snowboard boot while the outside main body 480 engages with the right side of the cleat of the right snowboard boot. Direction A indicates the forward direction of the snowboard boot, while direction B indicates the forward direction of the longitudinal axis of the snowboard for a rider who places his right foot near the rear of the snowboard.

The inside main body 440 is affixed to the snowboard 12 by way of the inside mounting plate 464 and the outside main body 480 is affixed by means of the outside mounting plate 546.

Figure 25:
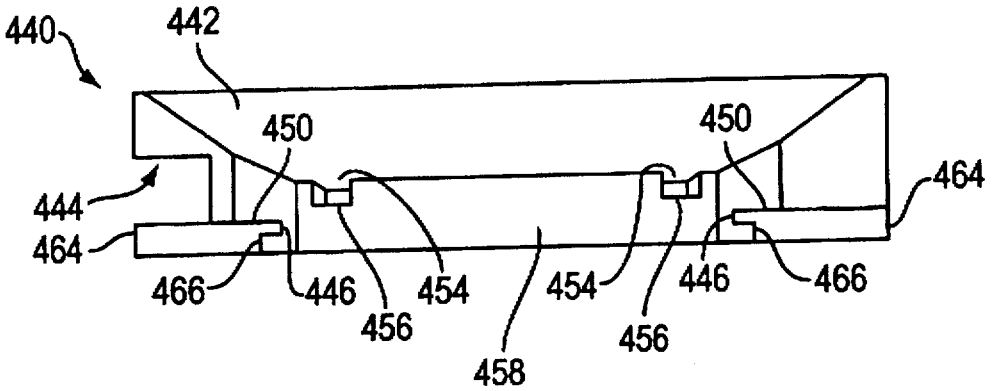
FIG. 25 is an elevational view in direction XXV of FIG. 24 of an inner main body of the binding of FIG. 24.
Figure 27:
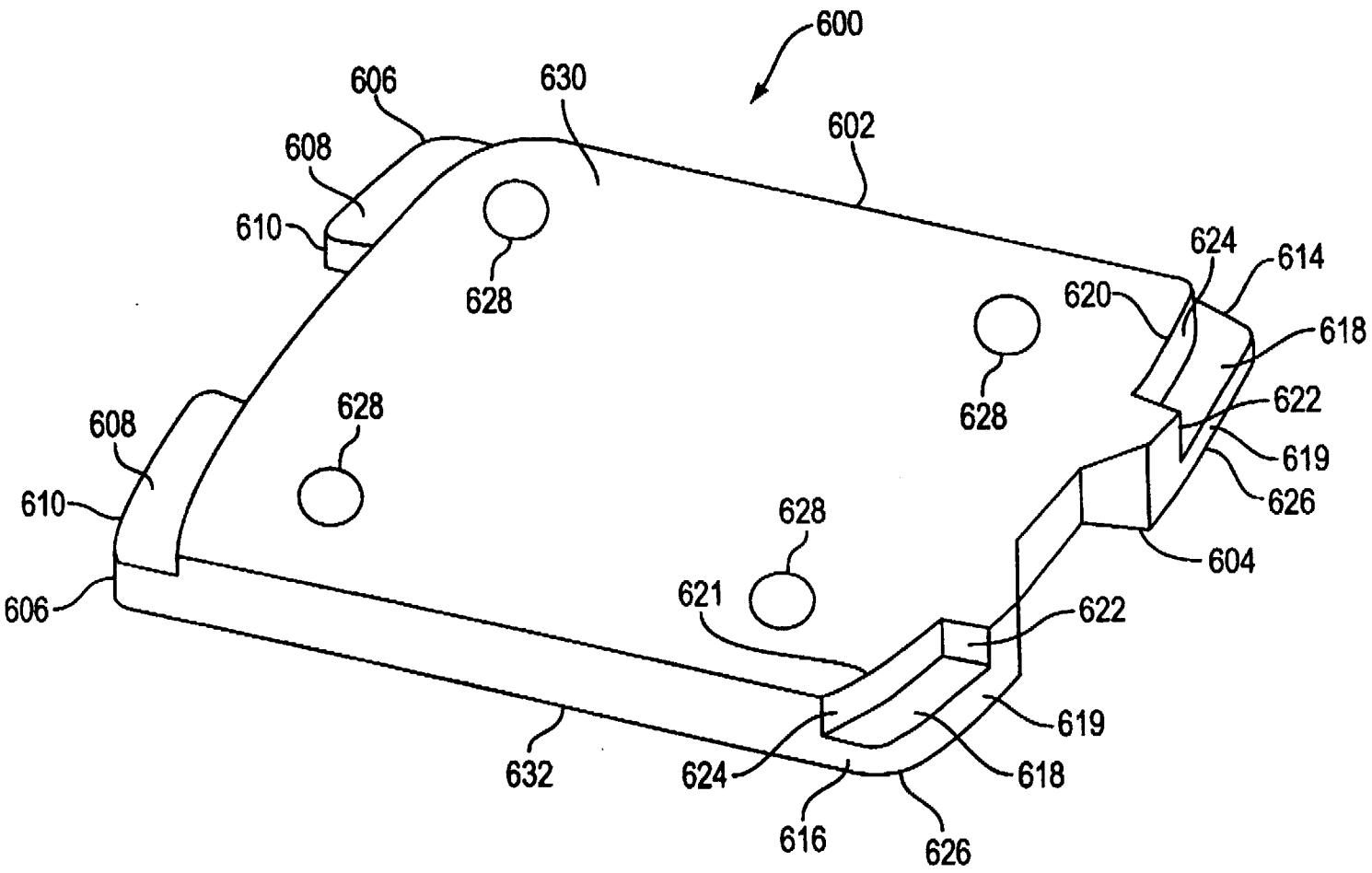
FIG. 27 is a perspective view of a cleat to be used with the binding of FIG. 24.

Inside main body 440 has on its top a beveled surface 442 arranged in the general shape of a portion of a circular arc. Bevel surface 442 tapers toward the snowboard in the general direction from the rear 439 to the front 438. Extending from the beveled surface 442 in a direction toward the outside main body 480 are extensions 452 which engage with a cleat 600 (FIG. 27). Each extension has a top surface 454 which is generally co-planar with the bevel surface 442, and bottom surface 456 which engages with the cleat 600 so as to prevent upward movement of the cleat away from the snowboard. On the rear side 439 of the inside main body 440 is recess 444 (FIG. 25). On the bottom of the inside main body at the front side 438 is a mounting groove 446 which engages with an inside mounting plate 464. Surface 450 forms the top of the groove and also acts as the bottom surface of the inside main body 440. Mounting arms 448 extend from surface 450 toward the rear side 439 of the inside main body 440. Mounting holes 449 are located at the end of the mounting arms 448 which extend from surface 450 along the top of the inside mounting plate 464.

Inside mounting plate 464 has a body plate 470 which has formed in the forward edge thereof a groove 466 for engaging with the mounting groove 446 of the inside main body 440. Elongated holes 468 in the inside mounting plate 464 allow the inside mounting plate to be bolted to the top surface of the snowboard by way of embedded nuts 30 (not shown) and provide for adjustment in the longitudinal direction of the snowboard (arrow B). Bolts (not shown) are then placed through bolt holes 449 in arm 448 and engage with the selected bolt holes 472 of the inside mounting plate 464. The plurality of holes 472 allows angular adjustment of the inside main body 458.

Outside main body 480 has on its top a bevel surface 482 which tapers toward the snowboard in the direction from the rear side 478 toward the front side 476. Outside main body 480 has bottom wall 486 which rests against body plate 548 of the outside mounting plate 546. At the forward side of the bottom wall 486 is groove 488 which is engaged by groove 450 of the outside mounting plate 546. Spring shaft hole 494 extends through the bevel surface 482 into the bottom wall 486 in a direction normal to the surface of the snowboard and is located generally in the middle of the bevel surface 482. Two latch axle holes 496 extend through the bevel surface 482 into the bottom wall 486 and are located on either side of the spring shaft hole 494. Two stop bar holes 498 extend through the bevel surface 482 and into the bottom wall 486 and are located on either side of the latch axle holes 496. The function of these holes will be described later. Two bolt hole tabs 490 extend rearward from the bottom wall 486, each having a bolt hole 492.

The outside main body 480 is affixed to the snowboard by means of outside mounting plate 546 as follows. Groove 550 of the outside mounting plate 480 engages with groove 488 on the bottom wall 486 of the outside main body, such that bottom wall 486 rests against the top of body plate 548. Elongated bolt holes 556 allow for longitudinal adjustment of the outside main body in direction B. Bolt hole arms 552 extend in either direction from the body plate 548 toward the ends of the outside mounting plate. A plurality of bolt holes 554 are located in each bolt hole arm 552. Bolts (not shown) are inserted through the bolt holes 492 on the bolt hole tabs 490 of the outside main body and are engaged into the selected one of the bolt holes 554 of the outside mounting plate 546. The plurality of holes 554 allows for angular adjustment of the outside main body.

Figure 26:
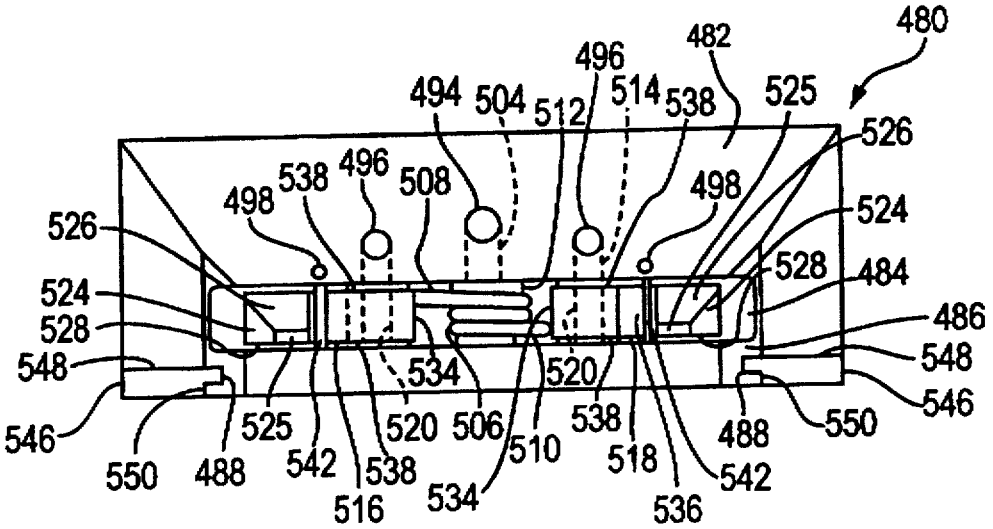
FIG. 26 is an elevational view in direction XXVI of an outer main body of the binding of FIG. 24.

FIG. 26 is a front elevational view of the outside main body 480. Spring shaft 504 extends through the spring shaft hole 494 traversing recess 484 of the outside main body. Similarly, latch axles 514 extend through the latch axle holes 496 traversing recess 484, and latch stops 542 extend through stop holes 498 traversing the recess 484. Holes 494, 496 and 498 extend from the bevel surface 482 through the bottom wall 486. A coil spring 506 having a first arm 508 and a second arm 510 is mounted around spring shaft 504 inside the recess 484. Spring washers 512 are placed on the spring shaft 504 on either side of the spring 506. Latches 516 and 518 are mounted by way of cylindrical openings 520 on latch axles 514 within recess 484. The latches 516 and 518 include arms 522 extended from the cylindrical opening and ending in the engaging portion 524. Bevel surface 526 is located at the top of each engaging portion and bottom surface 528 is located at the bottom of each engaging portion. Bevel surface 526 is generally co-planar with the bevel surface 482 of the outside main body 480. Extending rearwardly from each latch is tab arm 530 having tab 532 at the end thereof. Adjacent to cylindrical opening 520 of the latch is spring surface 534 for engaging with the spring 506. Stop surface 536 is located on the arm 522 and engages with latch stop 542. Latch washers 538 are placed on latch axles 514 on either side of the latches.

Latches 516 and 518 are arranged to be biased by the spring 506 as follows. First arm 508 of the spring is engaged against spring surface 534 of the forward latch 516. Second arm 510 of the spring is engaged against spring surface 534 of the rear latch 518. The latches are pivotally mounted on latch axles 514, and the spring arms bias each latch forward until the stop surface 536 engages latch stop 542. The spring thereby biases the latches 516 and 518 into their engaged position.

Figure 28:
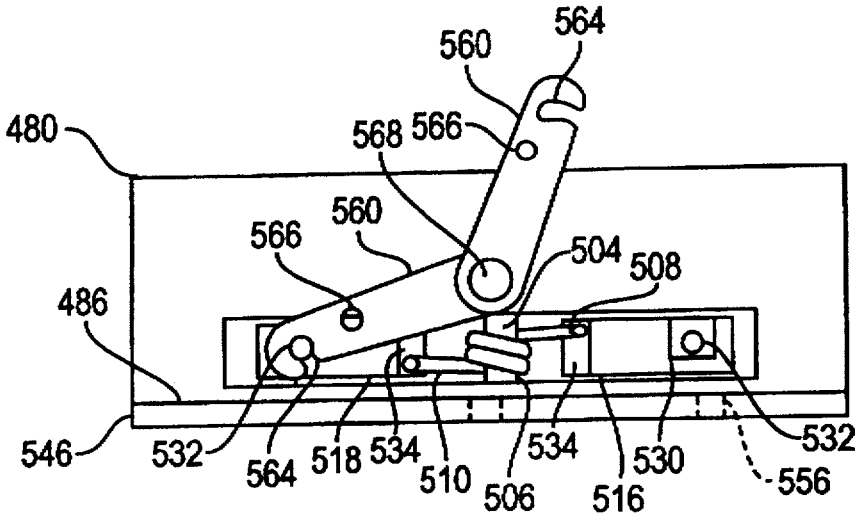
FIG. 28 is an elevational view taken in direction XXVIII of FIG. 24 of the outer main body of the binding of FIG. 24.

As seen in FIG. 28, two hooks 560 are mounted on hook axle 568 extending from the rear of outside main body 480. The hooks are pivotally mounted by their mounting hole 562 on hook axle 568. Each hook has a groove 564 which engages with tab 532 of the latches to maintain the latches in their engaged position. The hooks are released by pulling a cord (not shown) attached to cord hole 566 of each hook thereby disengaging a groove 564 from a respective tab 532. When the hooks 560 are pivoted upward to be clear of the tab arms 530 on the latches, the latches may now pivot rearward to their release position in response to a force strong enough to overcome the spring 506.

In this embodiment, bevel surface 442 of the inside main body forms a shallow angle with the top surface of the snowboard, for example, 30 degrees. Bevel surface 482 of the outside main body forms a steeper angle with the top surface of the snowboard, for example, 50 degrees. This arrangement is advantageous for easier step-in engagement of the cleat when the snowboard boots are placed relatively far from each other. In such a riding position, the leg tends to step into the board binding at an angle of 10 to 15 degrees from a line normal to the board. For the right boot, for example, the rider will step into the binding with his boot and leg at an angle toward the inside main body 440, rather than straight down along a line normal to the snowboard. Having the inside main body bevel surface 442 at a shallower angle than the outside main body bevel surface 482 will help guide the cleat 600 toward engagement with the binding when the boot steps in toward the binding at this angle.

FIG. 27 shows a perspective view of cleat 600. Cleat 600 includes main body 602 having top surface 630 and a bottom surface 632. Bevel 604 extends around the entire periphery of bottom surface 632. Extending from the left side of the main body 602 are inside tabs 606 which are engaged by the inside main body 440 of the binding. Tabs 606 include top surface 608 which is restrained from upward motion by bottom surface 456 of the tabs 452 on the inside main body 440. Tabs 606 of the cleat also include front surface 610 which engages against front surface 458 of the inside main body 440 of the binding mechanism.

Figure 30:
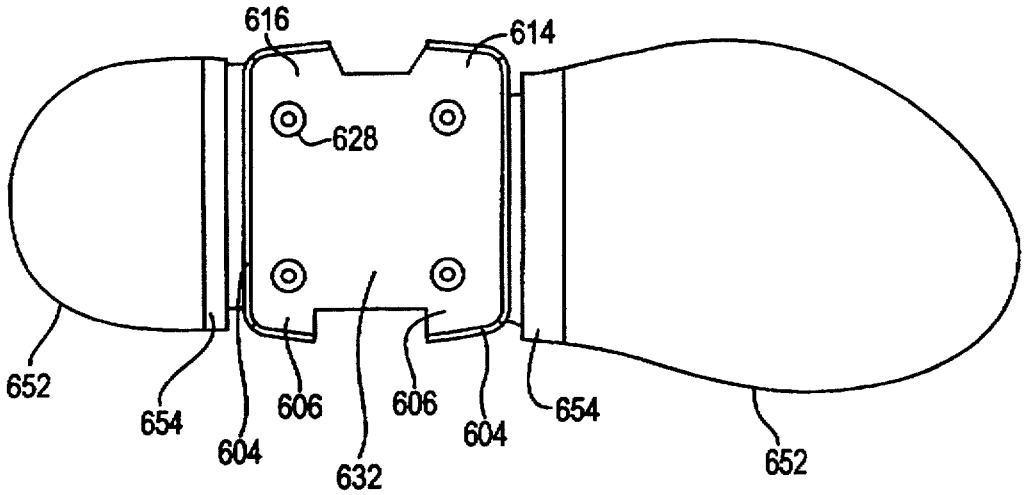
FIG. 30 is a bottom view of the cleat and boot of FIG. 29.
Figure 31:
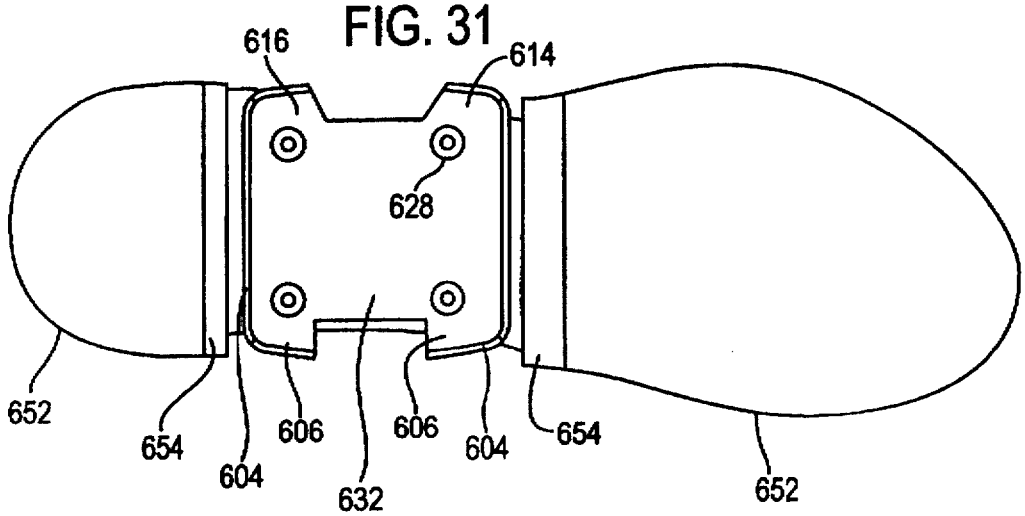
FIG. 31 is a bottom view of an alternate embodiment of the cleat and boot of FIG. 30.

Extending from the right side of the main body 602 are front outside tab 614 and rear outside tab 616. Recesses 620 and 621 expose top surfaces 618 of the outside tabs. Recess 620 and 621 include bevel surface 622 and side surface 624. When the cleat is engaged by the binding, top surfaces 618 of the outside tabs are engaged against bottom surfaces 528 of the engaging portions 524 of latches 516 and 518. Main body 602 also includes countersunk mounting holes 628 which allow the cleat 600 to be bolted against the midsole 650 of the snowboard boot (FIGS. 30 and 31).

Operation of this embodiment of the binding is as follows. The rider steps the boot and cleat in toward the binding at an angle from the normal to the snowboard as discussed above. The left side of the boot and/or the front surfaces 610 of the inside tabs of the cleat are initially contacted against bevel surface 442 of the inside main body. As the rider continues to step down, bevel surface 442 of the inside main body will guide the inside tabs 606 of the cleat toward the extensions 452 of the inside main body. The inside tabs 606 of the cleat will continue along the top surface 454 of the extensions 452 until the top surfaces 608 of the cleat tabs are below the bottom surfaces 456 of the inside main body extensions 452. The rider then moves the cleat toward the left until front surfaces 610 of the cleat tabs 606 contact front surface 458 of the inside main body 440. The top bevel surface 482 of the outside main body will help guide the cleat to the left for engagement with the inside main body. The inside main body front surface 458 is a circular arc when viewed from the top. Front surfaces 610 of the cleat tabs also lie on a circular arc when viewed from the top, having a radius of curvature slightly less than front surface 458. Engagement of cleat surfaces 610 by the inside main body front surface 458 secures the cleat from moving in directions A and B when the cleat is engaged.

As the rider continues to step down, the cleat outside tabs 614, 616 will contact the latches 516 and 518 of the outside main body. Bottom surface 626 of the cleat outside tabs 614 and 616 will engage bevel surfaces 526 of the engaging portions 524 of the latches. This will force the latches to rotate rearward against the spring until the top surface 618 of the cleat outside tabs is below the bottom surface 528 of the latch engaging portions 524. Spring 506 will then force the latches to pivot forward until the engaging portion 524 of the latches rests inside recesses 620 of the cleat. The rider then manually rotates the hooks 560 to engage the grooves 564 with the tabs 532 on the latches. This prevents the latches from pivoting rearward and releasing the cleat. Front surfaces 619 of the cleat outside tabs lie on the same radius as front surfaces 610 of the inside tabs. Latch side surfaces 529 engage cleat bevel surfaces 622 to secure the cleat from moving in direction A, latch front surfaces 525 engage recess surface 624 to secure the cleat from moving in direction B.

To disengage the cleat, the rider first pulls on the cord (not shown) attached to the holes 566 of hooks 560 to disengage the grooves 564 from tabs 532 and to rotate the hooks 560 until they are clear of the tabs 532 and tab arms 530. The rider then pivots his foot along the top surface of the snowboard which causes the latches to disengage as follows. If the rider pivots his foot counterclockwise, beveled surface 622 of front recess 620 applies a force against side 529 of the engaging portion 524 of the forward latch 516. When enough force is applied to overcome the spring force, the forward latch 516 will pivot rearward until the recess 620 is clear of the engaging portion 524. At the same time, rear cleat recess 621 will pivot forward via its open end until it is clear of the rear latch 518. At this point, the rider may lift the right side of the cleat away from the outside main body 480 and then move the entire cleat toward the right until the inside cleat tabs 606 are clear of the inside main body tabs 452. In a similar fashion, if the rider were to rotate the boot clockwise for disengagement, the rear latch 518 would be pivoted rearward against the force of the spring 506 until the cleat tabs are clear of their respective latch engaging portions 524.

Figure 29:
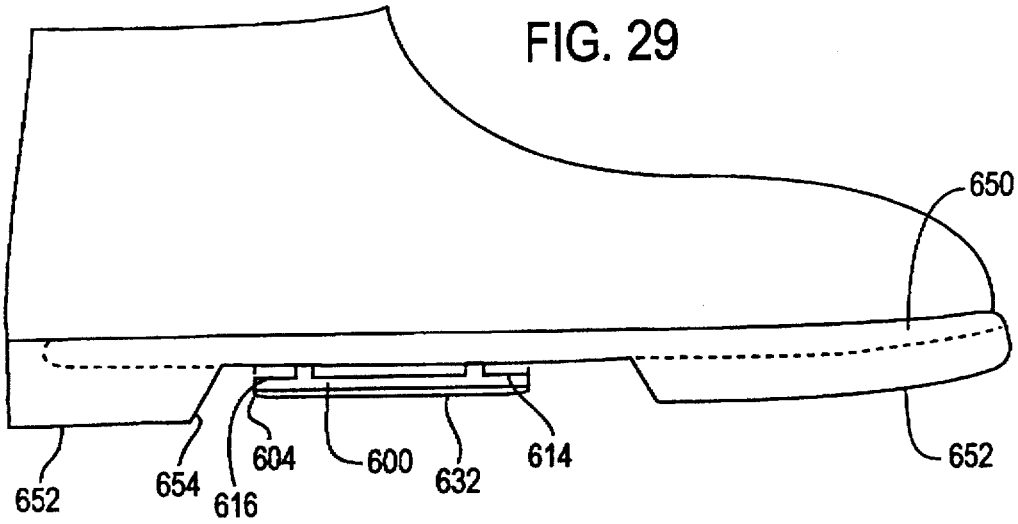
FIG. 29 is an elevational view of the cleat of FIG. 27 mounted on a snowboard boot.

In this embodiment, the cleat 600 is mounted to the midsole 650 of the boot within a recess formed by bevel surface 654 in the sole 652 of the snowboard boot such that bottom surface 632 of the cleat is approximately 5 mm above the bottom of the sole of the boot (FIG. 29). This will help prevent snow from sticking to the cleat 600 when the snowboard rider walks in the snow, and will help prevent any entrapped snow between the cleat and the snowboard from preventing engagement of the cleat with the binding. This also allows the sole to rest on the snowboard when the cleat is engaged. The recess of the boot sole is beveled to help guide the boot into proper engagement with the cleat. The engaging tabs of the cleat are approximately 100 mm apart in a longitudinal direction of the snowboard and approximately 80 mm apart in the fore and aft direction of the boot. This provides adequate support to prevent heel lift-up during riding, yet does not significantly reduce flexibility of the snowboard boot. Also, in this embodiment the cleat is wider than the heel and narrower than the ball of the boot to provide adequate lateral support without significantly interfering with walking (FIG. 30). Alternatively, the cleat can be narrower than the heel as shown in FIG. 31 to further minimize the risk of bumping the cleat against the opposite leg while walking.

FIGS. 32–41 illustrate a fifth embodiment of a snowboard binding mechanism according to the present invention. In the illustrated arrangement, the front of the rider's boot points in direction A, and the longitudinal axis of the snowboard extends in direction B toward the front of the snowboard for a rider who places his right foot near the rear of the snowboard.

The binding mechanism includes a front main body 660 and a rear main body 678, both of which are attached to a body plate 676. Positioned on body plate 676 between front main body 660 and rear main body 678 is a fixing plate 778 which includes a lower portion 779 (FIG. 32(c)). Both fixing plate 778 and lower portion 779 are generally circular in configuration, with lower portion 779 having a smaller circumference. Lower portion 779 fits within a recess in body plate 676 such that lip 780 of fixing plate 778 seats against body plate 676. The recess in body plate 676 is defined by mounting edge or ridge 674. Fixing plate 778 is affixed to the snowboard by way of bolts (not shown) extending through a plurality of countersunk mounting holes 782, through body plate 676 and into the snowboard.

Figure 32A:
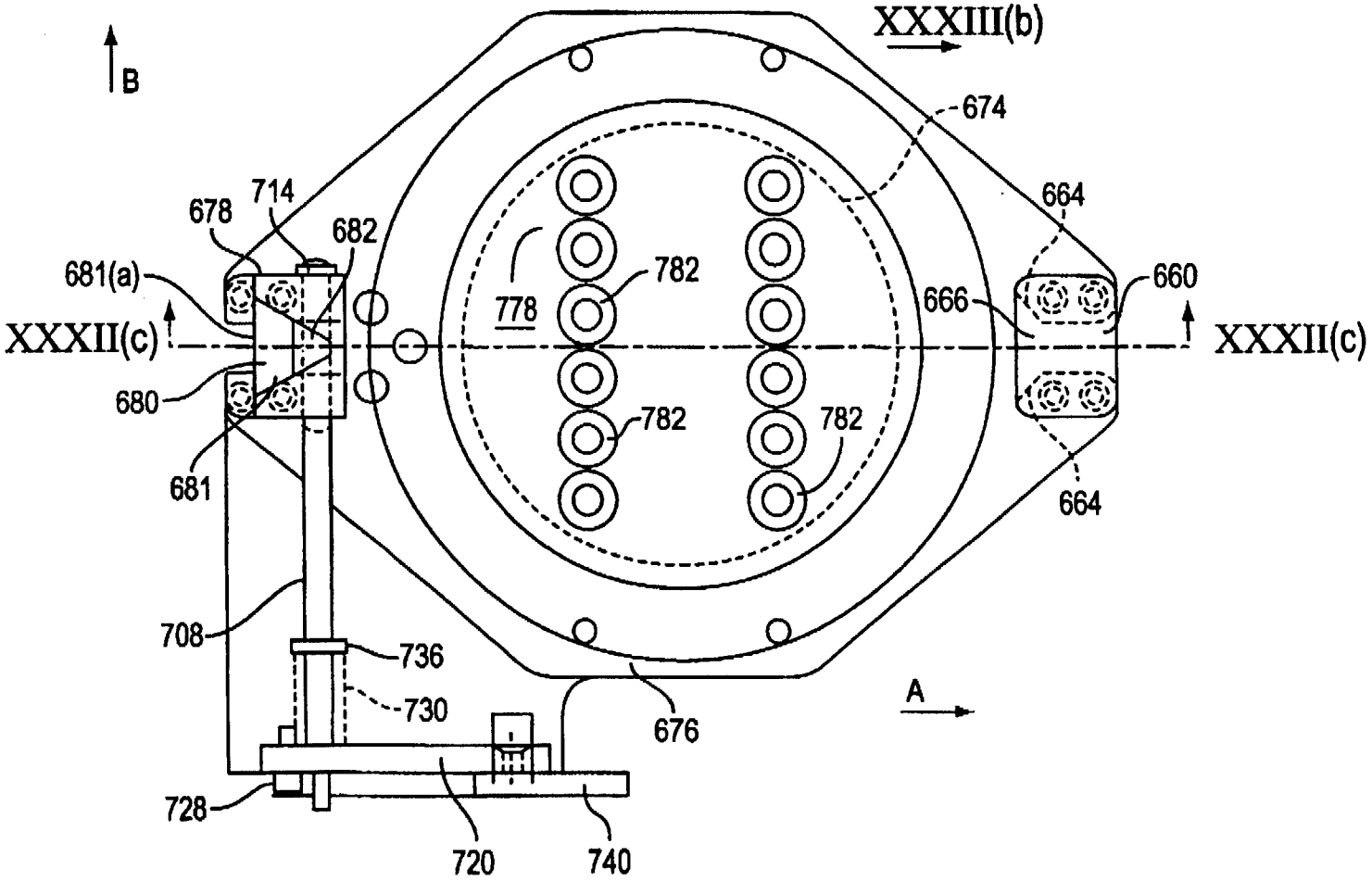
FIG. 32(*a*) is a top view of a fifth embodiment of a snowboard binding constructed in accordance with the present invention.
Figure 32B:
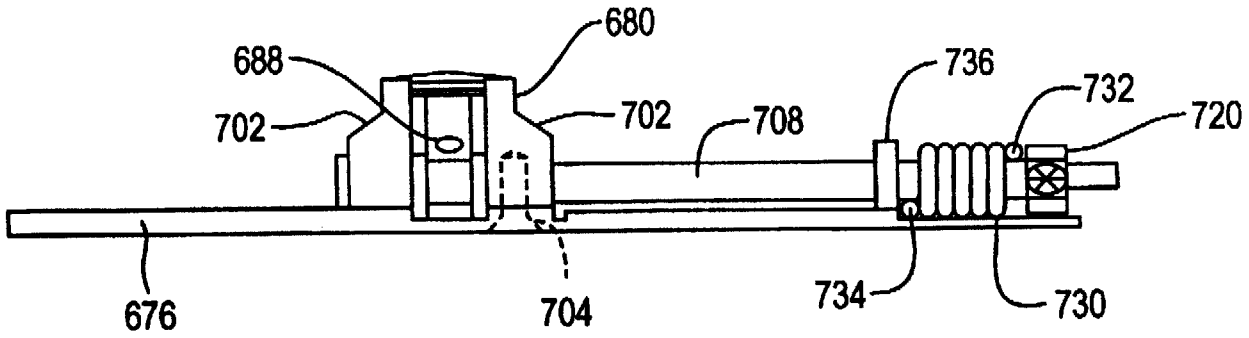
Figure 32C:
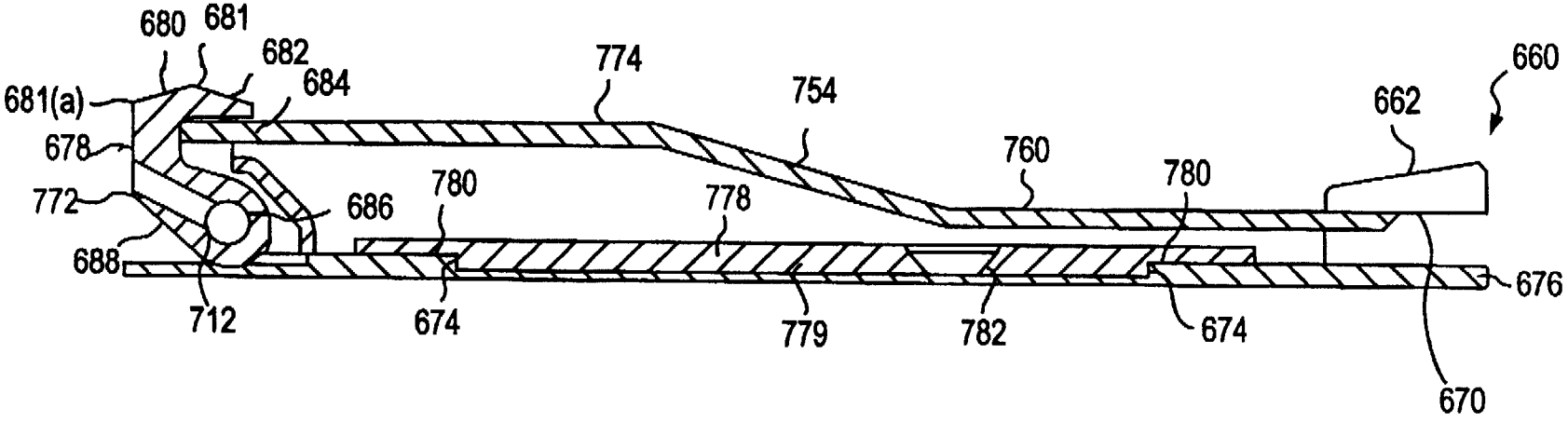
Figure 32D:
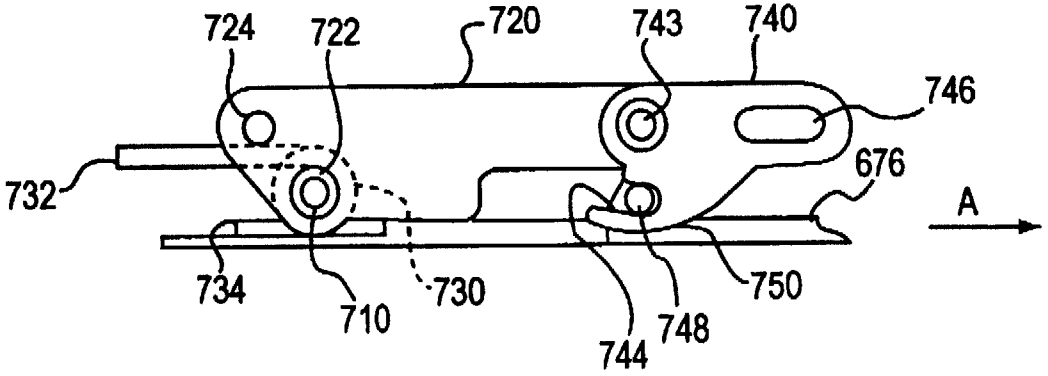
Figure 33A:
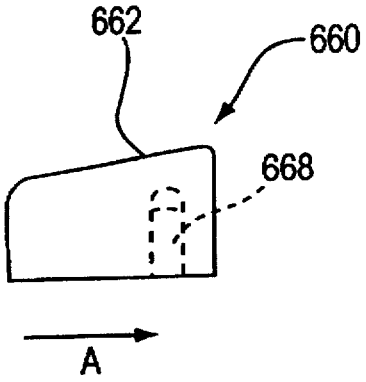
FIG. 33 (*a*) is a side view of the front main body of FIG. 32(*a*)
Figure 33B:
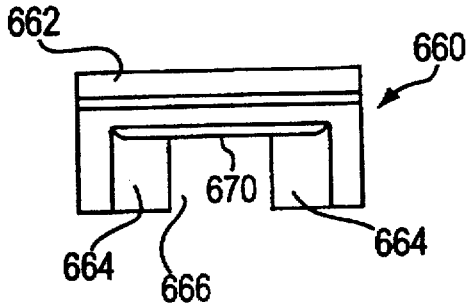
Figure 33C:
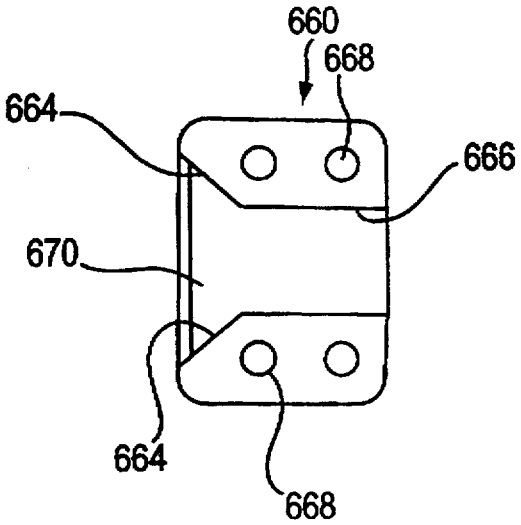
Figure 34A:
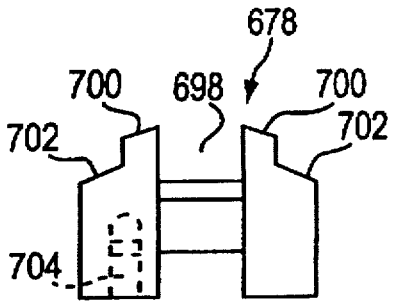
FIG. 34 (*a*) is a back view of the rear main body of FIG. 32(*a*)
Figure 34B:
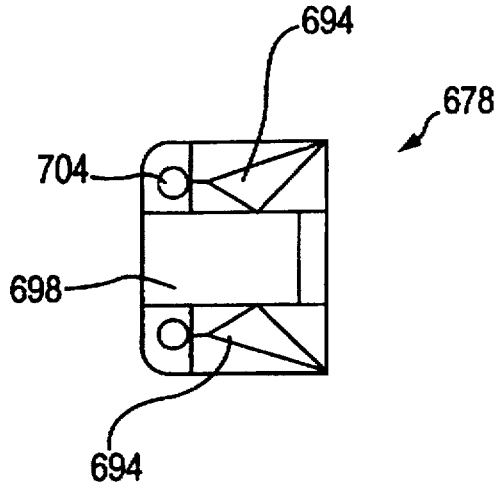
Figure 34C:
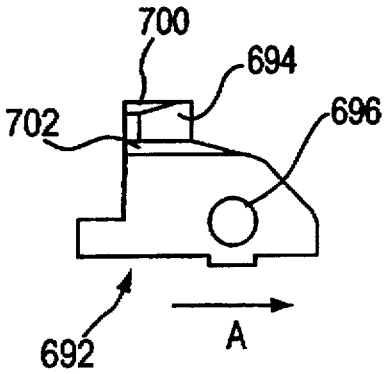
Figure 34D:
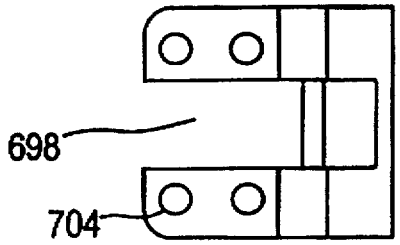
Figure 35:
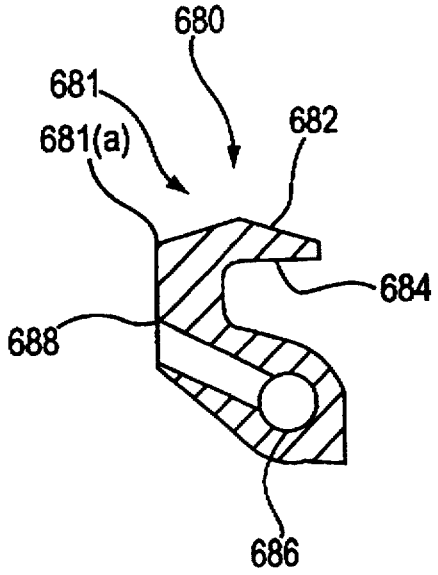
FIG. 35 is a cross-sectional view of the latch of FIG. 32(*a*) taken along line XXXII(*c*)—XXXII(*c*)

The presence of the plurality of holes 782 allows adjustment of the position of main bodies 660, 678 in direction B along the longitudinal axis of the snowboard. Furthermore, although FIG. 32(a) illustrates the main bodies 660, 678 aligned in direction A, the engagement of plates 676, 778 allows the main bodies 660, 678 to be oriented in a line that is angled with respect to direction A.

The front main body 660 (an example of an engaged means) includes top bevel 662 (FIG. 33), cleat receiving bevels 664, a cleat receiving opening 666 and a retaining surface 670. Front main body 660 is affixed to body plate 676 by bolts (not shown) extending through four mounting holes 668. Top bevel 662 slopes downwardly toward the snowboard 12 in a direction opposite direction A. This arrangement helps to direct a frontwardly extending portion of the cleat downwardly and opposite direction A toward the snowboard and to the correct location where the frontwardly extending portion of the cleat may be received by the front main body 660 during step-in. Additionally, the cleat receiving bevels 664 help to guide the frontwardly extending portion of the cleat into the cleat receiving opening 666. Once received within cleat receiving opening 666, the top surface of the frontwardly extending portion of the cleat rests against the retaining surface 670 of the front main body 660. A fuller description of the cleat will be provided below.

The rear main body 678 (FIG. 34) includes a rear support 692 as well as side bevels 694, top bevels 700 and support bevels 702. Located between the bevels 694, 700, 702 is a latch channel 698 extending in direction A. A latch 680 (an example of an engaged means, to be described in greater detail in connection with FIG. 35) is positioned within the latch channel 698 and functions to engage with a rearwardly extending portion of the cleat. Bevels 694, 700, 702 all assist in the engagement of the cleat to the latch 680. Top bevels 700 and support bevels 702 slope downwardly away from latch 680 in a direction substantially parallel to direction B. The side bevels 694 are formed so as to receive the rearwardly extending portion of the cleat. Located in a lower portion of the rear main body 678 is an axle hole 696 extending in direction B. The rear main body 678 is affixed to body plate 676 by bolts (not shown) extending vertically through mounting holes 704 into the rear main body 678.

Latch 680 (FIG. 35) includes a top surface 681, a retaining surface 684 and an axle hole 686. The latch top surface 681 is generally triangular in shape (viewed from the top), with a base 681(a) of the triangle resting in a direction parallel to direction B and located furthest from the front main body 660. Hence, the triangle shaped latch top surface 681 points in direction A toward front main body 660. The latch top surface further includes top bevel 682. Top bevel 682 slopes downwardly in direction A. Retaining surface 684 is a surface on the underside of the latch top surface 681. Retaining surface 684 functions as a stop for the rearwardly extending portion of the cleat during step-in.

Figure 36:
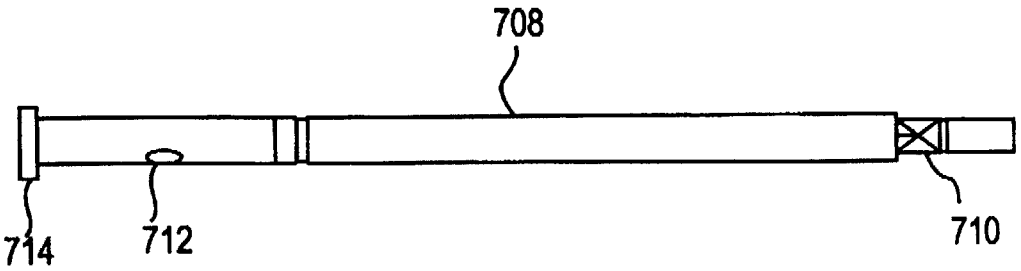
FIG. 36 is a view of the axle of FIG. 32(*a*)
Figure 37:
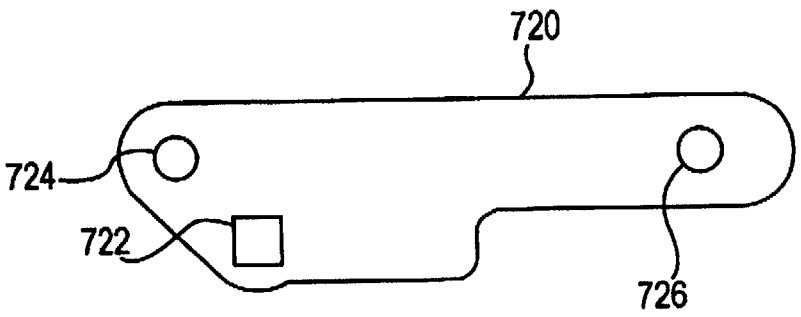
FIG. 37 is a side view of the release arm of FIG. 32(*a*)
Figure 38:
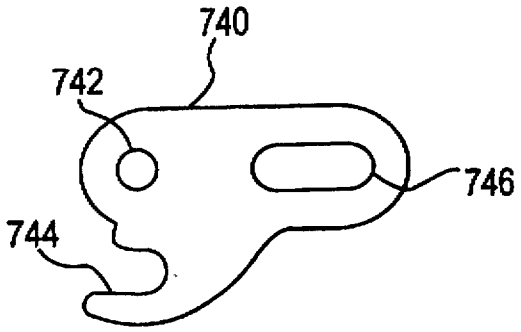
FIG. 38 is a side view of the hook of FIG. 32(*a*)
Figure 39:
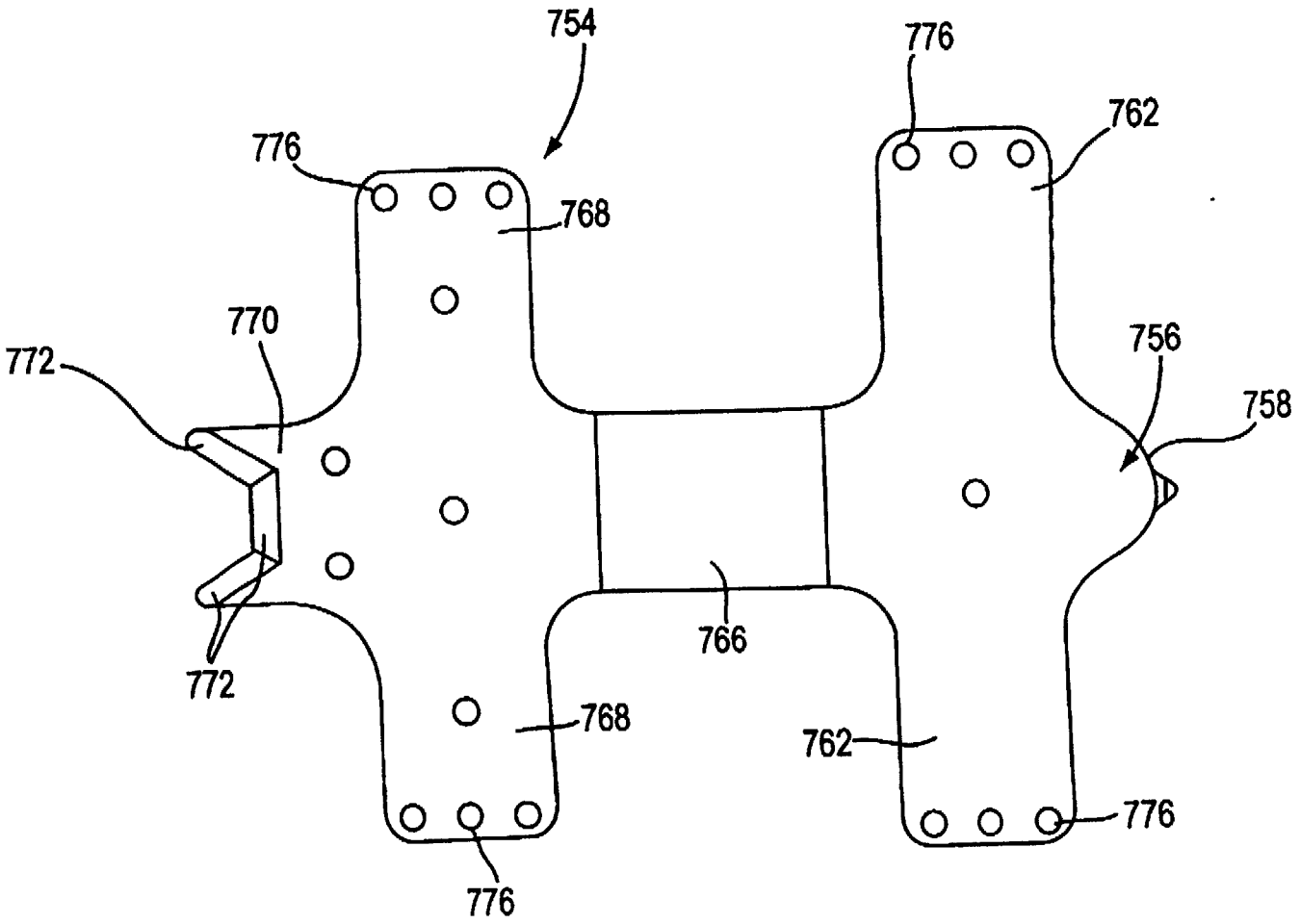
FIG. 39 is a top view of a cleat to be used with the binding of FIG. 32(*a*)

Latch 680 is fixedly mounted upon a rotatable axle 708 (FIG. 36). Latch 680 is positioned within latch channel 698 (FIG. 34) such that axle hole 686 of latch 680 is aligned with axle holes 696 of the rear main body 678. In this manner, axle 708 can be received by axle holes 696 and 686. Latch 680 further includes a mounting hole 688. Axle 708 further includes a latch mounting hole 712. The latch 680 is fixedly mounted to axle 708 by rotating the axle such that latch mounting hole 712 is aligned with the mounting hole 688 of latch 680. In this way, any suitable fixing means can be applied to latch 680 and extend through mounting hole 688 into latch mounting hole 712 of axle 708.

Located on one end of axle 708 is a head 714 and on the other end is a release arm mount 710. Axle 708 is positioned within axle holes 686, 696 such that head 714 rests against rear main body 678. Axle 708 is further supported by an axle support 736 of body plate 676. The release arm mount 710 extends through axle hole 722 of release arm 720 (described in greater detail below). Positioned between axle support 736 (FIG. 32(*a*)) and release arm mount 710 is a coil spring 730 including a first end 732 (FIG. 32(*b*)) and a second end 734. Spring 730 is coiled around axle 708. First end 732 extends radially outward from axle 708 in a direction opposite direction A. Second end 734 also extends radially outward from axle 708 in a rearward direction. Further, second end 734 is located adjacent to or abutting body plate 676.

Release arm 720 is pivotally mounted upon axle 708 in a direction parallel to direction A. A spring retainer hole 724 is located in the end of release arm 720 closest to axle 708. A hook mounting hole 726 (FIG. 37) is located in the end of release arm 720 farthest from axle 708. A spring retainer pin 728 (FIG. 32(*a*)) is positioned within spring retainer hole 724 (FIG. 37) such that the first end 732 of spring 730 is positioned on the underside of spring retainer pin 728.

Hook 740 (FIGS. 32(*d*) and 38) is pivotally mounted upon release arm 720 and extends in a direction parallel to direction A. Hook 740 includes a mounting hole 742, a slot 744 and a cord hole 746. A pin support 750 including a hook pin 748 is positioned on body plate 676 such that hook pin 748 may be received by slot 744. A hook retainer pin 743 is positioned within mounting hole 742 allowing hook 740 to pivot in relation to release arm 720. A cord (not shown) is attached to cord hole 746.

As illustrated in FIGS. 32(*c*) and 39, cleat 754 includes a frontwardly extending toe side (front) tab 756 having an arcuate surface 758. Cleat 754 further includes front arms 762, center portion 766, rear arms 768 and a rearwardly extending heel side (rear) tab 770. Front tab 756 and front arms 762 are in a plane lower than rear tab 770 and rear arms 768. Arms 762, 768 are each in a plane parallel to the snowboard top surface, with center portion 766 sloping upward from the front arms 762 to the rear arms 768. Because of this configuration, the retaining surface 670 of front main body 660 is positioned lower than the retaining surface 684 of rear main body 678. When the cleat 754 is engaged within main bodies 660, 678, there is a separation, for example 10.5 mm, between the lower surface of the cleat 754 and the upper surface of the body plate 676.

Front arms 762 are further defined by a top surface 760 and rear arms 768 are further defined by a top surface 774. The snowboard boot is placed upon and comes in contact with both top surfaces 760, 774 during step-in. As may be seen in FIG. 32(*c*), there is a separation between cleat 754 and the top surface of the snowboard. The separation, which may be, for example 10.5 mm under rear arm 768, facilitates step-in in the presence of snow on the top surface of the snowboard.

Figure 40A:
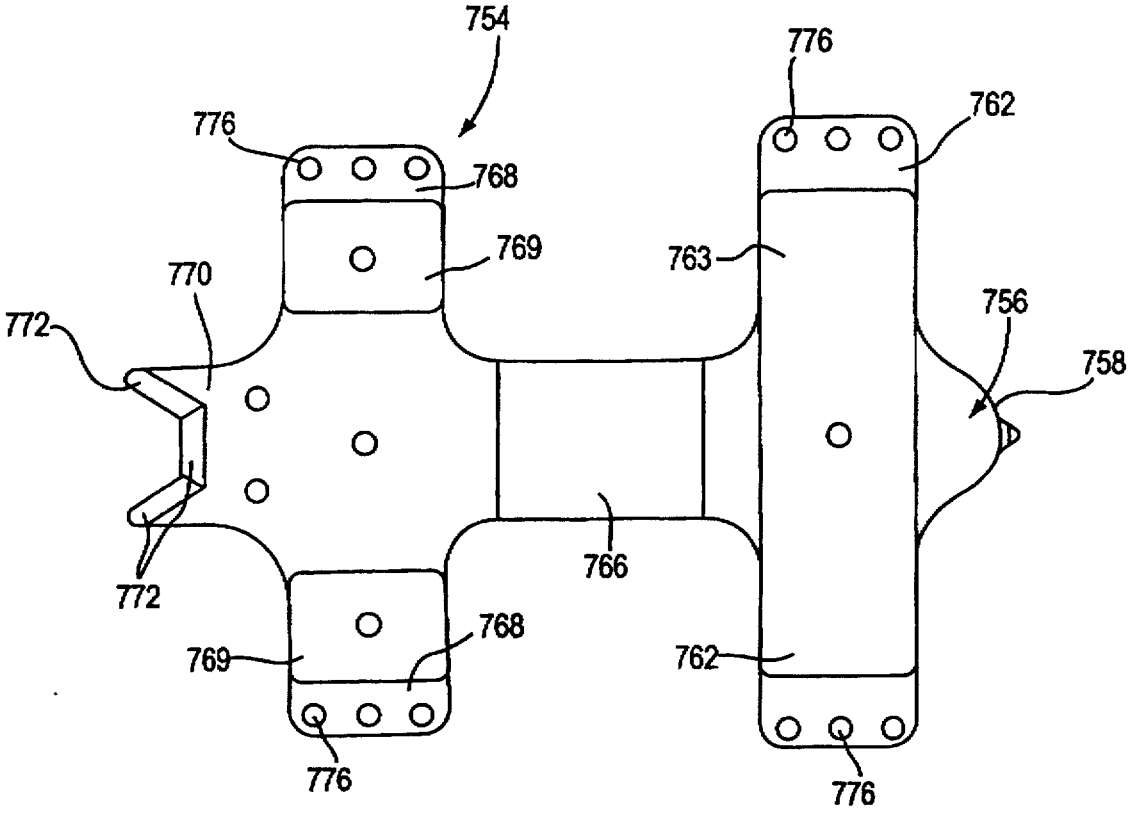
FIG. 40(*a*) is a top view of an alternate embodiment of a cleat to be used with the binding of FIG. 32(*a*)
Figure 40B:
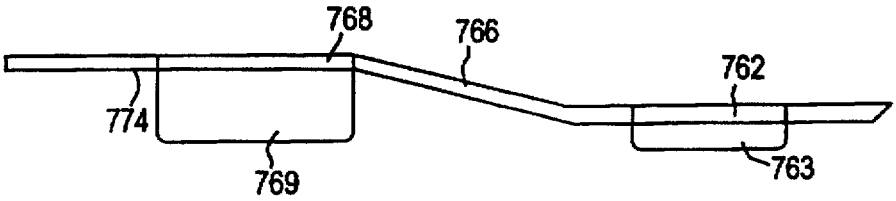

Alternatively, as shown in FIG. 40, front arms 762 may be further defined by the addition of a front pad 763 on the side opposite top surface 760. Additionally, rear arms 768 may include rear pads 769 on the side opposite top surface 774. Pads 763, 769 are made of a rubber like material and add further cushion and support to the snowboard rider. Because the front arms 762 are in a plane lower than the rear arms 768, rear pads 769 may have a greater height than front pad 763. Rear tab 770 further includes tab bevels 772.

Figure 41B:
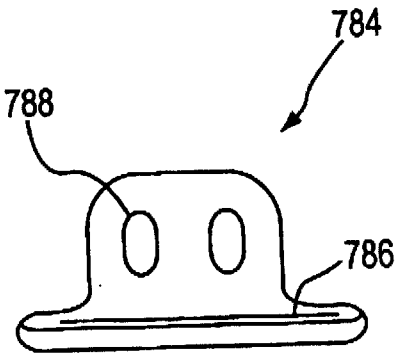
FIGS. 41(*a*) and 41(*b*) are views of a buckle to be used with the cleats of FIGS. 39 or 40(*a*)
Figure 41A:
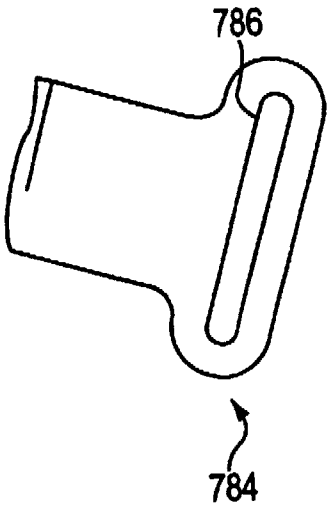

Located at the distal ends of both arms 762, 768 are mounting holes 776. Buckles 784 including mounting holes 788, shown in FIG. 41, are attached at the distal ends of arms 762, 768 by aligning mounting holes 788 with mounting holes 776 and utilizing nuts and bolts (not shown) to attach the buckles 784 to the cleat 754. Buckles 784 are further defined by strap holes 786 which receive straps S so that the snowboard boot may be attached to the cleat 754. The straps S envisioned may be of the hook and loop (e.g., VELCRO brand) type of enclosure, but any suitable strap may be utilized and the invention is not so limited.

Figure 49:
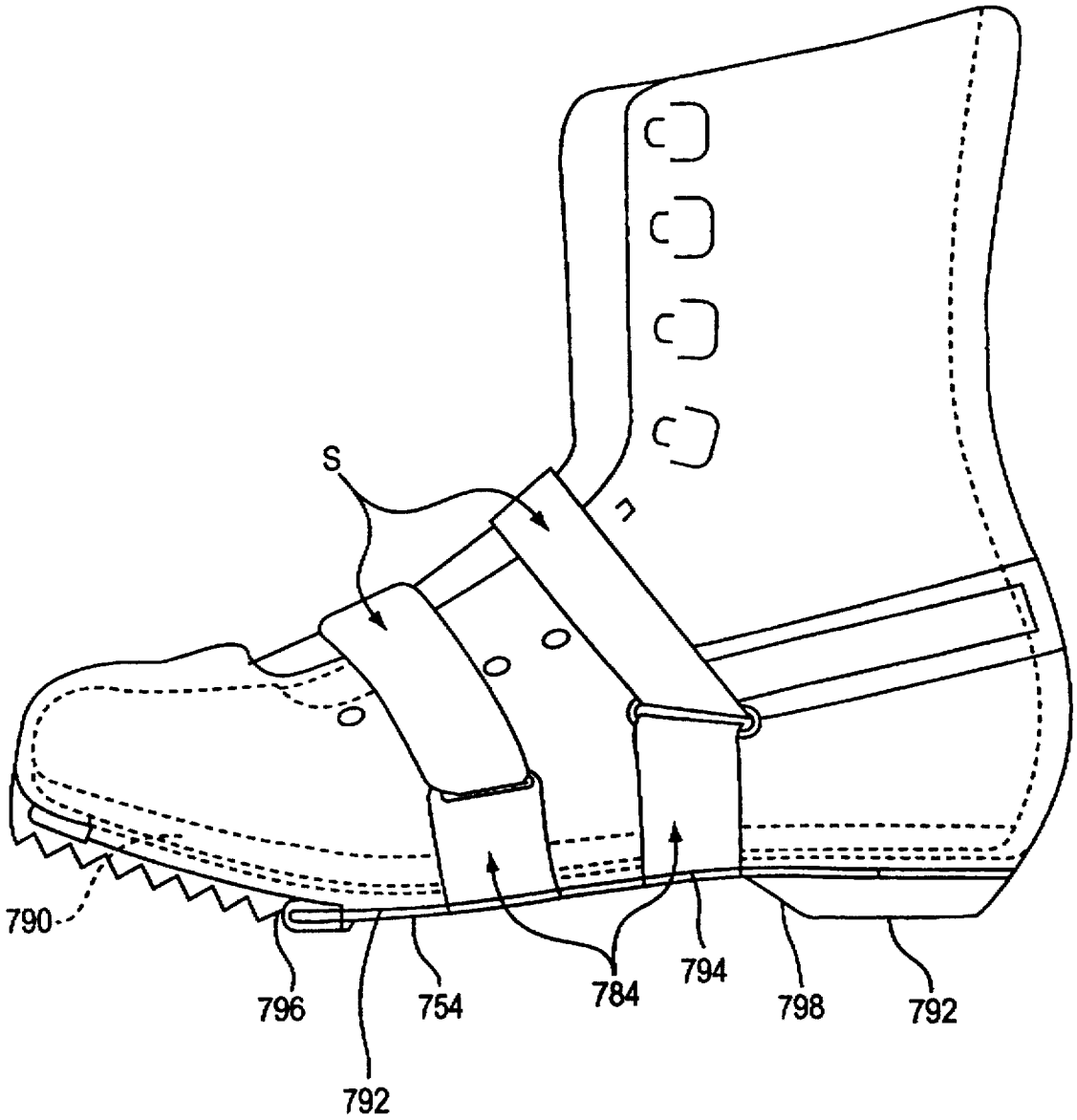
FIG. 49 is a side view of a boot to be used with the binding mechanisms of FIG. 32(*a*)

The boot, illustrated in FIG. 49, has an outsole 790 with a bottom surface 792. Bottom surface 792 includes a recess 794 into which cleat 754 fits, such that the cleat 754 is farther removed from the snowboard than bottom surface 792. Boot recess 794 further includes a front bevel 796 on the outsole 790 which engages front main body 660, thus assisting in the guidance of front tab 756 within the front main body 660. The boot also has a rear bevel 798 on recess 794 which engages with the rear main body 678, assisting the rear tab 770 into engagement with body 678.

Operation of the embodiment illustrated in FIG. 32 is as follows. The rider places the boot upon cleat 754, with front tab 756 extending beyond the ball of the foot toward the toes of the rider. The rider then attaches cleat 754 to the boot using the straps S attached to buckles 784, as illustrated in FIG. 49.

The rider then angles the toe of the boot downwardly over the front main body 660. By doing so, front tab 756 becomes located within the cleat receiving opening 666. Top bevel 662 assists in guiding front tab 756 into engagement with the front main body 660. The cleat receiving bevels 664 further angle front tab 756 into cleat receiving opening 666. Then, cleat 754 moves forward until arcuate surface 758 is engaged with cleat receiving bevels 664 and front bevel 796 of boot outsole 790 is flush with front main body 660. At this time, front tab 756 will be restrained from upward motion by retaining surface 670.

Having fit front tab 756 underneath retaining surface 670, the rider next lowers the heel of the boot toward rear main body 678. If latch 680 is in an engaged position (i.e., a position in which, if rear tab 770 was properly placed, it would be engaged within latch 680), the rider may release the latch 680 by pulling on the cord (not shown) attached to cord hole 746. Upward force exerted on cord hole 746 will cause hook 740 to rotate, disengaging the hook from hook pin 748. Continued upward force further rotates release arm 720. The rotation of release arm 720 causes axle 708 to rotate because axle 708 is engaged to release arm 720 via square axle hole 722. Rotation of axle 708 causes latch 680, which is fixedly mounted to axle 708, to move into the release position.

The rotation of release arm 720 in a direction opposite direction A further causes a biasing force to build up in coil spring 730. Rotation of release arm 720 causes first end 732 of spring 730 to come into contact with spring retainer pin 728, causing rotation of the spring 730. As spring 730 rotates, movement of second end 734 is quickly stopped by body plate 676, causing spring 730 to constrict around axle 708. This creates a biasing force to build up in spring 730 in direction A.

Once latch 680 is in the release position, while still exerting upward force on cord hole 746 the rider may step down with the heel of the boot until rear tab 770 comes into contact with either the side bevels 694, top bevels 700 or support bevels 702. Bevels 694, 700 assist in aligning rear tab 770 so that tab bevels 772 rest against support bevels 702 and rear bevel 798 of outsole 790 engages with rear main body 678. By releasing the upward force on cord hole 746, the constriction of spring 730 will lessen, allowing axle 708 to rotate back under the biasing force of spring 730. This will cause latch 680 to engage rear tab 770.

By exerting a downward force on cord hole 746, a rider can cause release arm 720 and hook 740 to further rotate such that slot 744 engages hook pin 748, thereby locking latch 680 into the engaged position. Once latch 680 is in an engaged position, rear tab 770 is prevented from an upward movement by retaining surface 684.

An alternative engagement of the embodiment illustrated in FIG. 32(*a*) is accomplished by the rider, after engaging the front tab 756 beneath retaining surface 670, stepping the heel of the boot downward such that rear tab 770 comes into contact with top bevel 682. Downward pressure upon bevel 682 forces latch 680 from the engaged position. By overcoming the bias of spring 730, the latch 680 is rotated into the release position, allowing rear tab 770 to proceed underneath the latch top surface 681. Once the downward pressure is released from bevel 682, spring 730 biases latch 680 into the engaged position, engaging rear tab 770 with retaining surface 684.

To disengage the snowboard boot from the snowboard, the rider pulls the cord (not shown) attached to cord hole 746. The upward motion of the cord rotates hook 740 upward, disengaging slot 744 from hook pin 748. Pulling the cord upward further rotates release arm 720 about axle 708. The rotation of release arm 720 causes spring retainer pin 728 to come in contact with first end 732 of spring 730. Further rotation of release arm 720 causes spring 730 to constrict around axle 708. The constriction of spring 730 causes axle 708 to rotate. Because latch 680 is fixedly mounted to axle 708, the latch 680 releases from rear tab 770 of cleat 754, allowing the snowboard rider to disengage the rear tab 758 of cleat 754 from the rear main body 678.

Figure 42A:
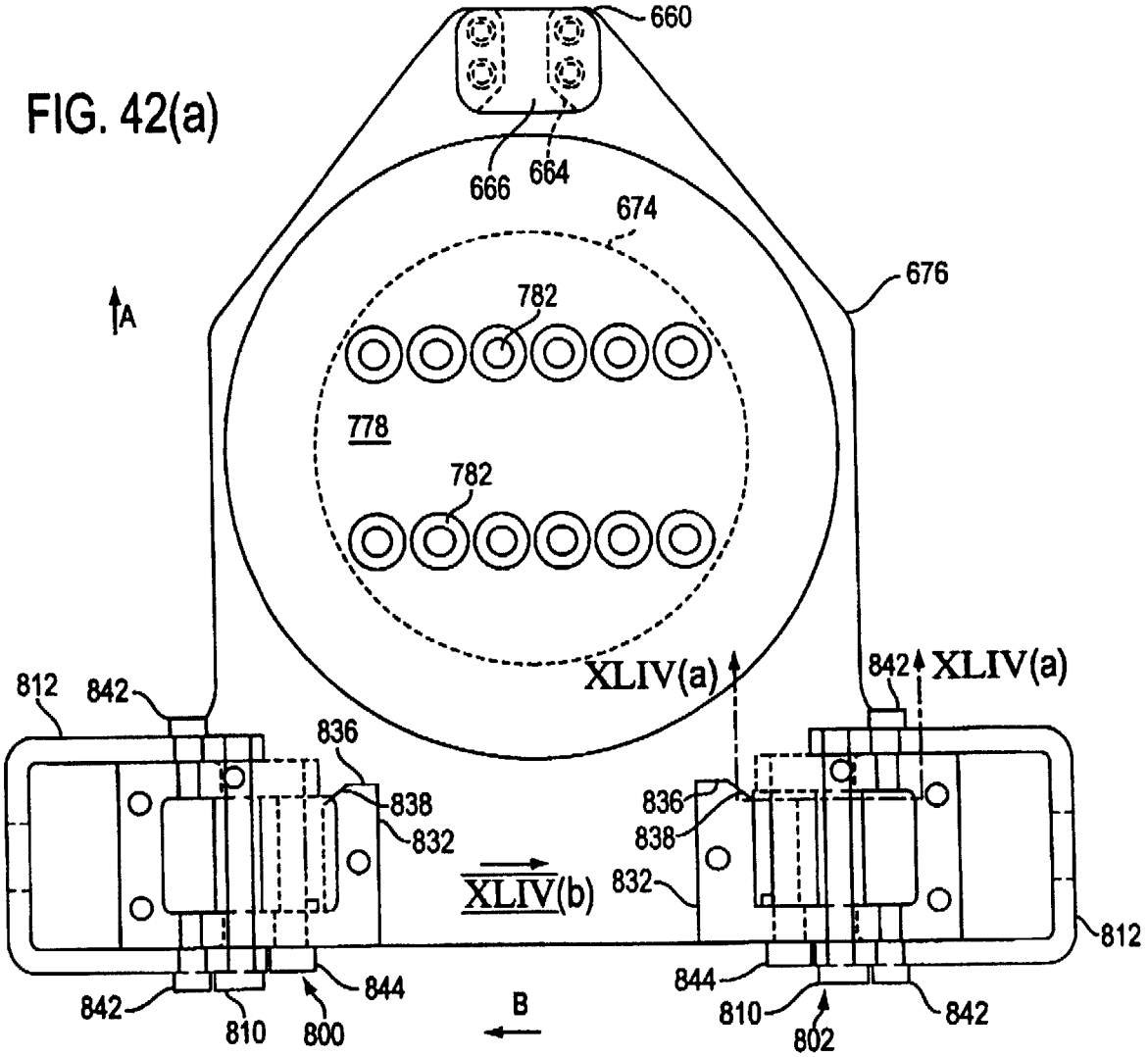
FIG. 42(*a*) is a top view of a sixth embodiment of a snowboard binding constructed in accordance with the present invention.
Figure 42B:
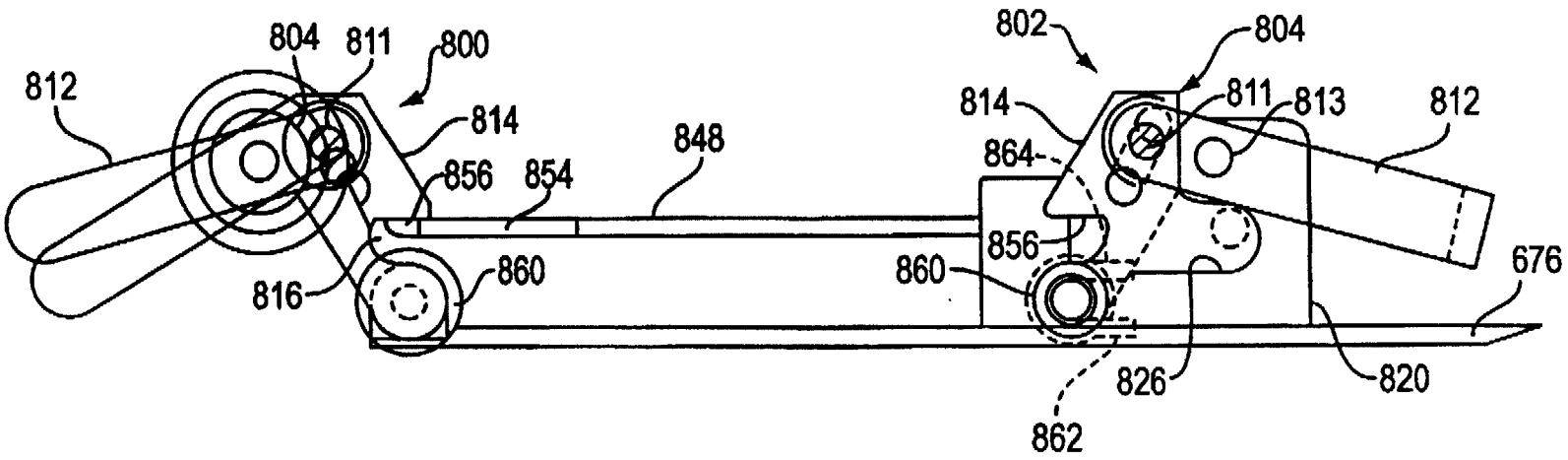

A sixth embodiment of the present invention is shown in FIGS. 42–48. The sixth embodiment contains several common features with the embodiment illustrated in FIGS. 32–41. As illustrated in FIG. 42, the snowboard binding includes a body plate 676, to which is affixed a fixing plate 778. Engagement of the plates 676, 778 is the same as in the previously described embodiment. Front main body 660 is affixed to body plate 676. The snowboard boot may be aligned in direction A during step-in. Direction B is the direction along the longitudinal axis of the snowboard when the rider places his right foot at the rear of the snowboard. Again, however, main body 660 and the rear bodies (described in detail below) may be oriented on a line transverse to direction A as well as moved along direction B.

Figure 43A:
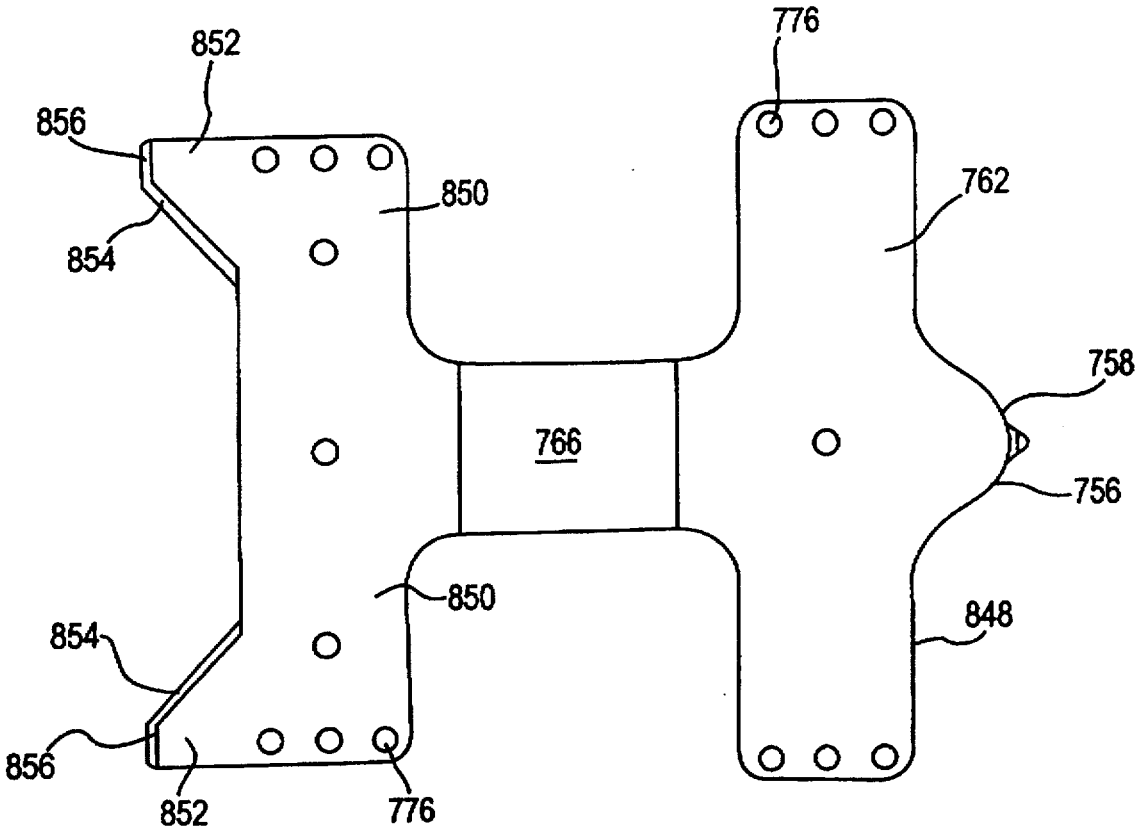
FIG. 43(*a*) is a top view of a cleat to be used with the binding of FIG. 42(*a*)
Figure 43B:
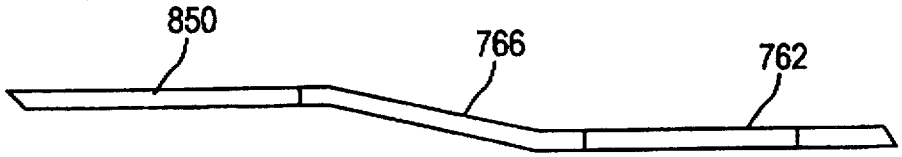
Figure 44A:
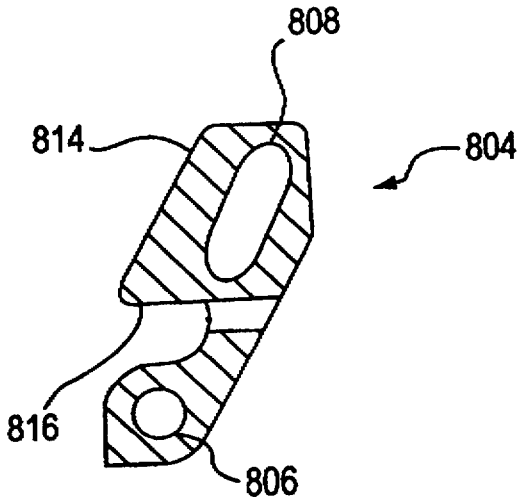
FIG. 44(*a*) is a cross-sectional view of a latch taken along line XLIV(*a*)—XLIV(*a*) of FIG. 42(*a*)
Figure 44B:
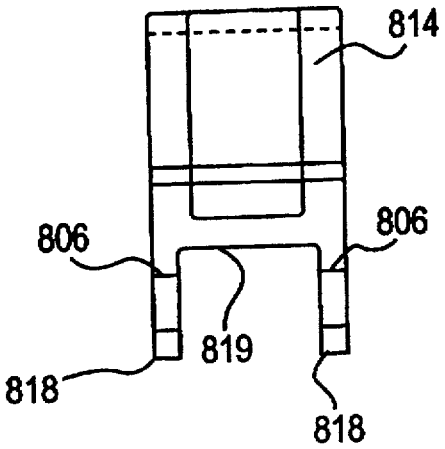
Figure 45C:
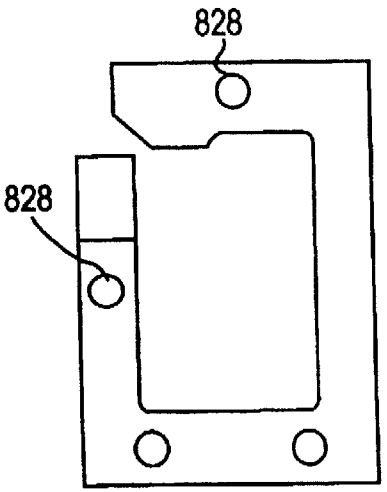
FIG. 45(*a*) is a top view of a base of FIG. 42(*a*)
Figure 45B:
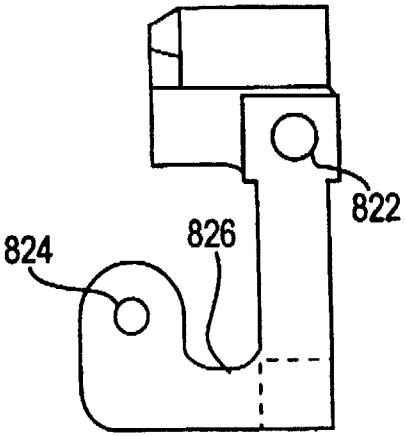
Figure 45A:
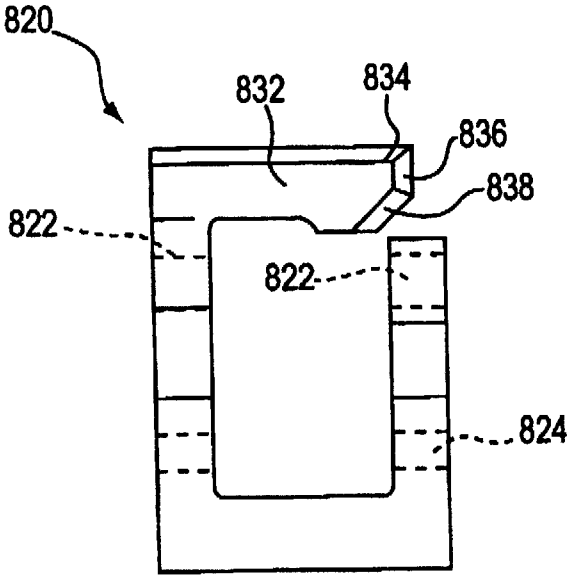
Figure 46A:
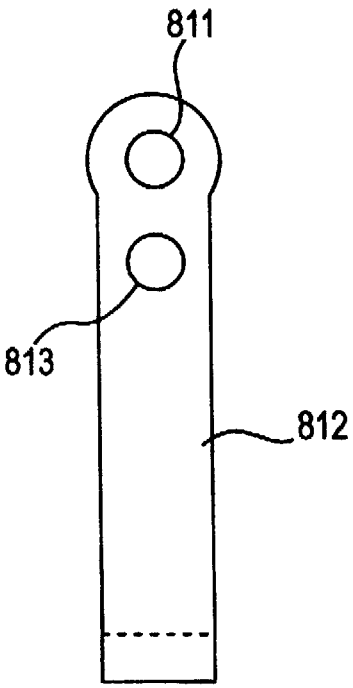
FIGS. 46(*a*) and 46(*b*) are respectively side and top views of a handle of FIG. 42(*a*)
Figure 46B:
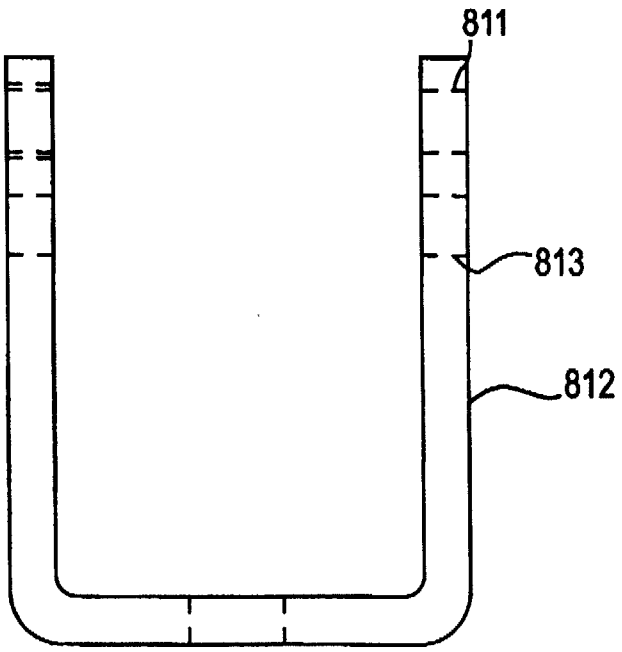
Figure 47A:
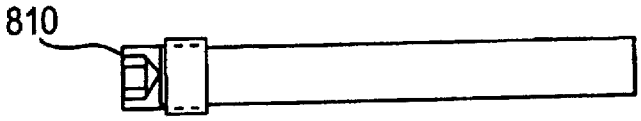
FIG. 47(*a*) is a top view of a cam of FIG. 42(*a*)
Figure 47B:
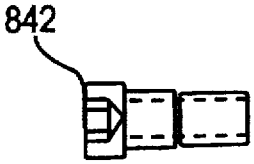
Figure 47C:
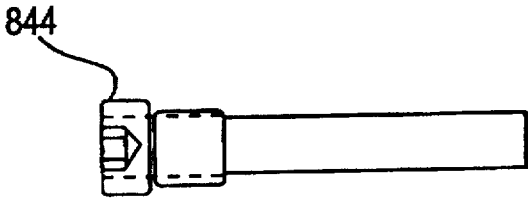
Figure 48:
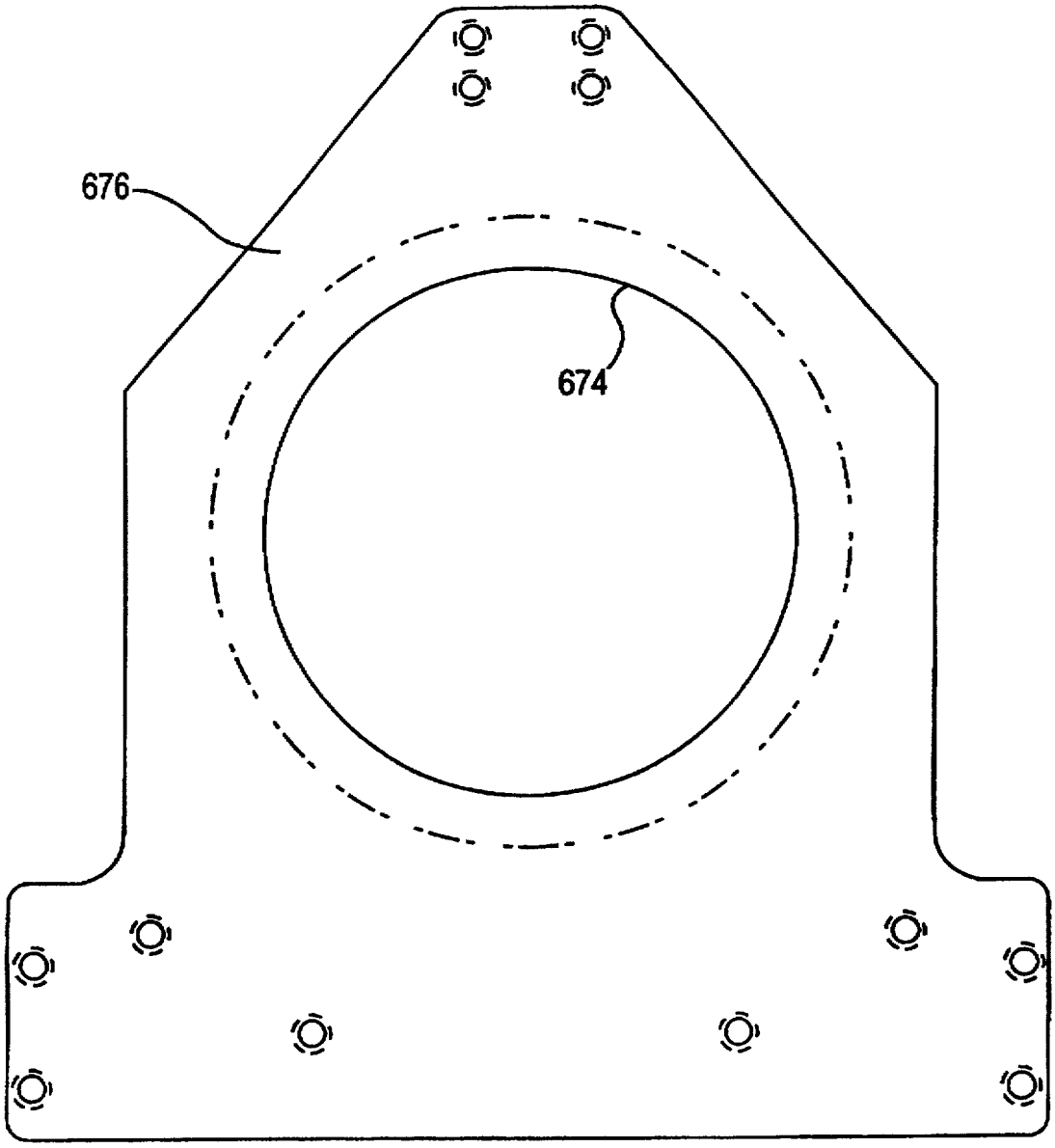
FIG. 48 is a top view of the body plate and fixing plate of FIG. 42(*a*)

As shown in FIG. 43, cleat 848 of this embodiment contains certain elements similar to cleat 754 of the previously described embodiment. For example, cleat 848 includes a front tab 756 having an arcuate surface 758. In addition, cleat 848 includes front arms 762 and center portion 766. Cleat 848 further includes rear arms 850. As in the embodiment illustrated in FIGS. 32–41, the rear arms 850 are positioned on a plane parallel to the snowboard top surface and higher than the plane in which front arms 762 are positioned. Hence, center portion 766 slopes downward from rear arms 850 toward front arms 762. As in the previous embodiment, the cleat 848 is positioned such that a separation, for example 10.5 mm, exists between it and the top surface of the body plate 676. This separation prevents snow from hindering the step-in process.

Rear tabs 852 are located at the distal ends of rear arms 850 and extend rearwardly. Rear tabs 852 further include inside bevels 854 and rear bevels 856. Cleat 848 may also include a front pad 763 and rear pads 769, similar to those illustrated in FIG. 40.

The rear binding mechanism of this embodiment includes a first rear main body 800 and a second rear main body 802 (FIG. 42(*a*)). If the rider places his right foot at the rear of the snowboard, first rear main body 800 is located on the left rearward side of the rider's boot. Rear main bodies 800, 802 include latches 804, handles 812 and bases 820. With reference to FIG. 42(*b*), only one base 820 is shown in order that the engagement of one of the latches 804 with cleat 848 may be more fully illustrated. Each latch 804 (FIG. 44) includes axle holes 806 extending through the latch in a direction parallel to direction A, a cam slot 808, a bevel 814, a cleat receiving groove 816, legs 818, and a spring engaging surface 819.

Handles 812 (FIG. 46) are generally "U" shaped and include cam holes 811 and mounting holes 813. Each base 820 (FIG. 45) includes latch mounting holes 822, handle mounting holes 824, a cam recess 826 and a cleat centering leg 832. The cleat centering leg 832 further includes an inside bevel 834, a forward bevel 836 and an outside bevel 838. Each base 820 is affixed to body plate 676 by way of mounting holes 828 through which bolts (not shown) extend. Each base 820 is positioned on body plate 676 such that the cleat centering leg 832 is located inwardly and each forward bevel 836 faces in direction A.

Each latch 804 is pivotally mounted upon a base 820 by way of a latch axle 844 (FIG. 42(*a*)) extending through latch mounting holes 822 of base 820 and axle holes 806 of latch 804. Additionally, a coil spring 860 (FIG. 42(*b*)), including a first end 862 and a second end 864, is coiled about each latch axle 844. Both ends 862, 864 extend radially outwardly from latch axles 844 in a direction substantially parallel to direction B. First end 862 is adjacent to or abuts body plate 676. As a latch 804 pivots about axle 844, second end 864 of spring 860 comes in contact with spring engaging surface 819. Because movement of first end 862 is stopped by body plate 676, rotation of latch 804 will cause spring 860 to constrict about axle 844, causing an inwardly directed biasing force to build up.

Each handle 812 is also pivotally mounted upon a base 820 by way of a handle mounting pin 842 (FIG. 42(*a*)) extending through mounting holes 813 of handle 812 and handle mounting holes 824 of base 820. Each handle 812 is furthermore engaged with each latch 804 by way of a cam 810 which extends through cam holes 811 of handle 812 and cam slot 808 of latch 804.

Operation of the embodiment illustrated in FIG. 42(*a*) is as follows. The snowboard rider attaches cleat 848 to the bottom of the snowboard boot in a fashion similar to that described previously for the fifth embodiment of the present invention. Once cleat 848 is strapped onto the underside of the snowboard boot, the rider may angle the toe of the boot downwardly over the front main body 660. Utilizing top bevel 662 and cleat receiving bevels 664 of the front main body 660, the rider guides front tab 756 beneath retaining surface 670.

Having done so, the rider proceeds to step downwardly with the heel of the snowboard boot. As the rider steps downwardly, the underside of each rear tab 852 comes in contact with each bevel 814 of each latch 804. As further pressure is exerted downwardly, each latch 804 rotates outwardly about each latch axle 844. This action further allows each latch 804 to swivel with respect to each handle 812 about each cam 810. The undersides of rear tabs 852 will continue to slide down each bevel 814 until rear tabs 852 come to the end of bevels 814 and meet the cleat receiving grooves 816 of latches 804. Once rear tabs 852 are within cleat receiving grooves 816, the downward pressure on latches 804 ceases, and hence, latches 804 will rotate back inwardly under the biasing of springs 860.

An alternative step-in procedure for the embodiment illustrated in FIG. 42(*a*) begins with the snowboard rider placing each latch 804 in a released position. Each latch 804 may be placed in a released position by exerting a force upwardly on each handle 812. By pulling upward on each handle 812, each latch 804 swivels with respect to handle 812 about cam 810. As each handle 812 is pulled upwardly such that it is perpendicular to the snowboard surface, each latch 804 will swivel such that cam 810 rests within cam recess 826. In such a fashion, each cleat receiving groove 816 is moved outwardly. Furthermore, the rotation of each latch 804 will cause the inwardly directed biasing force to build up in spring 860, as described above.

The snowboard rider then angles the toe of the boot downwardly over front main body 660 to guide front tab 756 between top bevels 662 and cleat receiving bevels 664 and beneath retaining surface 670. Having done so, the rider may then guide rear tabs 852 into position by utilizing inside bevels 854 and rear bevels 856 of cleat 848, as well as inside bevels 834, forward bevels 836 and outside bevels 838 of each base 820. Once rear tabs 852 are positioned properly, the rider may then exert a downward and outward force upon handles 812 such that the cams 810 are released from cam recesses 826. Each spring 860, wound about each latch axle 844, biases each latch 804 inwardly such that each cleat receiving groove 816 engages each latch 804. At this point, both tab 756 and tabs 852 are prevented from upward movement.

In all of the foregoing embodiments an elastic material may be provided on the lower surface of the cleat which is compressed between the cleat and the binding or cleat and snowboard during engagement to help reduce vibration transmitted to the boot. It is also possible to position the cleat within the recess in the sole of the boot to maintain the cleat at a height relative to the sole of the boot such that the sole is somewhat compressed against the snowboard or binding while the cleat is engaged by the binding.

Figure 50:
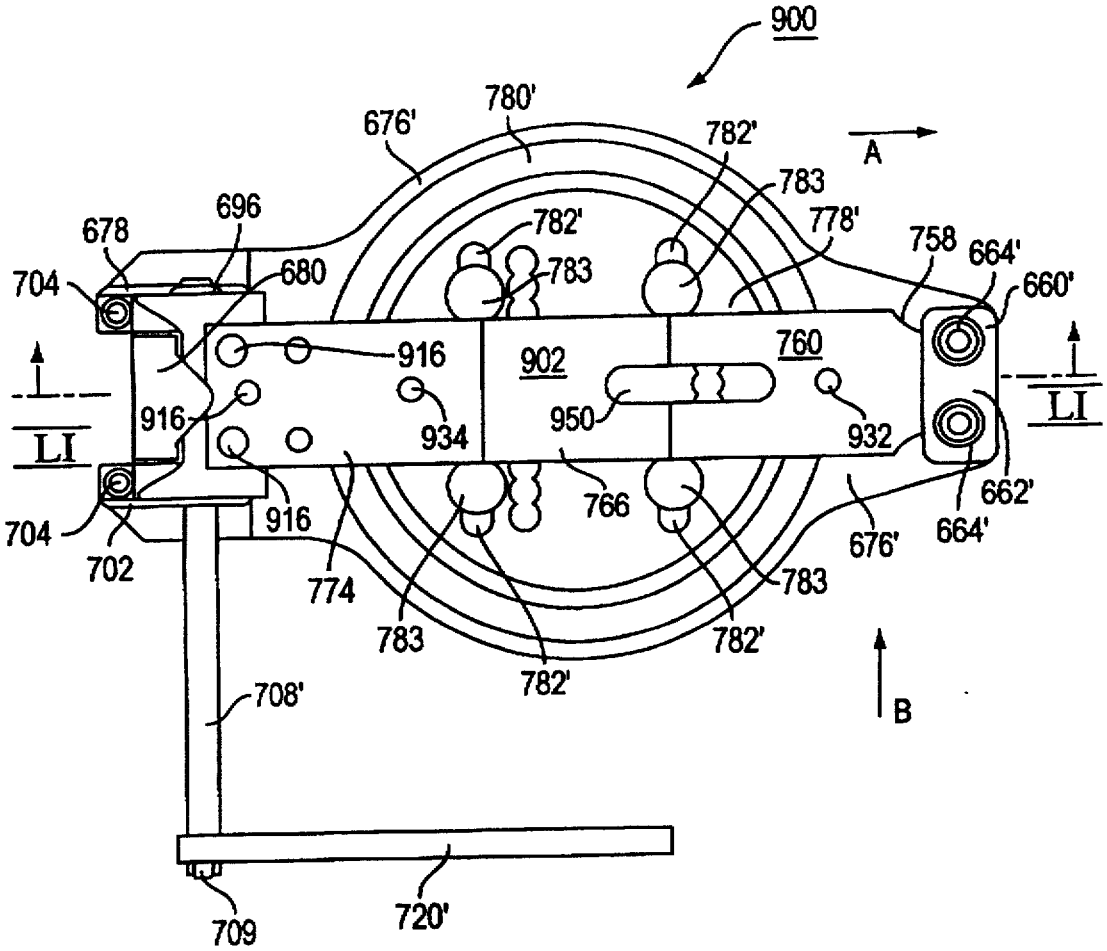
FIG. 50 is a top view corresponding to FIG. 32(*a*), showing a seventh embodiment constructed in accordance with the present invention.
Figure 51:
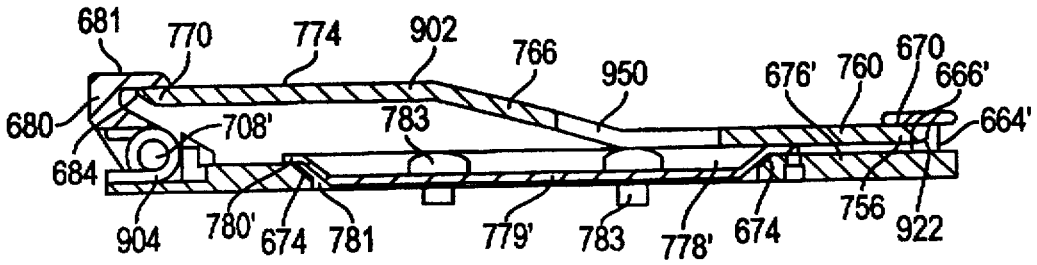
FIG. 51 is a schematic cross-sectional view taken along the line LI—LI of FIG. 50.
Figure 52:
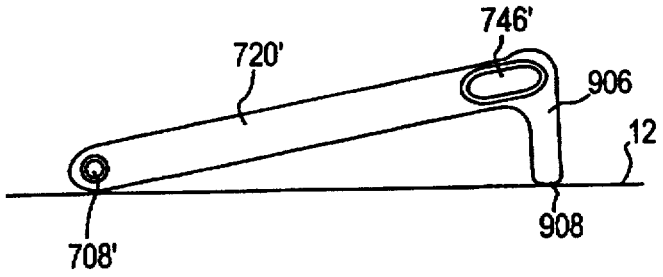
FIG. 52 is a side view of the release arm of FIG. 50.
Figure 53:
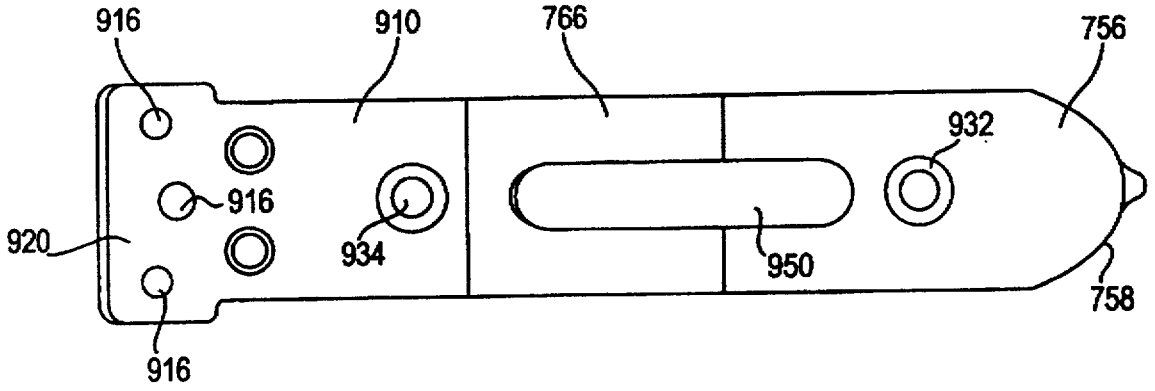
FIG. 53 is a top view of the main cleat portion for the cleat shown in FIG. 50.

FIGS. 50–60 illustrate a binding mechanism 900 constructed in accordance with a seventh embodiment of the present invention. The binding mechanism 900 (FIG. 50) includes a body plate 676', a fixing plate 778', a front main body 660', and a rear main body 678. The front main body 660' and the rear main body 678 are attached to the body plate 676'. The fixing plate 778' is dish-shaped (FIG. 51), with an upper peripheral flange 780' and a lower, generally circular portion 779'. The lower portion 779' fits within a circular opening 781 in the body plate 676'. The flange 780' rests on the body plate 676'. The fixing plate 778' is affixed to the snowboard 12 by bolts 783 extending through mounting holes 782' (FIG. 50). The holes 782' are elongated such that the position of the binding mechanism 900 is adjustable in the direction B.

The front main body 660' includes two mushroom-shaped connectors 664'. A cleat receiving opening 666' (FIG. 51) is defined between the connectors 664'. The connectors 664' have downwardly directed annular surfaces 670. The surfaces 670 are connected to the body plate 676' by respective cylindrical portions 671. The cylindrical portions 671 guide a toe side tab 756 of a cleat 902 into the cleat receiving opening 666'. When the cleat 902 is received within the opening 666', the top surface of the front tab 756 rests against the retaining surfaces 670.

The rear main body 678 has a latch 680 for engaging a heel side tab 770 of the cleat 902. The latch 680 is biased toward the illustrated engaged position by a compression spring 904. The latch 680 is connected to a release arm 720' (FIG. 50) by an axle 708'. The axle 708' is cantilevered from the rear main body 678, in contrast to the fifth embodiment. In the seventh embodiment, the end 709 of the axle 708' distal from the rear main body 678 is not located on the body plate 676'.

Another difference between the fifth and seventh embodiments is that the release arm 720' does not have a hook 740. The release arm 720' is formed in one piece, with a handle 906 (FIG. 52) and a distal end 908. When the latch 680 is in the engaged position, the distal end 908 of the release arm 720' rests on the top surface of the snowboard 12. The handle 906 is biased downwardly against the snowboard 12 (clockwise around the axle 708' as viewed in FIG. 52) by the spring 904. A cord hole 746' is provided above the handle 906, and a cord (not illustrated) is attached to the cord hole 746' for rotating the latch 680 (counterclockwise as viewed in FIG. 51) against the bias of the spring 904 to the release position.

Figure 54:
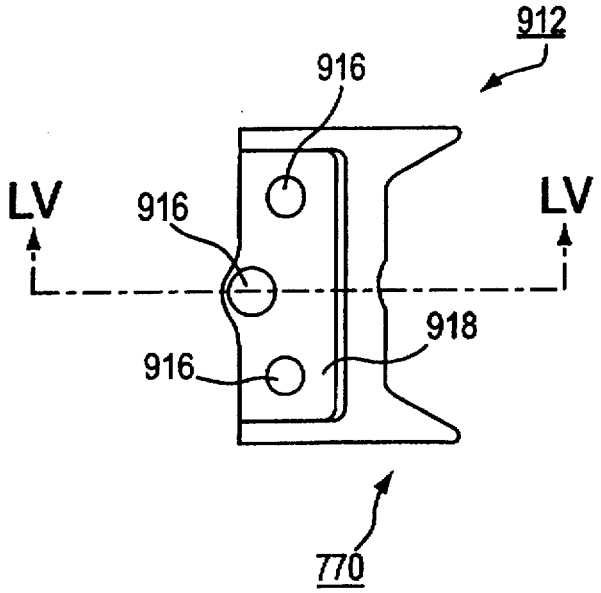
FIG. 54 is a top view of the attachable cleat portion for the cleat shown in FIG. 50.
Figure 55:
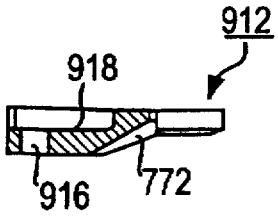
FIG. 55 is a cross-sectional view of the cleat portion of FIG. 54, taken along the line LV—LV.
Figure 56:
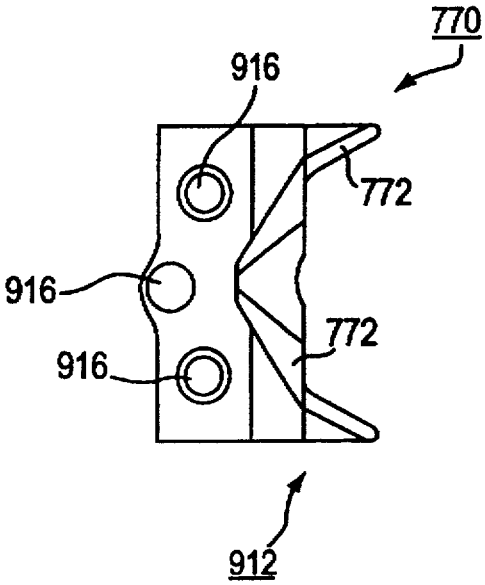
FIG. 56 is a bottom view of the cleat portion of FIG. 54.

The cleat 902 is preferably formed of a main cleat portion 910 (FIG. 53) and an attachable and detachable cleat portion 912 (FIGS. 54–56). The cleat portions 910, 912 are attached to each other by bolts 914 (FIG. 58) extending through respective holes 916 (FIGS. 53–56). When the cleat portions 910, 912 are assembled, a recessed surface 918 (FIG. 55) is in contact with a corresponding surface 920 on the main cleat portion 910. The manufacture of cleat 902 is made easier by dividing the cleat 902 into two portions 910, 912. For example, forming the cleat 902 in two portions 910, 912 makes it easier to form bevel surfaces 922, 772 on the toe and heel side tabs 756, 770, respectively. The main cleat portion 910 may have a cutout portion 950 to reduce the overall weight of the cleat 902.

Figure 57:
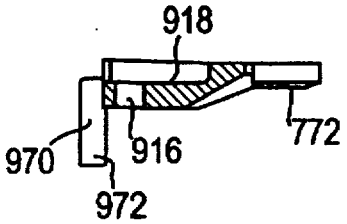
FIG. 57 is a cross-sectional view like FIG. 55, showing an alternative embodiment of the invention.

In an alternative embodiment of the invention, the attachable cleat portion 912 is provided with two legs 970 (FIG. 57). Each leg 970 has a lower end 972 for contacting the body plate 676'. The legs 970 are symmetrically positioned at the rear corners of the cleat portion 912 to help support the cleat 902 in the desired position above the body plate 676'. The legs 970 are narrow to easily penetrate through packed snow which may be located between the cleat 902 and the body plate 676'.

Figure 58:
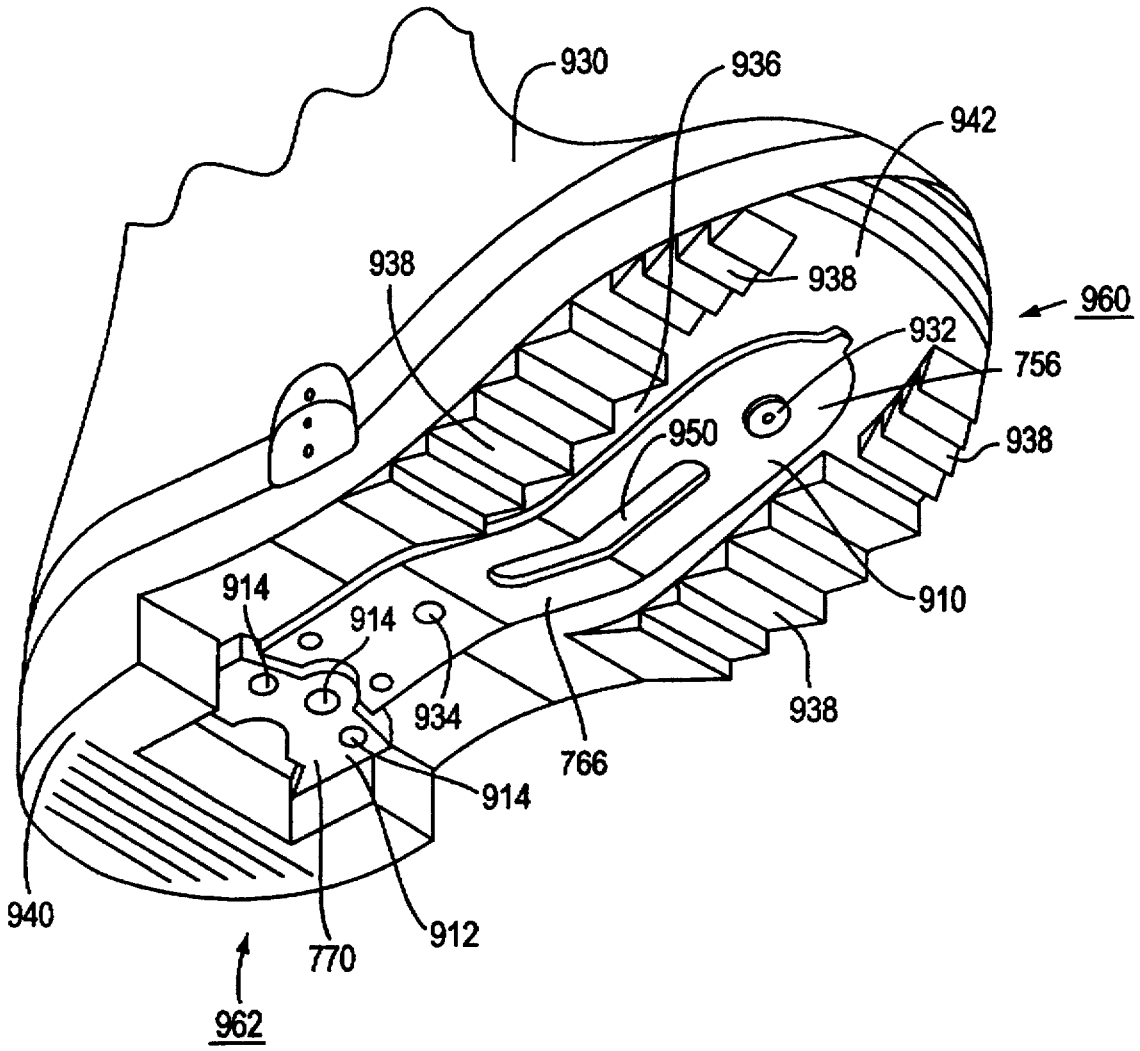
FIG. 58 is a perspective view of the cleat of FIG. 50 attached to a boot sole.
Figure 59:
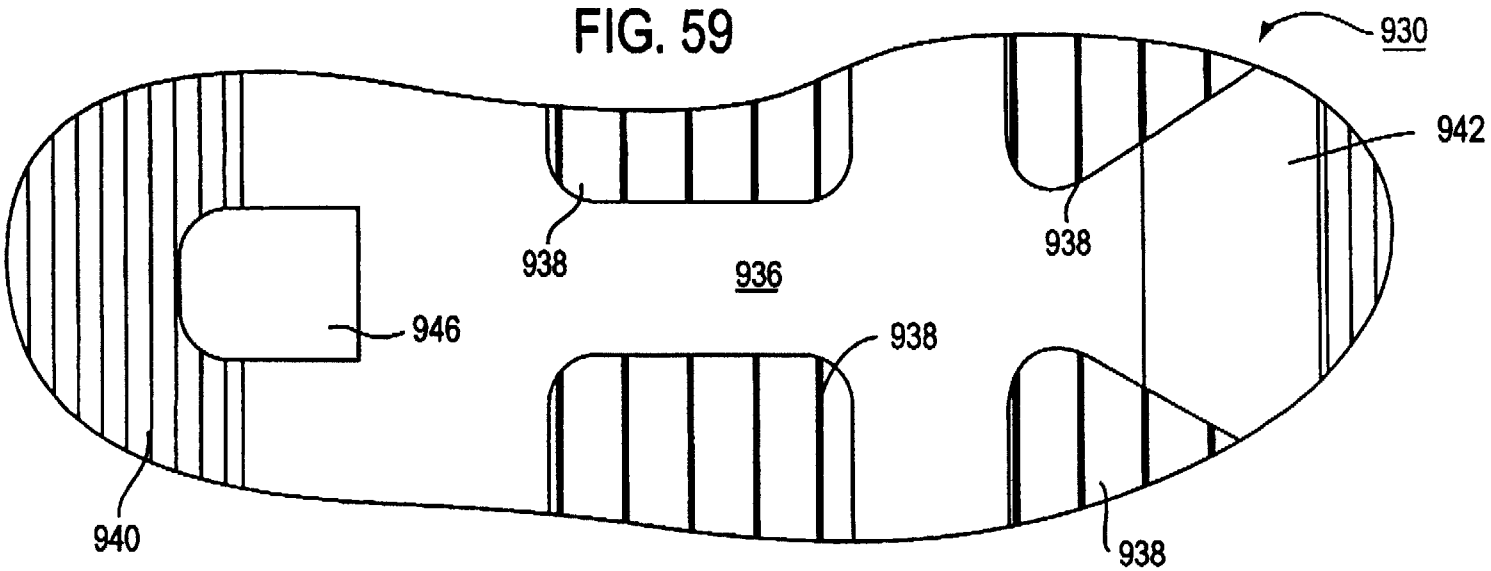
FIG. 59 is a bottom view of the boot of FIG. 58.
Figure 60:
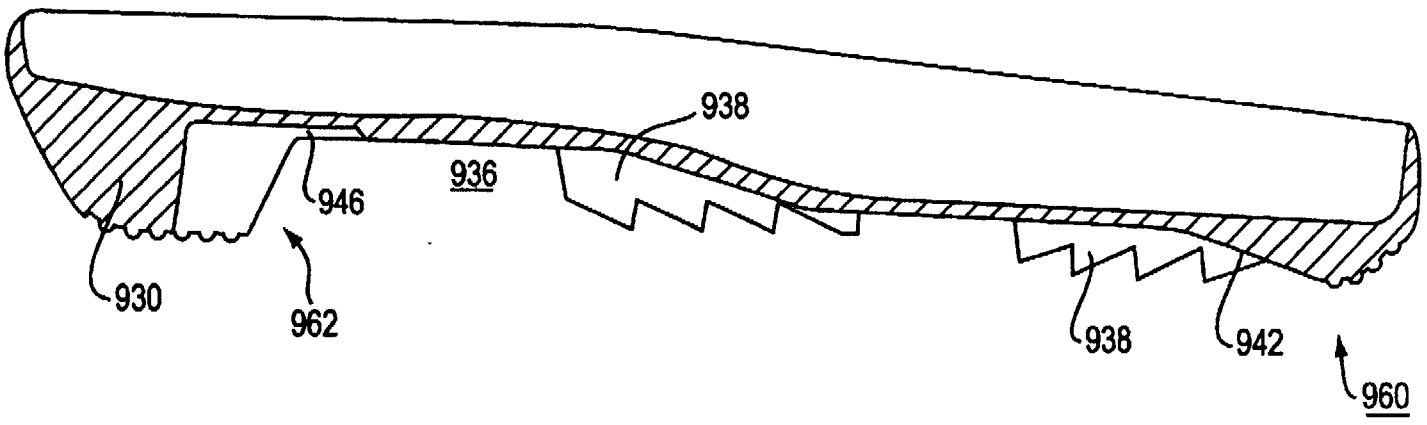
FIG. 60 is a cross-sectional view of the sole of the boot of FIG. 59, taken along the line LX—LX.

When assembled, the cleat 902 is generally like the stepped cleat 754 shown in FIGS. 32(*c*) and 39, except that the cleat 902 has no wings 762, 768. The main portion 910 is in the form of an elongated rectangular plate. As shown in FIG. 58, the cleat 902 is bolted to the toe and heel portions 960, 962 of a boot 930 by bolts 932, 934, with the cleat 902 located within an elongated recess 936. As shown in FIG. 58, the cleat 902 is located between treads 938 and a heel 940. The treads 938 and the heel 940 are relatively deep and extend downwardly beyond the cleat 902 such that the cleat 902 does not come into contact with the snowboard 12. A recess 946 is located in the heel portion 962 to provide room for the latch 680 to engage the heel side tab 770.

The cleat 902 is preferably located within a groove between the treads 938 and is completely surrounded by the treads 938 and heel 940. In the illustrated embodiment of the invention, the cleat 902 does not project out of the boot 930 in any direction. With this arrangement, the cleat 902 does not interfere with walking. The cleat 902 will not bump into the wearer's other boot.

As shown in FIG. 58, the groove and recess 946 may be formed in a continuous manner. Specifically, the groove and recess 946 may be formed such that there is no wall or other obstruction separating one from the other. A design such as this is important in that a completely continuous groove and recess 946 allows for easier removal of accumulated snow from the sole of boot 930.

The boot 930 has a front bevel 942 for engaging the front main body 660' to assist in the guidance of the front tab 756 into the front main body 660'.

To attach the cleat 902 to the binding mechanism 900, the rider angles the toe portion 960 of the boot 930 downwardly over the front main body 660' and locates the front tab 756 within the cleat receiving opening 666'. The cylindrical surfaces of the connectors 664' assist in guiding the front tab 756 into the opening 666'. Then, the cleat 902 moves forward until the arcuate surface 758 is fully engaged within the front main body 660'. At this time, the front tab 756 is restrained from upward motion by the retaining surface 670'.

Having fit the front tab 756 underneath the retaining surface 670', the rider next lowers the heel portion 962 of the boot 930 toward the rear main body 678. If the latch 680 is in the illustrated engaged position, the rider may release the latch 680 by pulling upwardly on the cord (not shown) attached to the cord hole 746'. Rotation of the release arm 720' causes latch 680, which is fixedly mounted to the axle 708', to move into the release position. The latch 680 is biased toward the engaged position by the spring 904.

While still exerting upward force on the cord hole 746' to maintain the latch 680 in the release position, the rider steps down with the heel portion 962 until the rear tab 770 comes into contact with either the side bevels 694, top bevels 700 or support bevels 702 of the rear main body 678. The bevels 694, 700 assist in aligning the rear tab 770. When the upward force on the release arm 720' is released, the axle 708' is rotated in the return direction (clockwise in FIG. 51) by the spring 904, causing the latch 680 to engage the rear tab 770.

In an alternative step-in procedure, after engaging the front tab 756 fully into the front opening 666', the rider steps downwardly with the heel portion 962 of the boot 930. The beveled surfaces of the rear tab 770 and the latch 680 then cause the latch 680 to rotate to its release position (against the bias of the spring 904), similarly to the procedure described above in connection with the fifth embodiment. After the rear tab 770 moves downwardly past the latch 680, the spring 904 returns the latch 680 to the engaged position, and then the rear tab 770 is held in place by the retaining surface 684.

To disengage the boot 930 from the snowboard 12, the rider pulls the cord (not shown) attached to the cord hole 746'. The upward motion of the cord rotates the release arm 720' about the axle 708' and thereby causes the latch 680 to release the cleat 902, allowing the snowboard rider to disengage the cleat 902 from the binding mechanism 900.

The above description and drawings are only illustrative of preferred embodiments which achieve the objects, features and advantages of the present invention, and it is not intended that the present invention be limited thereto. Any modifications of the present invention coming within the spirit and scope of the following claims is to be considered part of the present invention.

What is claimed as new and desired to be protected by Letters Patent of the United States is:

1. A snowboard binding mechanism for securing a cleat of a snowboard boot to a snowboard, comprising:

a main body adapted to be affixed to a top surface of the snowboard, said main body comprising a plurality of inside hooks, a plurality of outside hooks and a latch;

wherein said inside hooks are adapted to engage with and hold a first side of a cleat, said outside hooks are adapted to engage with and hold a second side of a cleat, said inside and outside hooks are oriented to engage with a cleat for attachment to said main body in a first direction from said inside hooks toward said outside hooks, and said latch is adapted to engage the cleat against moving in a direction opposite said first direction.

2. A snowboard binding mechanism as in claim 1, further comprising guiding means for guiding said cleat in a second direction transverse to said first direction to the proper location for engagement with said main body.

3. A snowboard binding mechanism as in claim 2, wherein said guiding means includes a top surface of said main body and forward and rear edges of said top surface arranged such that a portion of said cleat engages said front and rear edges as said cleat is lowered onto said main body thereby guiding said cleat with respect to said main body.

4. A snowboard binding mechanism as in claim 3, wherein:

said inside hooks of said main body are lower than said top surface of said main body, said outside hooks of said main body are higher than said top surface of said main body, such that a portion of said cleat may be placed on said top surface of said main body and then slid in said first direction until said cleat is engaged with said inside hooks and said outside hooks.

5. A snowboard binding mechanism as in claim 4, further comprising a latch axle and a latch spring mounted on said main body, wherein said latch is mounted on said latch axle to be movable relative to said main body between a release position allowing said cleat to be disengaged from said main body and a secure position wherein said latch is engaged with said cleat thereby maintaining the engagement of said cleat with said main body, wherein said spring biases said latch towards said secure position.

6. A snowboard binding mechanism as in claim 5, wherein said latch includes a latch hook which is adapted to engage with the cleat when said latch is in said secure position.

7. A snowboard binding mechanism as in claim 6, wherein said latch is adapted to be between said engaged cleat and the snowboard, and wherein said latch hook is adapted to engage said cleat from a side of the cleat facing the snowboard.

8. A snowboard binding mechanism as in claim 5, wherein said latch further includes a cord attachment means for affixing a pull cord to said latch operable to move said latch to said release position.

9. A snowboard binding mechanism as in claim 1, further comprising a fixing plate including an outer periphery and a groove in said outer periphery, wherein said main body includes a bottom plate, said bottom plate including a mounting edge, wherein said fixing plate groove is adapted to be affixed to the top surface of the snowboard such that said groove engages said mounting edge of said bottom plate, thereby securing said main body to the snowboard.

10. A snowboard binding mechanism as in claim 9, wherein said fixing plate groove and said mounting edge each form at least a portion of a circle so as to permit said main body to be affixed at varying angles relative to the longitudinal axis of the snowboard.

11. A snowboard binding mechanism as in claim 10, wherein said fixing plate includes a plurality of elongated holes through which the fixing plate may be fastened to the snowboard so as to permit said main body to be affixed at varying positions along the longitudinal axis of the snowboard.

12. A snowboard binding mechanism as in claim 6, further comprising said cleat, and wherein said cleat has a first side to be engaged by said inside hooks, a second side to be engaged by said outside hooks, and a latch engaging portion to be engaged by said latch hook.

13. A snowboard binding mechanism as in claim 12, wherein said cleat further includes a main plate positioned between a forward bevel plate and a rear bevel plate, wherein said cleat is adapted for attachment to a snowboard boot such that said forward and rear bevel plates are angled from said main plate toward said main body and away from the boot such that said forward and rear bevel plates engage said forward and rear edges of said main body as said cleat is lowered onto said main body, thereby properly locating said cleat relative to said main body for engagement by said main body.

14. A snowboard binding mechanism as in claim 12, wherein said cleat further comprises a plurality of inside tabs projecting from said cleat main plate towards said main body to be engaged by said inside hooks and a plurality of outside tabs to be engaged by said outside hooks.

15. A snowboard binding mechanism as in claim 13, further comprising a boot including an outsole, said outsole including a bottom surface and a recess formed therein, wherein said cleat is affixed to said boot within said recess such that said cleat main plate is farther from the snowboard than said bottom surface.

16. A snowboard binding mechanism as in claim 15, wherein said boot has a ball width measured at the ball of said boot in a direction transverse to a longitudinal axis of said boot, wherein said cleat has a cleat width measured in a direction transverse to the longitudinal axis of said boot, and wherein said cleat width is less than said ball width.

17. A snowboard binding mechanism as in claim 16, wherein said boot has a heel width measured at the heel of said boot in a direction transverse to said longitudinal axis of said boot, and wherein said cleat width is less than said heel width.

18. A snowboard binding mechanism as in claim 15, wherein said main body secures said cleat in such a manner that the longitudinal axis of said boot is generally transverse to the longitudinal axis of the snowboard.

19. A cleat adapted to be secured by a snowboard binding mechanism, comprising:

a main plate positioned between a forward bevel plate and a rear bevel plate;

wherein said cleat is adapted for attachment to a snowboard boot such that said forward and rear bevel plates are angled downwardly from said main plate in a direction toward the binding mechanism and away from the boot, said forward and rear bevel plates being adapted to engage a top surface of the binding mechanism as the cleat is lowered towards the binding mechanism, thereby properly locating said cleat relative to the binding mechanism for engagement therewith;

a plurality of first side tabs extending from a first side of said main plate toward the binding mechanism, and a plurality of second side tabs affixed to a second side of said main plate, wherein said main plate is adapted to engage the top surface of the binding mechanism and then slide in a direction toward said second side tabs, such that said first and second side tabs engage with the binding mechanism.

20. A snowboard binding mechanism for securing a cleat of a snowboard boot to a snowboard, comprising:

a main body adapted to be affixed to a top surface of the snowboard, said main body including:

(a) two inside hooks spaced apart from each other in a first direction, said two inside hooks being formed as projections;

(b) two outside hooks spaced apart from each other in said first direction and spaced apart from said inside hooks in a second direction extending perpendicular to said first direction, said two outside hooks being formed as projections projecting in the same direction as said two inside hooks;

(c) a latch, pivotably supported to said main body and movable in a plane perpendicular to said first direction.

21. A snowboard binding mechanism according to claim 20, wherein said main body includes:

a front wall extending in said second direction;

a rear wall extending parallel to said front wall; and a bottom plate connecting said front wall and said rear wall, wherein said front wall has one of said inside hooks and one of said outside hooks, and said latch is positioned between said front wall and said rear wall.

22. A snowboard binding mechanism according to claim 21, wherein said front wall and said rear wall are formed as a one-piece integral unit by bending a single plate to form said front and rear walls.

23. A snowboard binding mechanism according to claim 21, wherein said main body further includes a shaft extending in said first direction between said front wall and said rear wall, and wherein said latch is pivotably supported on said shaft.

* * * * *

UNITED STATES PATENT AND TRADEMARK OFFICE

CERTIFICATE OF CORRECTION

PATENT NO. : 5,799,957

DATED : September 1, 1998

INVENTOR(S) : Okajima, et al

It is certified that error appears in the above-identified patent and that said Letters Patent is hereby corrected as shown below:

The title page should be deleted and substitute therefor the attached page.

Signed and Sealed this

Twenty-seventh Day of April, 1999

*Attest:*

Q. TODD DICKINSON

*Attesting Officer*

*Acting Commissioner of Patents and Trademarks*

United States Patent [19]

Okajima et al.

[11] Patent Number: 5,799,957

[45] Date of Patent: Sep. 1, 1998

[54] SNOWBOARD BINDING

[75] Inventors: Shinpei Okajima, Izumi; Yutaka Ueda, Tondabayashi, both of Japan

[73] Assignee: Shimano, Inc., Osaka, Japan

[21] Appl. No.: 760,953

[22] Filed: Dec. 6, 1996

Related U.S. Application Data

[60] Division of Ser. No. 348,844, Nov. 28, 1994, which is a continuation-in-part of Ser. No. 254,889, Jun. 6, 1994, abandoned.

[51] Int. Cl.[6] ..... A63L 9/00

[52] U.S. Cl. ..... 280/14.2; 280/607; 280/613; 280/624; 280/632

[58] Field of Search ..... 280/11.3, 607, 280/613, 617, 618, 620, 623, 624, 625, 626, 627, 631, 632, 634, 14.2; 36/115, 117.1, 117.3

[56] References Cited

U.S. PATENT DOCUMENTS

| | | | |
|---|---|---|---|
| Re. 33,544 | 2/1991 | Dennis et al. | 280/618 |
| 3,154,312 | 10/1964 | Marchand | 280/11.13 |
| 3,471,161 | 10/1969 | Cubberley | 280/11.35 |
| 3,775,875 | 12/1973 | Dvorsky | 36/117.3 |
| 3,834,723 | 9/1974 | Erlebach | 280/11.35 |
| 3,900,204 | 8/1975 | Weber | 280/11.13 |
| 3,909,026 | 9/1975 | Salomen | 280/11.35 |
| 3,910,591 | 10/1975 | Salomon | 280/11.35 |
| 3,955,825 | 5/1976 | Kubelka et al. | 280/618 |
| 4,026,045 | 5/1977 | Druss | 36/117.3 |
| 4,165,889 | 8/1979 | Weinstein et al. | 280/626 |
| 4,184,696 | 1/1980 | Settembre | 280/615 |
| 4,270,770 | 6/1981 | Spademan | 280/624 |
| 4,275,904 | 6/1981 | Pedersen | 280/818 |
| 4,361,344 | 11/1982 | Hull | 280/613 |
| 4,392,666 | 7/1983 | Ramer | 280/614 |
| 4,571,858 | 2/1986 | Faulin | 36/117 |
| 4,652,007 | 3/1987 | Dennis | 280/618 |
| 4,728,116 | 3/1988 | Hill | 280/618 |
| 4,732,405 | 3/1988 | Freisinger et al. | 280/634 |
| 4,973,073 | 11/1990 | Raines et al. | 280/624 |
| 5,035,443 | 7/1991 | Kincheloe | 280/618 |
| 5,116,074 | 5/1992 | Peyre | 280/618 |
| 5,145,202 | 9/1992 | Miller | 280/613 |
| 5,236,216 | 8/1993 | Ratzek | 280/14.2 |
| 5,299,823 | 4/1994 | Glaser | 280/607 |
| 5,368,320 | 11/1994 | Teeter et al. | 280/14.2 |
| 5,505,477 | 4/1996 | Turner et al. | 36/117.3 |
| 5,544,909 | 8/1996 | Laughlin | 280/617 |
| 5,551,728 | 9/1996 | Barthel et al. | 280/818 |
| 5,558,355 | 9/1996 | Henry | 280/624 |

*Primary Examiner*—Brian L. Johnson
*Assistant Examiner*—Min Yu

[57] ABSTRACT

A snowboard binding for releasably connecting a boot to a snowboard. One embodiment of the invention includes inner and outer main bodies to receive a two-piece cleat. A second embodiment includes inner and outer hooks for hooking, and a latch for securing, a one-piece cleat. A third embodiment includes a front main body and a spring-loaded latch in a rear main body for engaging a one-piece cleat. A fourth embodiment engages a one-piece cleat with inwardly beveled, semi-circular inner and outer main bodies. A fifth embodiment engages a one-piece cleat with a front main body and a latch, fixedly mounted upon an axle, within a rear main body. The latch is biased toward the engaged position by a spring. In a sixth embodiment of the invention, a one-piece cleat is engaged with a front main body and two rear spring biased latches. In a seventh embodiment, among other things, the cleat is formed in two pieces.

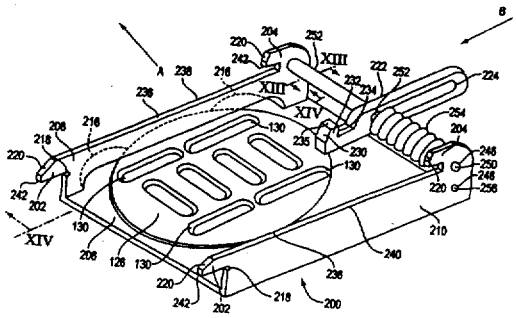

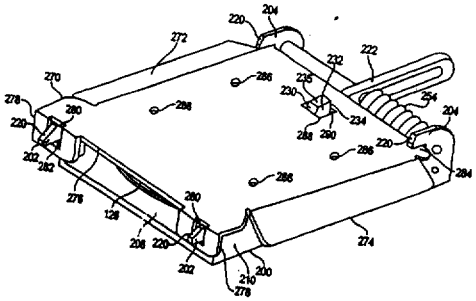

23 Claims, 46 Drawing Sheets